US011173733B2

(12) United States Patent
Kawai

(10) Patent No.: US 11,173,733 B2
(45) Date of Patent: Nov. 16, 2021

(54) PRINTING DEVICE REPEATEDLY PERFORMING PRINT CYCLE INCLUDING A PLURALITY OF CONVEYING PERIODS AND A PLURALITY OF PRINTING PERIODS

(71) Applicant: BROTHER KOGYO KABUSHIKI KAISHA, Nagoya (JP)

(72) Inventor: Junya Kawai, Anpachi-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/835,716

(22) Filed: Mar. 31, 2020

(65) Prior Publication Data

US 2020/0406644 A1 Dec. 31, 2020

(30) Foreign Application Priority Data

Jun. 28, 2019 (JP) ..... JP2019-122262

(51) Int. Cl.
*B41J 13/00* (2006.01)

(52) U.S. Cl.
CPC ..... *B41J 13/0009* (2013.01)

(58) Field of Classification Search
CPC ..... B41J 2/3556; B41J 3/4075; B41J 11/42; B41J 11/425
See application file for complete search history.

(56) References Cited

U.S. PATENT DOCUMENTS 8,994,766 B2 * 3/2015 Kako ..... B41J 2/3556 347/188
2007/0076081 A1 * 4/2007 Yoshida ..... B41J 11/42 347/104
2007/0176955 A1 * 8/2007 Yoshida ..... B41J 13/0027 347/16
2008/0012891 A1 * 1/2008 Murashima ..... B41J 11/007 347/16
2015/0029287 A1 1/2015 Kako et al.

FOREIGN PATENT DOCUMENTS

JP 2013018141 A 1/2013
JP 2015024547 A 2/2015

* cited by examiner

*Primary Examiner* — Lam S Nguyen
(74) *Attorney, Agent, or Firm* — Kenealy Vaidya LLP

(57) ABSTRACT

A printing device is configured to perform a plurality of print cycles including a plurality of conveying periods and a plurality of printing periods. An N-th print cycle includes: selecting m number of conveying periods from among the plurality of conveying periods; setting one or more valid conveying periods; obtaining a first time duration by dividing a time duration corresponding to the m number of conveying periods into a plurality of time segments; adjusting a time duration of each of the one or more valid conveying periods using the first time duration; outputting a pulse in each of the one or more valid conveying periods to convey the printing medium in response to a motor being driven to rotate upon receipt of the pulse; and printing a portion of an object on the printing medium in each of the plurality of the printing periods.

16 Claims, 21 Drawing Sheets

FIG. 5A Lp = Li
OBJECT: 1417 dots
TAPE FEEDING AMOUNT: 100 mm (LENGTH CORRESPONDING TO 1417 dots)
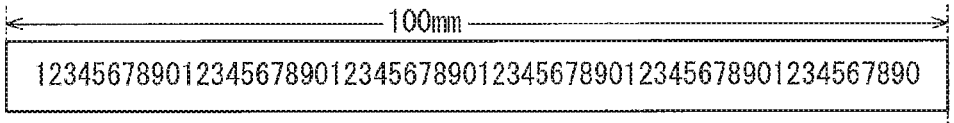
FIG. 5B Lp > Li
OBJECT: 1417 dots
TAPE FEEDING AMOUNT: 105 mm
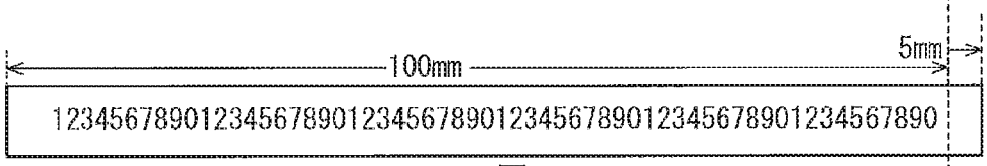
FIG. 5C
OBJECT: 1417 dots
TAPE FEEDING AMOUNT: 100 mm (LENGTH CORRESPONDING TO (1417 − 71) dots)
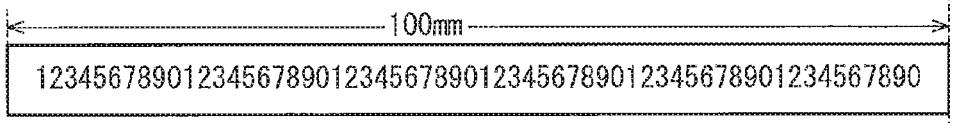
FIG. 5D Lp < Li
OBJECT: 1417 dots
TAPE FEEDING AMOUNT: 95 mm
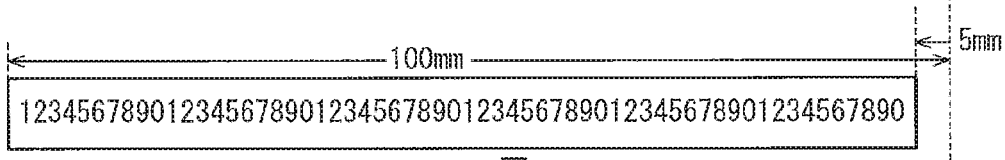
FIG. 5E
OBJECT: 1417 dots
TAPE FEEDING AMOUNT: 100 mm (LENGTH CORRESPONDING TO (1417 + 71) dots)
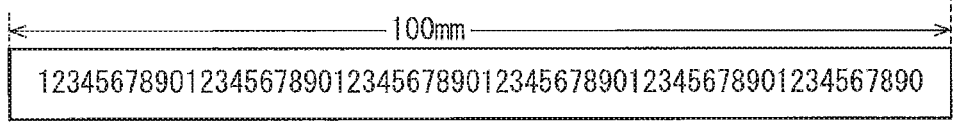

FEEDING PERIOD ADJUSTMENT (Lp > Li)

FEEDING PERIOD ADJUSTMENT (Lp > Li)

PRINTING PERIOD ADJUSTMENT (Lp > Li)

PRINTING PERIOD ADJUSTMENT (Lp > Li)

FEEDING PERIOD ADJUSTMENT (Lp < Li)

FEEDING PERIOD ADJUSTMENT (Lp < Li)

PRINTING PERIOD ADJUSTMENT (Lp < Li)

PRINTING PERIOD ADJUSTMENT (Lp < Li)

FEEDING PERIOD ADJUSTMENT (Lp > Li)

FEEDING PERIOD ADJUSTMENT (Lp > Li)

PRINTING PERIOD ADJUSTMENT (Lp > Li)

PRINTING PERIOD ADJUSTMENT (Lp > Li)

FEEDING PERIOD ADJUSTMENT (Lp < Li)

FEEDING PERIOD ADJUSTMENT (Lp < Li)

PRINTING PERIOD ADJUSTMENT (Lp < Li)

PRINTING PERIOD ADJUSTMENT (Lp < Li)

FEEDING PERIOD ADJUSTMENT (Lp > Li)

FEEDING PERIOD ADJUSTMENT (Lp > Li)

PRINTING PERIOD ADJUSTMENT (Lp > Li)

PRINTING PERIOD ADJUSTMENT (Lp > Li)

FEEDING PERIOD ADJUSTMENT (Lp < Li)

FEEDING PERIOD ADJUSTMENT(Lp < Li)

PRINTING PERIOD ADJUSTMENT (Lp < Li)

PRINTING PERIOD ADJUSTMENT (Lp < Li)

FEEDING PERIOD ADJUSTMENT (Lp < Li)

FEEDING PERIOD ADJUSTMENT (Lp < Li)

PRINTING DEVICE REPEATEDLY PERFORMING PRINT CYCLE INCLUDING A PLURALITY OF CONVEYING PERIODS AND A PLURALITY OF PRINTING PERIODS

CROSS REFERENCE TO RELATED APPLICATION

This application claims priority from Japanese Patent Application No. 2019-122262 filed Jun. 28, 2019. The entire content of the priority application is incorporated herein by reference.

TECHNICAL FIELD

The present disclosure relates to a printing device.

BACKGROUND

Printing devices creating labels by printing images on printing media such as tape and the like are well known in the art. For example, a conventional label printer controls the tape feeding speed in order to increase or decrease the length of the label image printed on a label. When the ratio of the label length to a standard value is less than 100%, the label printer decreases the tape feeding speed. When the ratio of the label length to a standard value is more than 100%, the label printer increases the tape feeding speed.

SUMMARY

Print control schemes of printing devices include synchronized printing and non-synchronized printing. In synchronized printing, the conveyance of a printing medium and print control are performed in synchronization. In non-synchronized printing, the conveyance of a printing medium and print control are performed asynchronously. When the conveying speed of the printing medium varies as the tape feeding speed in the label printer described above, non-synchronized printing is usually performed during a time duration in which the conveying speed of the printing medium is maintained at constant and does not vary. This is because if non-synchronized printing is performed while the conveying speed is varying, the printing process is likely to become complicated, and as a result, it is often difficult to perform precise non-synchronized printing. However, the printing process may not always include a time duration of a constant conveying speed of the printing medium. Therefore, it is desired that precise non-synchronized printing be performed while the conveying speed is varying.

In view of the foregoing, it is an object of the present disclosure to provide a printing device capable of performing precise non-synchronized printing even while the conveying speed of a printing medium is varying.

In order to attain the above and other objects, the present disclosure provides a printing device including: a motor, a controller; and a memory. The motor is used for conveying a printing medium in a conveying direction. The controller is configured to output a pulse. The motor is configured to be driven to rotate in response to receiving the pulse. The printing medium is conveyed in the conveying direction at a conveying speed in response to the motor being driven to rotate. The memory stores a set of program instructions therein. The set of program instructions, when executed by the controller, causes the printing device to perform a plurality of print cycles one by one to print an object. The plurality of print cycles includes an N-th print cycle where N is an integer greater than or equal to one. Each of the print cycles includes a plurality of conveying periods from a first conveying period to an n-th conveying period and a plurality of printing periods from a first printing period to an n-th printing period where n is an integer greater than or equal to two. The pulse is outputted in each of the plurality of conveying periods. A portion of the object is printed in each of the plurality of printing periods. The object is designed to have a first length in the conveying direction and is expected to have a second length in the conveying direction in actual printed size. The conveying speed of the printing medium is increased or decreased during at least part of the plurality of conveying periods in the N-th print cycle. The N-th print cycle includes: (a) selecting; (b) setting; (c) obtaining; (d) adjusting; and (e) performing. The (a) selecting selects, in a case where the second length does not match the first length, m number of conveying periods from among the plurality of conveying periods where m is an integer greater than or equal to one and smaller than n. m is set to a value corresponding to a first ratio of a difference between the first length and the second length to the first length. The (b) setting sets one or more valid conveying periods based on the selected m number of conveying periods. The (c) obtaining obtains a first time duration by dividing a time duration corresponding to the selected m number of conveying periods into a plurality of time segments. The (d) adjusting adjusts a time duration of each of the one or more valid conveying periods using the first time duration. The (e) performing performs the one or more valid conveying periods in parallel with performing the plurality of printing periods. The (e) performing includes: (e1) outputting; and (e2) printing. The (e1) outputting outputs the pulse in each of the one or more valid conveying periods to convey the printing medium in response to the motor being driven to rotate upon receipt of the pulse. The (e2) printing prints the portion of the object on the printing medium in each of the plurality of printing periods. In a case where the conveying speed is increased from the first conveying period to the n-th conveying period in the N-th print cycle, the (a) selecting selects the m number of conveying periods in descending order from the n-th conveying periods. In a case where the conveying speed is decreased from the first conveying period to the n-th conveying period in the N-th print cycle, the (a) selecting selects the m number of conveying periods in ascending order from the first conveying periods. In a case where the second length is greater than the first length, the (b) setting sets (n−m) number of conveying periods as the one or more valid conveying periods by removing the selected m number of conveying periods from the plurality of conveying periods in the N-th print cycle, the (c) obtaining divides the time duration corresponding to the selected m number of conveying periods into (n−m) number of time segments and calculates, as the first time duration, (n−m) number of time durations corresponding to respective ones of the (n−m) number of time segments, and the (d) adjusting adds the (n−m) number of time durations to respective ones of the one or more valid conveying periods. In a case where the second length is smaller than the first length, the (b) setting sets (n+m) number of conveying periods as the one or more valid conveying periods by adding the selected m number of conveying periods to the plurality of conveying periods in the N-th print cycle, the (c) obtaining divides the time duration corresponding to the selected m number of conveying periods into (n+m) number of time segments and calculates, as the first time duration, (n+m) number of time durations corresponding to respective ones of the (n+m) number of time segments, and the (d) adjusting subtracts the (n+m) number of time durations from respective ones of the one or more valid conveying periods.

According to another aspect, the present disclosure also provides a printing device including: a motor; a controller; and a memory. The motor is used for conveying a printing medium in a conveying direction. The controller is configured to output a pulse. The motor is configured to be driven to rotate in response to receiving the pulse. The printing medium is conveyed in the conveying direction at a conveying speed in response to the motor being driven to rotate. The memory stores a set of program instructions therein. The set of program instructions, when executed by the controller, causes the printing device to perform a plurality of print cycles one by one to print an object. The plurality of print cycles includes an N-th print cycle where N is an integer greater than or equal to one. Each of the print cycles includes a plurality of conveying periods from a first conveying period to an n-th conveying period and a plurality of printing periods from a first printing period to an n-th printing period where n is an integer greater than or equal to two. The pulse is outputted in each of the plurality of conveying periods. A portion of the object is printed in each of the plurality of printing periods. The object is designed to have a first length in the conveying direction and is expected to have a second length in the conveying direction in actual printed size. The conveying speed of the printing medium is increased or decreased during at least part of the plurality of conveying periods in the N-th print cycle. The N-th print cycle includes: (a) selecting; (b) setting; (c) obtaining; (d) adjusting; and (e) performing. The (a) selecting selects, in a case where the second length does not match the first length, m number of conveying periods from among the plurality of conveying periods where m is an integer greater than or equal to one and smaller than n. m is set to a value corresponding to a first ratio of a difference between the first length and the second length to the first length. The (b) setting sets one or more valid conveying periods based on the selected m number of conveying periods. The (c) obtaining obtains a first time duration by dividing a time duration corresponding to the selected m number of conveying periods into n number of time segments. n number of time durations corresponding to respective ones of the n number of time segments is calculated as the first time duration. The (d) adjusting adjusts a time duration of each of the plurality of printing periods using the first time duration. The (e) performing performs the one or more valid conveying periods in parallel with performing the plurality of printing periods. The (e) performing includes: (e1) outputting; and (e2) printing. The (e1) outputting outputs the pulse in each of the one or more valid conveying periods to convey the printing medium in response to the motor being driven to rotate upon receipt of the pulse. The (e2) printing prints the portion of the object on the printing medium in each of the plurality of printing periods. In a case where the conveying speed is increased from the first conveying period to the n-th conveying period in the N-th print cycle, the (a) selecting selects the m number of conveying periods in descending order from the n-th conveying periods. In a case where the conveying speed is decreased from the first conveying period to the n-th conveying period in the N-th print cycle, the (a) selecting selects the m number of conveying periods in ascending order from the first conveying periods. In a case where the second length is greater than the first length, the (d) adjusting subtracts the n number of time durations from respective ones of the plurality of printing periods. In a case where the second length is smaller than the first length, the (d) adjusting adds the n number of time durations to respective ones of the plurality of printing periods.

According to still another aspect, the present disclosure also provides a printing device including: a motor; a controller; and a memory. The motor is used for conveying a printing medium in a conveying direction. The controller is configured to output a pulse. The motor is configured to be driven to rotate in response to receiving the pulse. The printing medium is conveyed in the conveying direction at a conveying speed in response to the motor being driven to rotate. The memory stores a set of program instructions therein. The set of program instructions, when executed by the controller, causes the printing device to perform: a plurality of print cycles one by one to print an object. The plurality of print cycles includes an N-th print cycle and an (N+1)-th print cycle successively performed following the N-th print cycle where N is an integer greater than or equal to one. Each of the print cycles including a plurality of conveying periods from a first conveying period to an n-th conveying period and a plurality of printing periods from a first printing period to an n-th printing period where n is an integer greater than or equal to two. The pulse is outputted in each of the plurality of conveying periods. A portion of the object is printed in each of the plurality of printing periods. The object is designed to have a first length in the conveying direction and is expected to have a second length in the conveying direction in actual printed size. The conveying speed of the printing medium is increased from the first conveying period to the n-th conveying period in the N-th print cycle and is decreased from the first conveying period to the n-th conveying period in the (N+1)-th print cycle. The N-th print cycle and the (N+1)-th print cycle include: (a) selecting; (b) setting; (c) obtaining; (d) adjusting; and (e) performing. The (a) selecting selects, in a case where the second length does not match the first length, m number of conveying periods from among the plurality of conveying periods in the N-th print cycle and the plurality of conveying periods in the (N+1)-th print cycle where m is an integer greater than or equal to one and smaller than n. m is set to a value corresponding to a ratio of a difference between the first length and the second length to the first length. The m number of conveying periods is selected in order of the conveying speed from a fastest conveying speed. The (b) setting sets one or more valid conveying periods based on the selected m number of conveying periods. The (c) obtaining obtains a first time duration by dividing a time duration corresponding to the selected m number of conveying periods into a plurality of time segments. The (d) adjusting adjusts a time duration of each of the one or more valid conveying periods using the first time duration. The (e) performing performs the one or more valid conveying periods in parallel with performing the plurality of printing periods in the N-th print cycle and the plurality of printing periods in the (N+1)-th print cycle. The (e) performing includes: (e1) outputting; and (e2) printing. The (e1) outputting outputs the pulse in each of the one or more valid conveying periods to convey the printing medium in response to the motor being driven to rotate upon receipt of the pulse. The (e2) printing prints the portion of the object on the printing medium in each of the plurality of printing periods in the N-th print cycle and the plurality of printing periods in the (N+1)-th print cycle. In a case where the second length is greater than the first length, the (b) setting sets (2n−m) number of conveying periods as the one or more valid conveying periods by removing the selected m number of conveying periods from the plurality of conveying periods in the N-th print cycle and the plurality of conveying periods in the (N+1)-th print cycle, the (c) obtaining divides the time duration corresponding to the selected m number of conveying periods into (2n−m) number of time segments and calculates, as the first time duration, (2n−m) number of time durations corresponding to respective ones of the (2n−m) number of time segments, and the (d) adjusting adds the (2n−m) number of time durations to respective ones of the one or more valid conveying periods. In a case where the second length is smaller than the first length, the (b) setting sets (2n+m) number of conveying periods as the one or more valid conveying periods by adding the selected m number of conveying periods to the plurality of conveying periods in the N-th print cycle and the plurality of conveying periods in the (N+1)-th print cycle, the (c) obtaining divides the time duration corresponding to the selected m number of conveying periods into (2n+m) number of time segments and calculates, as the first time duration, (2n+m) number of time durations corresponding to respective ones of the (2n+m) number of time segments, and the (d) adjusting subtracts the (2n+m) number of time durations from respective ones of the one or more valid conveying periods.

According to still another aspect, the present disclosure further provides a printing device including: a motor; a controller; and a memory. The motor is used for conveying a printing medium in a conveying direction. The controller is configured to output a pulse. The motor is configured to be driven to rotate in response to receiving the pulse. The printing medium is conveyed in the conveying direction at a conveying speed in response to the motor being driven to rotate. The memory stores a set of program instructions therein. The set of program instructions, when executed by the controller, causes the printing device to perform a plurality of print cycles one by one to print an object. The plurality of print cycles includes an N-th print cycle and an (N+1)-th print cycle successively performed following the N-th print cycle where N is an integer greater than or equal to one. Each of the print cycles includes a plurality of conveying periods from a first conveying period to an n-th conveying period and a plurality of printing periods from a first printing period to an n-th printing period where n is an integer greater than or equal to two. The pulse is outputted in each of the plurality of conveying periods. A portion of the object is printed in each of the plurality of printing periods. The object is designed to have a first length in the conveying direction and is expected to have a second length in the conveying direction in actual printed size. The conveying speed of the printing medium is increased from the first conveying period to the n-th conveying period in the N-th print cycle and is decreased from the first conveying period to the n-th conveying period in the (N+1)-th print cycle. The N-th print cycle and the (N+1)-th print cycle include: (a) selecting; (b) setting; (c) obtaining; (d) adjusting; and (e) performing. The (a) selecting selects, in a case where the second length does not match the first length, m number of conveying periods from among the plurality of conveying periods in the N-th print cycle and the plurality of conveying periods in the (N+1)-th print cycle where m is an integer greater than or equal to one and smaller than n. m is set to a value corresponding to a ratio of a difference between the first length and the second length to the first length. The m number of conveying periods is selected in order of the conveying speed from a fastest conveying speed. The (b) setting sets one or more valid conveying periods based on the selected m number of conveying periods. The (c) obtaining obtains a first time duration by dividing a time duration corresponding to the selected m number of conveying periods into a 2n number of time segments. 2n number of time durations correspond to respective ones of the 2n number of time segments being calculated as the first time duration. The (d) adjusting adjusts a time duration of each of the plurality of printing periods in the N-th print cycle and the plurality of printing periods in the (N+1)-th print cycle using the first time duration. The (e) performing performs the one or more valid conveying periods in parallel with performing the plurality of printing periods in the N-th print cycle and the plurality of printing periods in the (N+1)-th print cycle. The (c) performing includes: (e1) outputting; and (e2) printing. The (e1) outputting outputs the pulse in each of the one or more valid conveying periods to convey the printing medium in response to the motor being driven to rotate upon receipt of the pulse. The (e2) printing the portion of the object on the printing medium in each of the plurality of printing periods in the N-th print cycle and the plurality of printing periods in the (N+1)-th print cycle. In a case where the second length is greater than the first length, the (b) setting sets (2n−m) number of conveying periods as the one or more valid conveying periods by removing the selected m number of conveying periods from the plurality of conveying periods in the N-th print cycle and the plurality of conveying periods in the (N+1)-th print cycle, and the (d) adjusting subtracts the 2n number of time durations from respective ones of the plurality of printing periods in the N-th print cycle and the plurality of printing periods in the (N+1)-th print cycle. In a case where the second length is smaller than the first length, the (b) setting sets (2n+m) number of conveying periods as the one or more valid conveying periods by adding the selected m number of conveying periods to the plurality of conveying periods in the N-th print cycle and the plurality of conveying periods in the (N+1)-th print cycle, and the (d) adjusting adds the 2n number of time durations to respective ones of the plurality of printing periods in the N-th print cycle and the plurality of printing periods in the (N+1)-th print cycle.

According to still another aspect, the present disclosure also provides a printing device including: a motor, a controller; and a memory. The motor is used for conveying a printing medium in a conveying direction. The controller is configured to output a pulse. The motor is configured to be driven to rotate in response to receiving the pulse. The printing medium is conveyed in the conveying direction at a conveying speed in response to the motor being driven to rotate. The memory stores a set of program instructions therein. The set of program instructions, when executed by the controller, causes the printing device to perform a plurality of print cycles one by one to print an object. The plurality of print cycles includes an N-th print cycle where N is an integer greater than or equal to one. Each of the print cycles includes a plurality of conveying periods from a first conveying period to an n-th conveying period and a plurality of printing periods from a first printing period to an n-th printing period where n is an integer greater than or equal to two. The pulse is outputted in each of the plurality of conveying periods. A portion of the object being printed in each of the plurality of printing periods. The object is designed to have a first length in the conveying direction and is expected to have a second length in the conveying direction in actual printed size. The N-th print cycle includes: (a) obtaining; (b) adjusting; and (c) performing. The (a) obtaining obtains, in a case where the second length does not match the first length and a ratio of a difference between the first length and the second length to the first length is an intermediate value smaller than 1/n, a first time duration by dividing a second time duration into n number of time segments. The second time duration is obtained by multiplying a time duration of the single conveying period by the intermediate value. n number of time durations correspond to respective ones of the n number of time segments. The (b) adjusting adjusts a time duration of each of the plurality of printing periods using the first time duration. The n number of time durations are added to respective ones of the plurality of printing periods in the N-th print cycle. The (c) performing performs the plurality of conveying periods in parallel with performing the plurality of printing periods in the N-th print cycle. The (c) performing includes: (c1) outputting; and (c2) printing. The (c1) outputting outputs the pulse in each of plurality of conveying periods in the N-th print cycle to convey the printing medium in response to the motor being driven to rotate upon receipt of the pulse. The (c2) printing prints the portion of the object on the printing medium in the plurality of printing periods in the N-th print cycle.

BRIEF DESCRIPTION OF THE DRAWINGS

The particular features and advantages of the disclosure as well as other objects will become apparent from the following description taken in connection with the accompanying drawings, in which:

FIGS. 5A to 5E illustrate changes of the relation between a design length of an object and an actual length of a printed object before and after performing print-length adjustment control, in which FIG. 5A illustrates a case in which the actual length before performing the print-length adjustment control is equal to the design length, FIG. 5B illustrates a case in which the actual length before performing the print-length adjustment control is larger than the design length, FIG. 5C illustrates a case in which the actual length illustrated in FIG. 5B becomes smaller after performing the print-length adjustment control to be equal to the design length, FIG. 5D illustrates a case in which the actual length before performing the print-length adjustment control is smaller than the design length, and FIG. 5E illustrates a case in which the actual length illustrated in FIG. 5D becomes larger after performing the print-length adjustment control to be equal to the design length;

FIGS. 6A and 6B are explanatory diagrams illustrating feeding period adjustment performed when the actual length is larger than the design length and the feeding speed of the tape is maintained at constant, in which FIG. 6A illustrates the feeding speed of the tape and determination of valid periods, and FIG. 6B illustrates adjustment of a time duration of each valid period using a first time segment;

FIGS. 7A and 7B are explanatory diagrams illustrating printing period adjustment performed when the actual length is larger than the design length and the feeding speed of the tape is maintained at constant, in which FIG. 7A illustrates the feeding speed of the tape and determination of valid periods, and FIG. 7B illustrates adjustment of a time duration of each printing period using a first time segment;

FIGS. 8A and 8B are explanatory diagrams illustrating feeding period adjustment performed when the actual length is smaller than the design length and the feeding speed of the tape is maintained at constant, in which FIG. 8A illustrates the feeding speed of the tape and determination of valid periods, and FIG. 8B illustrates adjustment of a time duration of each valid period using a first time segment;

FIGS. 9A and 9B are explanatory diagrams illustrating printing period adjustment performed when the actual length is smaller than the design length and the feeding speed of the tape is maintained at constant, in which FIG. 9A illustrates the feeding speed of the tape and determination of valid periods, and FIG. 9B illustrates adjustment of a time duration of each printing period using a first time segment;

FIGS. 10A and 10B are explanatory diagrams illustrating feeding period adjustment performed when the actual length is larger than the design length and the feeding speed of the tape is maintained at constant after acceleration, in which FIG. 10A illustrates the feeding speed of the tape and determination of valid periods, and FIG. 10B illustrates adjustment of a time duration of each valid period using a first time segment;

FIGS. 11A and 11B are explanatory diagrams illustrating printing period adjustment performed when the actual length is larger than the design length and the feeding speed of the tape is maintained at constant after acceleration, in which FIG. 11A illustrates the feeding speed of the tape and determination of valid periods, and FIG. 11B illustrates adjustment of a time duration of each printing period using a first time segment;

FIGS. 12A and 12B are explanatory diagrams illustrating feeding period adjustment performed when the actual length is smaller than the design length and the feeding speed of the tape is maintained at constant after acceleration, in which FIG. 12A illustrates the feeding speed of the tape and determination of valid periods, and FIG. 12B illustrates adjustment of a time duration of each valid period using a first time segment;

FIGS. 13A and 13B are explanatory diagrams illustrating printing period adjustment performed when the actual length is smaller than the design length and the feeding speed of the tape is maintained at constant after acceleration, in which FIG. 13A illustrates the feeding speed of the tape and determination of valid periods, and FIG. 13B illustrates adjustment of a time duration of each printing period using a first time segment;

FIGS. 15A and 15B are explanatory diagrams illustrating feeding period adjustment performed when the actual length is larger than the design length and the feeding speed of the tape increases and then decreases, in which FIG. 15A illustrates the feeding speed of the tape and determination of valid periods, and FIG. 15B illustrates adjustment of a time duration of each valid period using a first time segment;

FIGS. 16A and 16B are explanatory diagrams illustrating printing period adjustment performed when the actual length is larger than the design length and the feeding speed of the tape increases and then decreases, in which FIG. 16A illustrates the feeding speed of the tape and determination of valid periods, and FIG. 16B illustrates adjustment of a time duration of each printing period using a first time segment;

FIGS. 17A and 17B are explanatory diagrams illustrating feeding period adjustment performed when the actual length is smaller than the design length and the feeding speed of the tape increases and then decreases, in which FIG. 17A illustrates the feeding speed of the tape and determination of valid periods, and FIG. 17B illustrates adjustment of a time duration of each valid period using a first time segment;

FIGS. 18A and 18B are explanatory diagrams illustrating printing period adjustment performed when the actual length is smaller than the design length and the feeding speed of the tape increases and then decreases, in which FIG. 18A illustrates the feeding speed of the tape and determination of valid periods, and FIG. 18B illustrates adjustment of a time duration of each printing period using a first time segment;

FIGS. 19A and 19B are explanatory diagrams illustrating feeding period adjustment performed when the actual length is smaller than the design length and the feeding speed of the tape decreases after maintained at constant, in which FIG. 18A illustrates the feeding speed of the tape and determination of valid periods, and FIG. 19B illustrates adjustment of a time duration of each valid period using a first time segment and adjustment of a time duration of each printing period using a second time segment;

DETAILED DESCRIPTION

Figure 1:
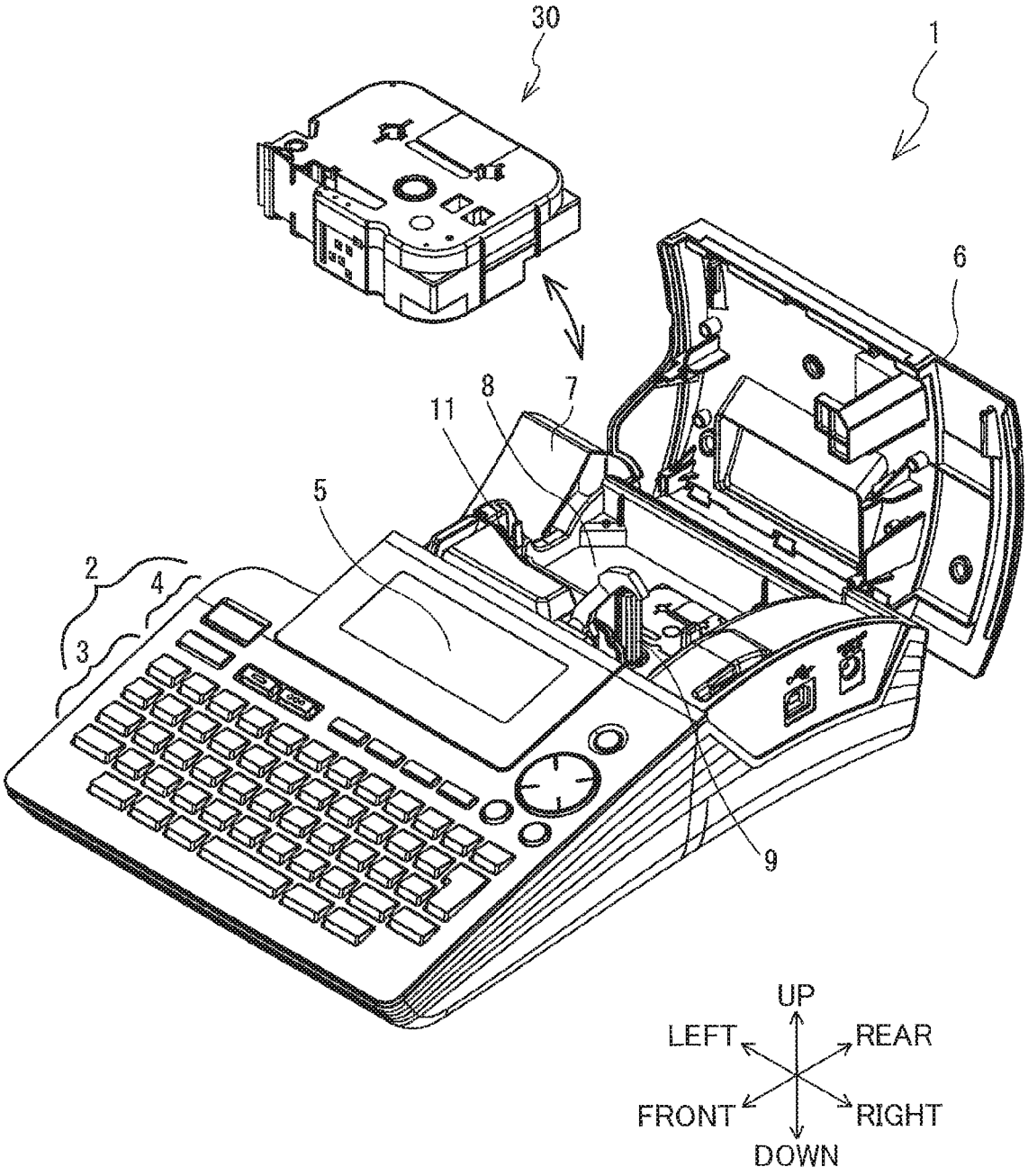
FIG. 1 is a perspective view of a printing device according to an embodiment of the present disclosure.

Next, an embodiment of the present disclosure will be described while referring to the accompanying drawings. The referenced drawings are used to describe the technical features made possible with the present disclosure. The configurations of the devices illustrated in the drawings are merely examples, and the present disclosure is not intended to be limited to these configurations.

<1. Overall Configuration of Printing Device 1 and Tape Cassette 30>

The overall configuration of a printing device 1 and a tape cassette 30 will now be described with reference to FIGS. 1 and 2. In the following description, the upper-right side, the lower-left side, the lower-right side, the upper-left side, the top side, and the bottom side of the printing device 1 illustrated in FIG. 1 will be defined as the rear side, the front side, the right side, the left side, the top side, and the bottom side of the printing device 1.

As illustrated in FIG. 1, the printing device 1 is provided with a keyboard 3, a function key group 4, a display 5, a cover 6, a tape tray 7, and a cassette mounting section 8. The keyboard 3 is provided in the top surface of the printing device 1. The user operates the keyboard 3 in order to input objects such as characters, symbols, numbers, graphics, and the like. The function key group 4 is provided to the rear (the upper-right side in FIG. 1) of the keyboard 3. The function key group 4 includes a power switch, application keys, a cursor key, and the like. In the following description, the keyboard 3 and the function key group 4 is also collectively referred to as an operation unit 2. The display 5 is provided to the rear of the function key group 4. The cover 6 is provided on the rear side of the display 5 and can open and close over the cassette mounting section 8. The tape tray 7 is provided on the left-rear corner of the printing device 1. The tape tray 7 receives printed pieces of tape cut by a cutter 36. The cutter 36 will be described later with reference to FIG. 2.

The cassette mounting section 8 is provided on the rear side of the display 5. A tape cassette 30 is detachably mounted in the cassette mounting section 8. The printing device 1 prints objects inputted via the keyboard 3 using the tape cassette 30 mounted in the cassette mounting section 8. The cassette mounting section 8 is provided with a ribbon take-up shaft 9, a tape drive shaft 11, a thermal head 10 (see FIG. 2), a platen roller 37 (see FIG. 2), and a driven roller 38 (see FIG. 2). The cutter 36 (see FIG. 2) is disposed on the left side of the thermal head 10.

Figure 2:
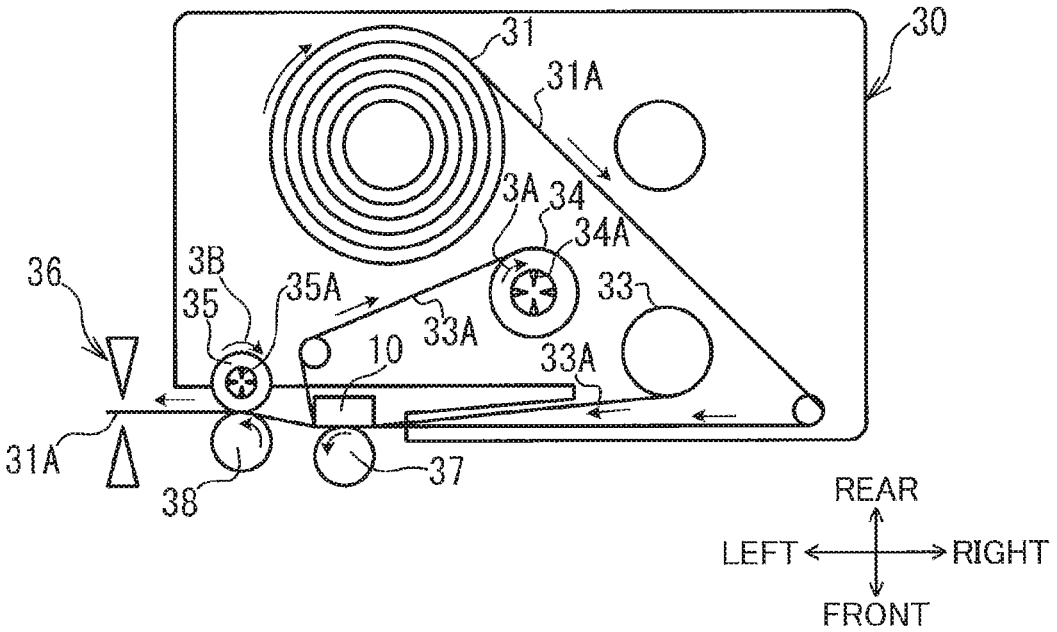
FIG. 2 is a plan view schematically illustrating the internal structure of a tape cassette mounted in the printing device according to the embodiment of the present disclosure.

As illustrated in FIG. 2, the tape cassette 30 is provided with a tape roll 31, a ribbon supply roll 33, a ribbon take-up roller 34, and a tape feeding roller 35. A tape 31A is wound into the tape roll 31. An ink ribbon 33A is wound into the ribbon supply roll 33. The ribbon take-up roller 34 takes up the ink ribbon 33A that has been used in printing. A gear 34A is disposed on the inner surface of the ribbon take-up roller 34, and engages with a gear disposed on the outer surface of the ribbon take-up shaft 9 (see FIG. 1). A gear 35A is disposed on the inner surface of the tape feeding roller 35 and engages with a gear disposed on the outer surface of the tape drive shaft 11 (see FIG. 1). The tape 31A and the ink ribbon 33A are interposed between the thermal head 10 and the platen roller 37. The tape 31A is also interposed between the tape feeding roller 35 and the driven roller 38.

<2. Electrical Configuration of Printing Device 1>

Figure 3:
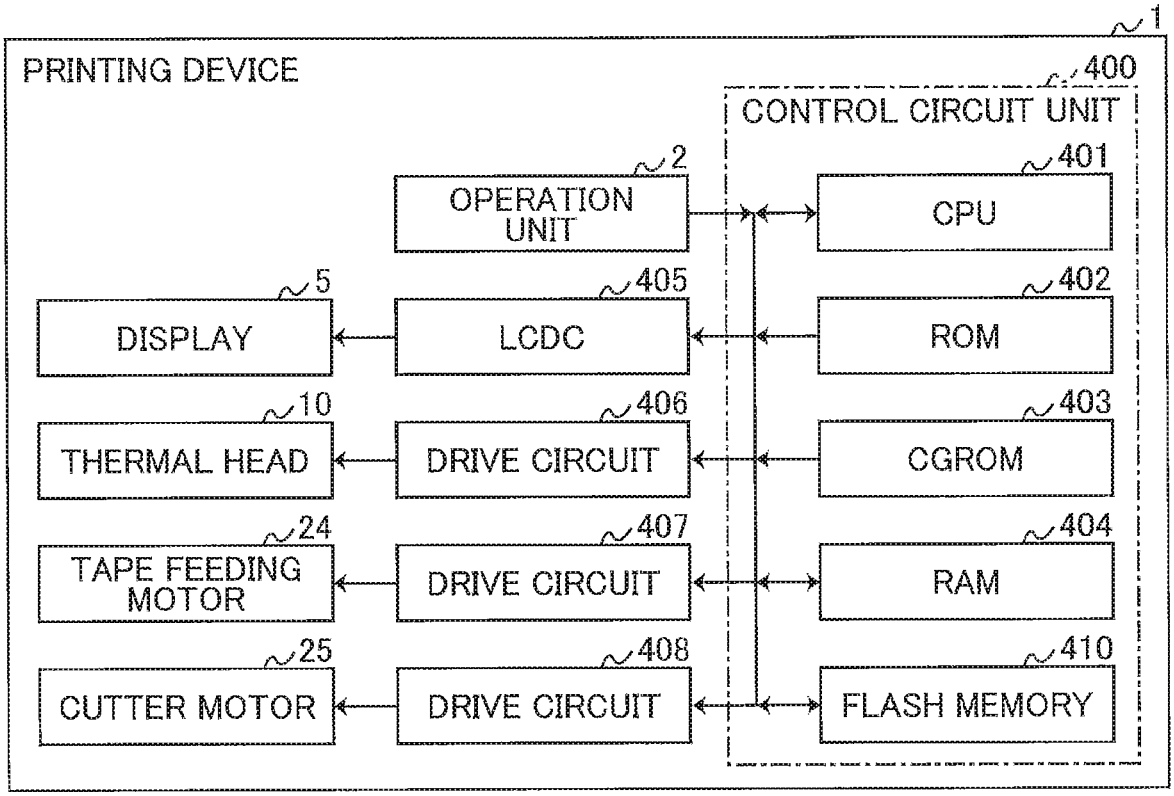
FIG. 3 is a block diagram illustrating an electrical configuration of the printing device according to the embodiment of the present disclosure.

Next, the electrical configuration of the printing device 1 will be described with reference to FIG. 3. The printing device 1 is provided with a control circuit unit 400 formed on a control substrate. The control circuit unit 400 includes a central processing unit (CPU) 401, a read only memory (ROM) 402, a character generator ROM (CGROM) 403, a random-access memory (RAM) 404, and a flash memory 410, all of which components are connected via a data bus.

The ROM 402 stores various parameters required when the CPU 401 executes various programs. The CGROM 403 stores dot pattern data for printing objects. The RAM 404 includes a plurality of memory areas, such as a text memory, a print buffer, and the like. The flash memory 410 stores various programs that the CPU 401 executes for controlling the printing device 1. Alternatively, the various programs stored in the flash memory 410 may be acquired from an external device via an interface device (not illustrated). If the CPU 401 acquires the programs from an external device, the CPU 401 may replace the programs stored in the flash memory 410 with the acquired programs. The flash memory 410 also stores print data required for printing objects.

In the printing device 1, the CPU 401 is connected to the operation unit 2, a liquid-crystal drive circuit (LCDC) 405, and drive circuits 406, 407, and 408. The LCDC 405 has a video RAM (not illustrated) for outputting display data to the display 5. The drive circuit 406 is an electronic circuit for driving the thermal head 10. The CPU 401 controls the drive circuit 406 by outputting a control signal to the drive circuit 406, thereby turning on/off power supply to a plurality of heating elements in the thermal head 10.

The printing device 1 is also provided with a tape feeding motor 24. The tape feeding motor 24 is a stepping motor that rotates the ribbon take-up shaft 9 and the tape drive shaft 11. The tape feeding motor 24 is coupled to the ribbon take-up shaft 9 and the tape drive shaft 11 through a plurality of gears engaged with each other. Hereinafter, the gears are referred to as "engagement gears." The tape feeding motor 24 rotates in synchronization with inputted pulsed signals. The tape feeding motor 24 transmits a rotation drive force to the ribbon take-up shaft 0 and the tape drive shaft 11 through the engagement gears.

The drive circuit 407 drives the tape feeding motor 24. The CPU 401 outputs pulsed signals to the drive circuit 407. The drive circuit 407 converts the power of the pulsed signals outputted from the CPU 401 to a power that can drive the tape feeding motor 24. The converted pulsed signals are outputted to the tape feeding motor 24. That is, the CPU 401 outputs pulsed signals to the tape feeding motor 24 via the drive circuit 407, thereby rotating the tape feeding motor 24 at a rotational speed in accordance with the pulsed signals.

The drive circuit 408 is an electronic circuit for driving the cutter 36. The CPU 401 outputs a control signal to the drive circuit 408, thereby causing the cutter 36 to cut the tape.

<3. Overview of Printing Operation>

In response to the CPU 401 driving the tape feeding motor 24 via the drive circuit 407, the ribbon take-up shaft 9 and the tape drive shaft 11 rotate in cooperation. The ribbon take-up shaft 9 (see FIG. 1) rotates the ribbon take-up roller 34 in the direction of arrow 3A, as illustrated in FIG. 2. The tape drive shaft 11 (see FIG. 1) rotates the tape feeding roller 35 in the direction of arrow 3B. As a result of the rotation of the ribbon take-up shaft 9 and the tape drive shaft 11, the tape 31A is fed from the tape roll 31, and the ink ribbon 33A is fed from the ribbon supply roll 33.

The platen roller 37 rotates as a result of the tape 31A being fed by the tape feeding roller 35. The platen roller 37 presses the tape 31A against the thermal head 10 while the tape 31A is being fed. The ink ribbon 33A is interposed between the tape 31A and the thermal head 10. The CPU 401 energizes the heating elements in the thermal head 10. The energized heating elements generates heat. The generated heat causes a plurality of ink dots to be transferred from the ink ribbon 33A onto the tape 31A. While the tape 31A is being fed by the tape feeding roller 35, a plurality of dots is repeatedly transferred to the tape 31A. In this way, a specific pattern of dots, i.e., a dot pattern in which a plurality of dots is arranged in the feeding direction of the tape 31A is formed on the tape 31A. The dot pattern formed on the tape 31A corresponds to the object inputted via the operation unit 2.

The driven roller 38 rotates as a result of the tape 31A being fed by the tape feeding roller 35. After a dot pattern is printed on the tape 31A, the tape feeding roller 35 and the driven roller 38 feeds the tape 31A toward the cutter 36 downstream. The CPU 401 drives a cutter motor 25 via the drive circuit 408. In response to this operation, the cutter 36 cuts the tape 31A. The tape tray 7 (see FIG. 1) catches the cut piece of tape 31A. The used ink ribbon 33A is taken up by the ribbon take-up roller 34. The piece of tape 31A subjected to printing and cut by the cutter 36 is referred to as a "label."

<4. Synchronized Print Control and Non-Synchronized Print Control>

There are two types of print control of printing with the thermal head 10 while feeding the tape 31A: synchronized print control and non-synchronized print control. Under the synchronized print control, a dot is printed every time the tape 31A is fed by a length corresponding to a single dot. Under the non-synchronized print control, the feeding of the tape 31A by a length corresponding to a single dot and the printing of a single dot are controlled in an asynchronous manner. The printing device 1 prints an object on the tape 31A by switching between the synchronized print control and the non-synchronized print control every predetermined print cycle.

Figure 4:
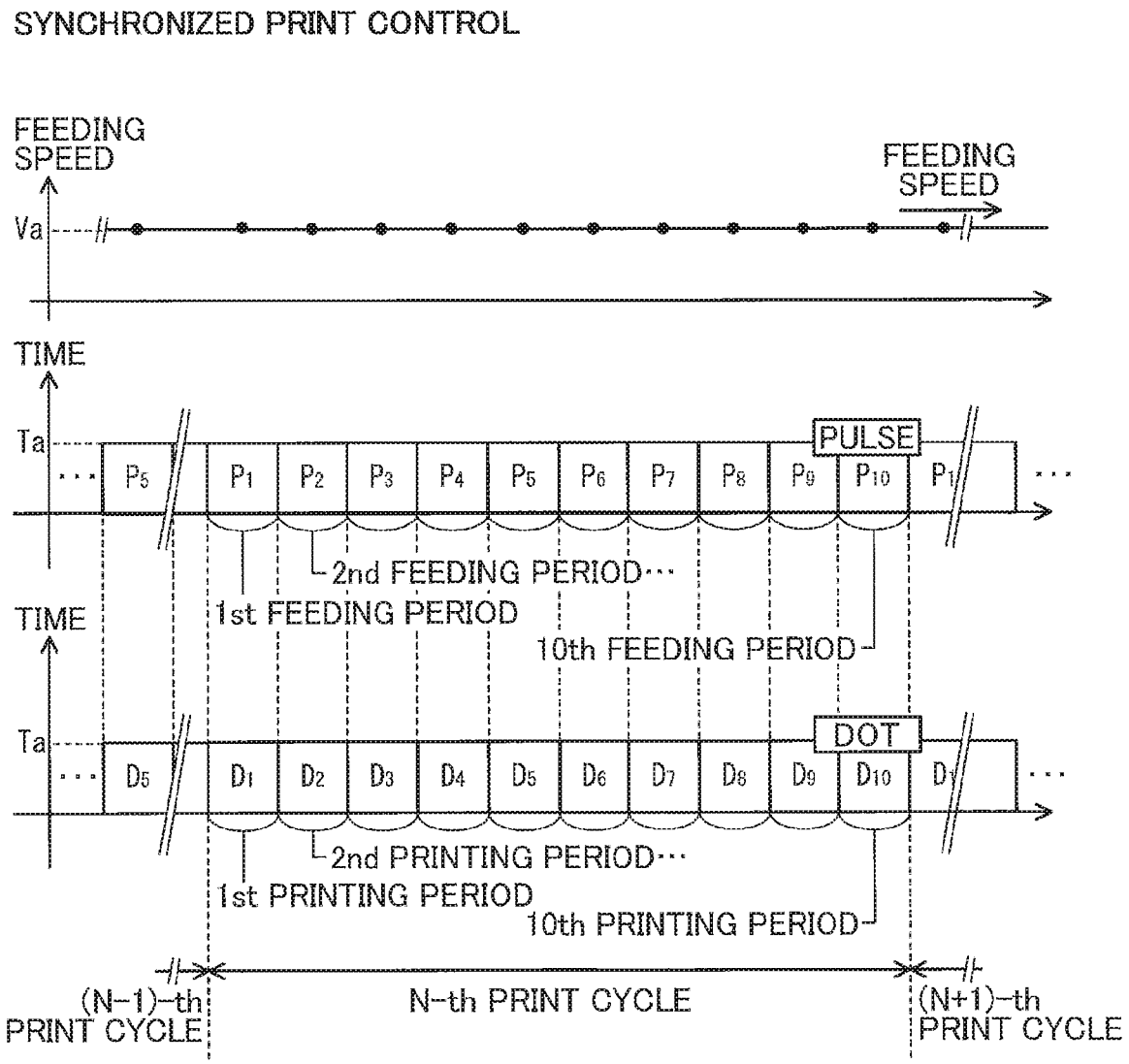
FIG. 4 is an explanatory diagram illustrating feeding periods and printing periods during synchronized print control in which a feeding speed of tape is maintained at constant.

Specific examples of the synchronized print control will now be described with reference to FIG. 4. In FIG. 4, the tape 31A is fed at a constant feeding speed Va. Note that the tape feeding motor 24 for feeding the tape 31A rotates in response to inputted pulsed signals. The amount of rotation of the tape feeding motor 24 is determined in accordance with the number of inputted pulsed signals. The rotational speed of the tape feeding motor 24 increases as the period of the inputted pulsed signals decreases. In other words, the rotational speed of the tape feeding motor 24 increases as the frequency of the inputted pulsed signals increases. In the case where pulsed signals are repeatedly outputted to the tape feeding motor 24 to repeatedly feed the tape 31A by a length corresponding to a single dot, the cycle of each pulsed signal is referred to as a "feeding period." In the example of FIG. 4, the feeding speed Va of the tape 31A is maintained at constant. Therefore, each feeding period has the same time duration Ta. In the case where a dot is printed one by one on the tape 31A, each print cycle of printing a dot is referred to as a "printing period." Under the synchronized print control, the feeding periods coincide with the printing periods. Therefore, the time duration Ta of each printing period is the same as the time duration Ta of each feeding period.

Each print cycle includes n number of feeding periods, where n is an integer greater than or equal to two. The n number of feeding periods are referred to as first to n-th feeding periods in chronological order. The first to n-th feeding periods are respectively denoted by $P_1$ to $P_n$. The first to n-th printing periods are respectively denoted by $D_1$ to $D_n$. In the following description, a specific example will be described in which n=10. However, the integer n is not limited to ten but may be any other integer which is greater than or equal to two. Note that, under the synchronized print control, the number of the feeding periods and the number of the printing periods in each print cycle are the same, i.e., n=10, in every print cycle in this example.

Under the non-synchronized print control, the feeding periods and the printing periods are unsynchronized. Specifically, the timing of the first feeding period $P_1$ coincides with the timing of the first printing period $D_1$ in each print cycle. In other words, the first feeding period $P_1$ and the first printing period $D_1$ are synchronized. Therefore, under the non-synchronized print control, the second to n-th (i.e., tenth) feeding periods $P_2$ to $P_{10}$ and the second to n-th (i.e., tenth) printing periods $D_2$ to $D_{10}$ are unsynchronized, but the first feeding period $P_1$ and the first printing period $D_1$ are actually synchronized. Note that, under the non-synchronized print control, the number of feeding periods and the number of the printing periods in each print cycle may not be n (=10) due to print-length adjustment control, which will be described later.

The printing device 1 repeats the print cycles and performs the synchronized print control or the non-synchronized print control in each of the print cycles to print an object on the tape 31A. The print cycles are referred to as first to N-th print cycles in chronological order, where N is an integer greater than or equal to one.

Next, an example in which the printing device 1 prints an object "1234567890 . . . " inputted via the operation unit 2 will be described with reference to FIGS. 5A through 5E. The object consists of 1417 dots arrayed in the feeding direction. The resolution of the printing device 1 is 360 dpi. In such a case, a design length of the object consisting of 1417 dots printed under the synchronized print control is calculated to be 100 mm from the following expression: 1417×(25.4/360) where 1417 is the number of dots, and (25.4/360) is the length per dot in the feeding direction in millimeters (mm). The design length of the object in the feeding direction is hereinafter referred to as "setting value Li." An example of the design length is illustrated in FIG. 5A.

However, the printed object may actually have a length larger than 100 mm (see FIG. 5B) or smaller than 100 mm (see FIG. 5D) due to errors such as an error in the width of the tape 31A, an error in the diameter of the platen roller 37, or assembly errors in various mechanism of the printing device 1. Hereinafter, the actual length of the printed object in the feeding direction is referred to as an "actual value Lp."

To solve the above-described issue, print-length adjustment control is performed. For example, if the actual value Lp is 105 mm, which is 5 mm larger than the setting value Li (=100 mm) (Lp>Li), as illustrated in FIG. 5B, the pulsed signals are controlled so that the tape 31A is fed by a length 5 mm or 71 dots less than the actual value Lp, as illustrated in FIG. 5C. Here, the 71 dots corresponding to 5 mm is calculated from the equation 5/(25.4/360)=71. In contrast, for example, if the actual value Lp is 95 mm, which is 5 mm smaller than the setting value Li (=100 mm) (Lp<Li), as illustrated in FIG. 5D, the pulsed signals are controlled so that the tape 31A is fed by a length 5 mm or 71 dots more than the actual value Lp, as illustrated in FIG. 5E. Here, the 71 dots corresponding to 5 mm is also calculated from the equation 5/(25.4/360)=71. In this way, the actual value Lp and the setting value Li can both beset to 100 mm. That is, the print-length adjustment control is basically non-synchronized print control in which the control for feeding the tape 31A by a length corresponding to a single dot and the control for printing a dot are not synchronized. In the following description, the print-length adjustment control performed by adjusting the feeding periods as described above is referred to as "feeding period adjustment." Note that the print-length adjustment control may be performed by adjusting the printing periods, besides the feeding period adjustment. Hereinafter, the print-length adjustment control performed by adjusting the printing periods is referred to as "printing period adjustment." Details will be described later.

<5. Print-Length Adjustment Control (with Constant Feeding Speed)>

The print-length adjustment control performed while the feeding speed Va of the tape 31A is maintained at constant will now be described in detail with reference to FIGS. 6A to 9B. Note that an adjustment value is set for the printing device 1 via the operation unit 2. The adjustment value is defined as the ratio of the difference between the setting value Li and the actual value Lp to the setting value Li ((Li−Lp)/Li). The printing device 1 performs print-length adjustment control on the basis of the adjustment value. In this embodiment, the user of the printing device 1 can set the adjustment value to be a multiple of the ratio of each feeding period to the print cycle or a multiple of the ratio of each printing period to the print cycle, where the ratio in either case is 1/10 or 10%. Each of FIGS. 6A and 6B and FIGS. 7A and 7B illustrates a case in which the actual value Lp is approximately 10% larger than the setting value Li, and the adjustment value is set to −10%. Each of FIGS. 8A and 8B and FIGS. 9A and 9B illustrates a case in which the actual value Lp is approximately 10% smaller than the setting value Li, and the adjustment value is set to +10%.

<5-1. Feeding Period Adjustment by First Time Segment (Lp>Li)>

Figure 6A:
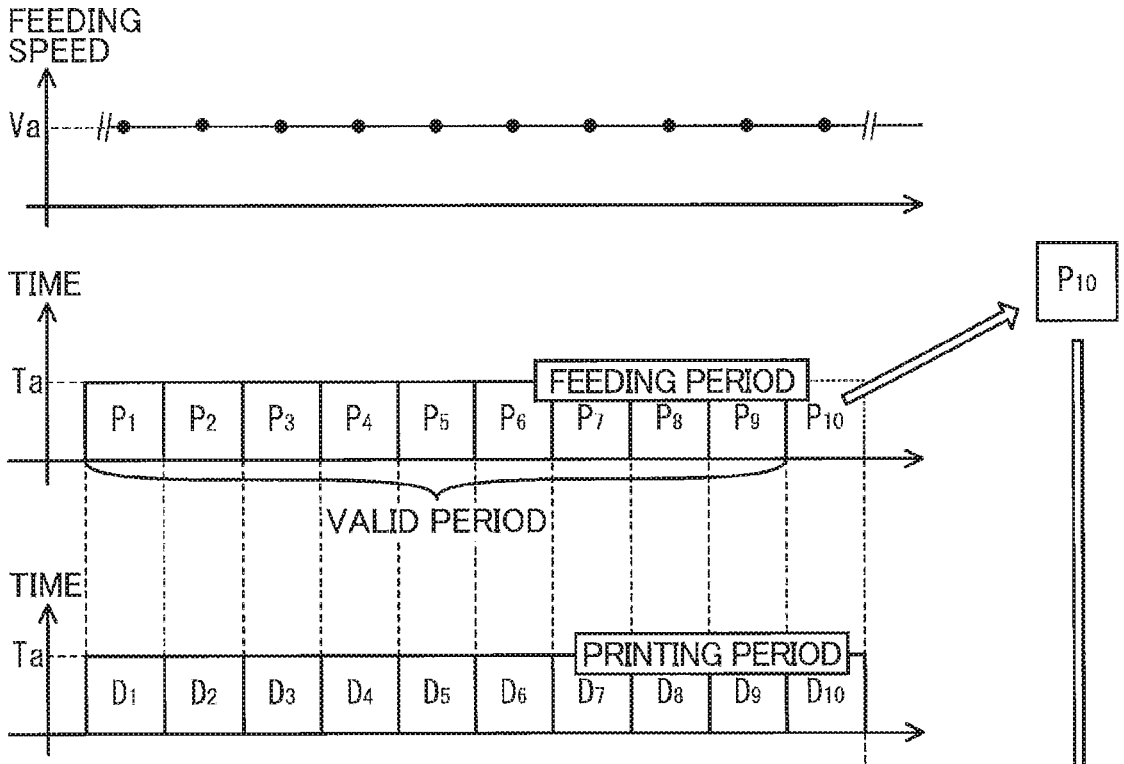
Figure 6B:
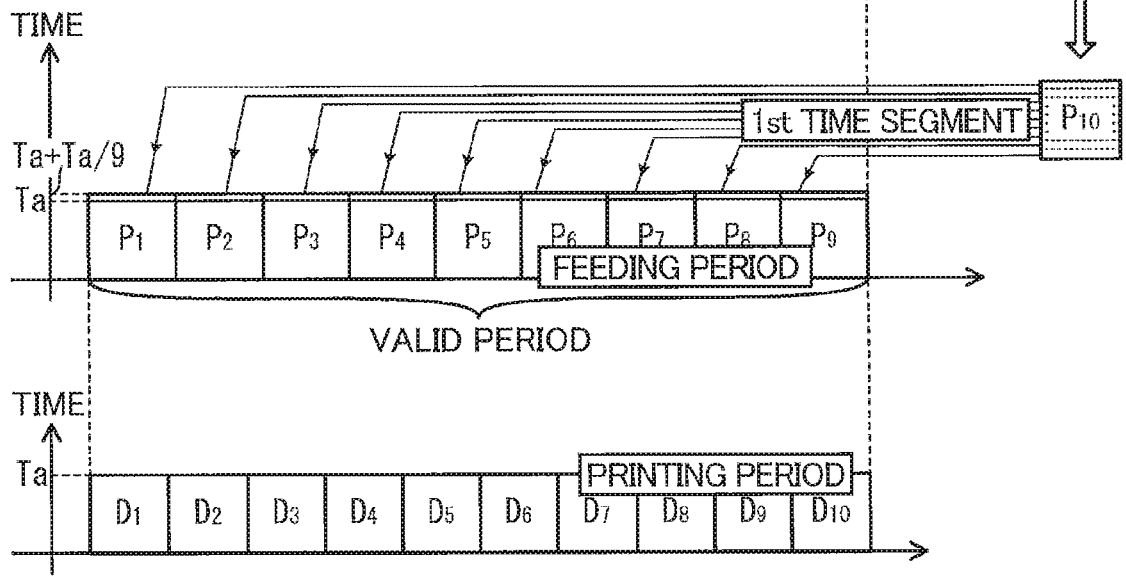

As illustrated in FIGS. 6A and 6B, the printing device 1 determines an integer m which is greater than or equal to one and smaller than n. The integer m is the number of feeding periods corresponding to the ratio of the difference between the setting value Li and the actual value Lp to the setting value Li according to the adjustment value −10%. Note that one print cycle includes n number of (n=10) feeding periods $P_1$ to $P_n$. Thus, the integer m that is the number of feeding periods corresponding to the adjustment value −10% is one which is a value satisfying the relational expression m/n=|−10%|.

Next, the printing device 1 selects arbitrary m number of (m=1) feeding periods from among the first to n-th (n=10) feeding periods in a print cycle, as illustrated in FIG. 6A. For example, it is assumed that the tenth feeding period $P_{10}$ is selected. The printing device 1 then determines valid periods to be feeding periods (the first to ninth feeding periods $P_1$ to $P_9$) except the selected m number of (m=1) feeding periods (the tenth feeding period $P_{10}$) from among the first to n-th (n=10) feeding periods $P_1$ to $P_{10}$. As illustrated in FIG. 6B, the printing device 1 then equally divides the time duration (m×Ta) in the selected m number of (m=1) feeding period (the tenth feeding period $P_{10}$) into (n−m) number of (n−m−9) time segments, where (n−m) is the number of valid periods. Hereinafter, each resulting time segment (m×Ta/(n−m)) is referred to as a "first time segment." The printing device 1 then adds the first time segment to each of valid periods (the first to ninth feeding periods $P_1$ to $P_9$). The time duration of each feeding period is calculated to be Ta+(m×Ta/(n−m))=Ta+Ta/9.

Note that, although the tenth feeding period $P_{10}$ is selected as the determined number (m=1) of feeding period, any other feeding period (any one of the first to ninth feeding periods $P_1$ to $P_9$) may be selected alternatively. Since the number of feeding periods corresponding to the adjustment value −10% has been determined to be one, the first time segment is calculated to be Ta/9. However, if the determined number m is two or more, the time duration of the first time segment is calculated by equally dividing the total time duration of the selected m number of feeding periods by the number of valid periods, i.e., n−m (=9).

The printing device 1 outputs a pulsed signal to the tape feeding motor 24 during the time duration corresponding each of the valid periods (the first to ninth feeding periods $P_1$ to $P_9$) to which the first time segment is added. As a result, the tape feeding motor 24 is driven to rotate, thereby feeding the tape 31A. The valid periods consist of nine feeding periods (the first to ninth feeding periods $P_1$ to $P_9$). This is 10% less than the number of feeding periods normally included in a print cycle. However, in this example, the actual value Lp without adjustment is 10% larger than the setting value Li. Therefore, the length of the tape 31A to be fed is 10% smaller than the actual value Lp without adjustment and coincides with the setting value Li.

Since the first time segment is added to each of the valid periods (the first to ninth feeding periods $P_1$ to $P_9$), the total time duration of the valid periods coincides with the total time duration of the first to tenth printing periods $D_1$ to $D_{10}$. Therefore, while the tape 31A is fed in response to the pulsed signal outputted to the tape feeding motor 24 during each valid period, dots are printed on the tape 31A during each printing period to form an object on the tape 31A.

<5-2. Printing Period Adjustment by First Time Segment (Lp>Li)>

Figure 7A:
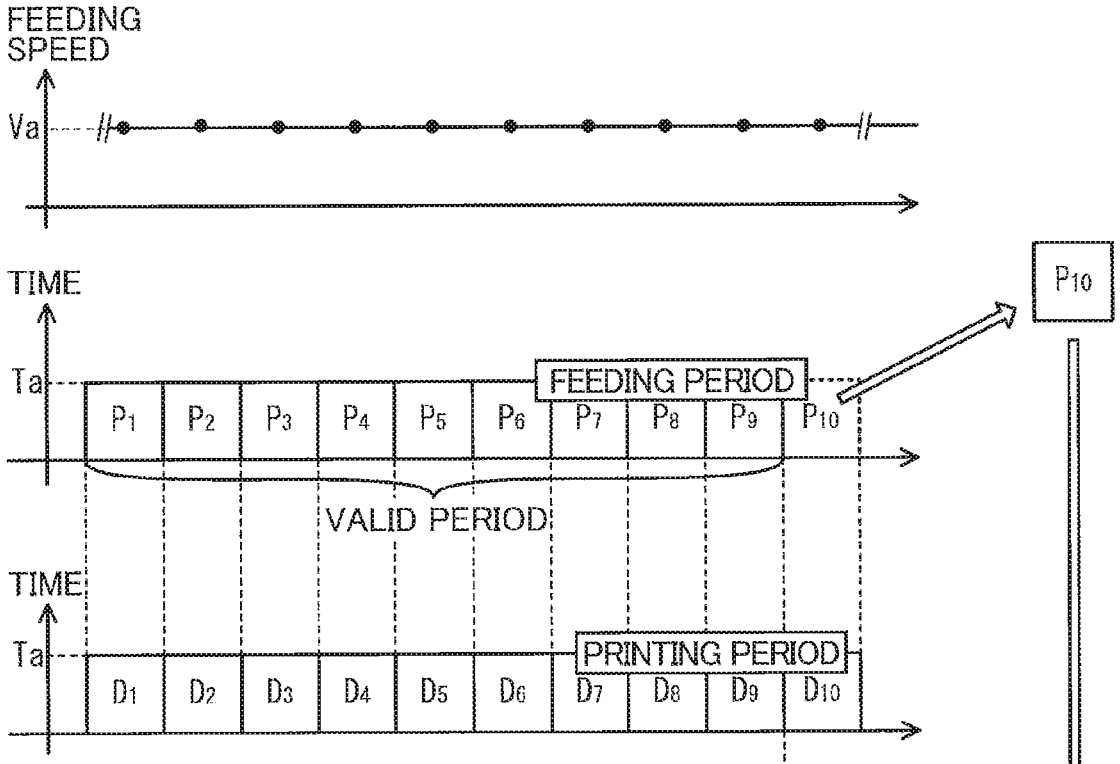
Figure 7B:
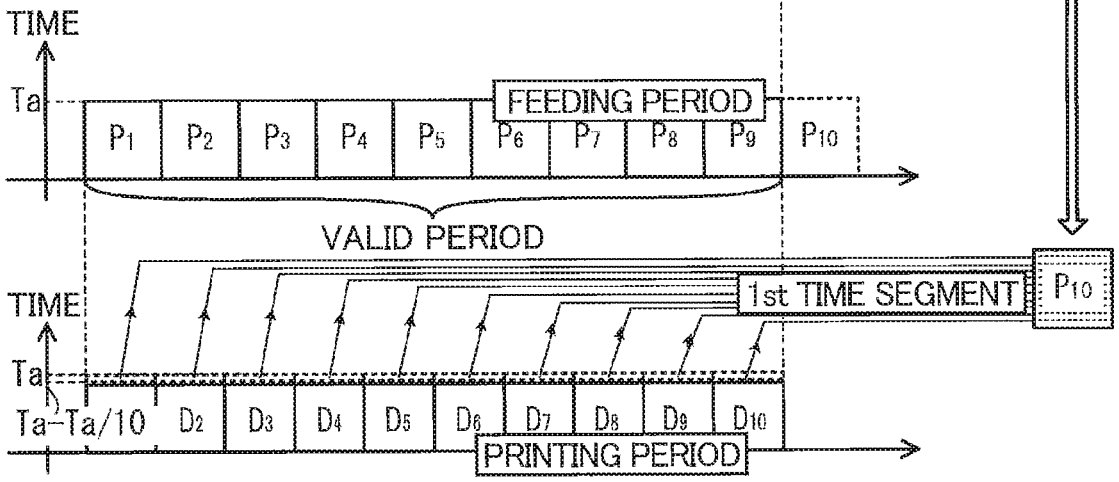

The process up to determining the first to ninth feeding periods $P_1$ to $P_9$ to be the valid periods is the same as that in the feeding period adjustment described in section 5-1 with reference to FIGS. 6A and 6B. Therefore, the process will not be described here but is illustrated in FIG. 7A. Next, as illustrated in FIG. 7B, the printing device 1 equally divides the time duration in the selected m number of (m=1) feeding period (the tenth feeding period $P_{10}$) into n number of (n=10) time segments, where n is the number of printing periods in the print cycle. Each resulting time segment (m×Ta/n) corresponds to the first time segment. The printing device 1 then subtracts the first time segment from each of the first to tenth printing periods $D_1$ to $D_{10}$. The time duration of each printing period is calculated to be Ta−(m×Ta/n)=Ta−Ta/10.

The printing device 1 outputs a pulsed signal to the tape feeding motor 24 during each of the valid periods (the first to ninth feeding periods $P_1$ to $P_9$). As a result, the tape feeding motor 24 is driven to rotate, thereby feeding the tape 31A. As in the case of the feeding period adjustment illustrated in FIGS. 6A and 6B, the length of the tape 31A to be fed is 10% smaller than the actual value Lp without adjustment and coincides with the setting value Li. Since the first time segment is subtracted from each of the printing periods $D_1$ to $D_{10}$, the total time duration of the first to tenth printing periods $D_1$ to $D_{10}$ coincides with the total time duration of the valid periods (the first to ninth feeding periods $P_1$ to $P_9$). Therefore, while the tape 31A is fed in response to the pulsed signal outputted to the tape feeding motor 24 during each valid period, dots are printed on the tape 31A during each printing period to form an object on the tape 31A.

<5-3. Feeding Period Adjustment by First Time Segment (Lp<Li)>

Figure 8A:
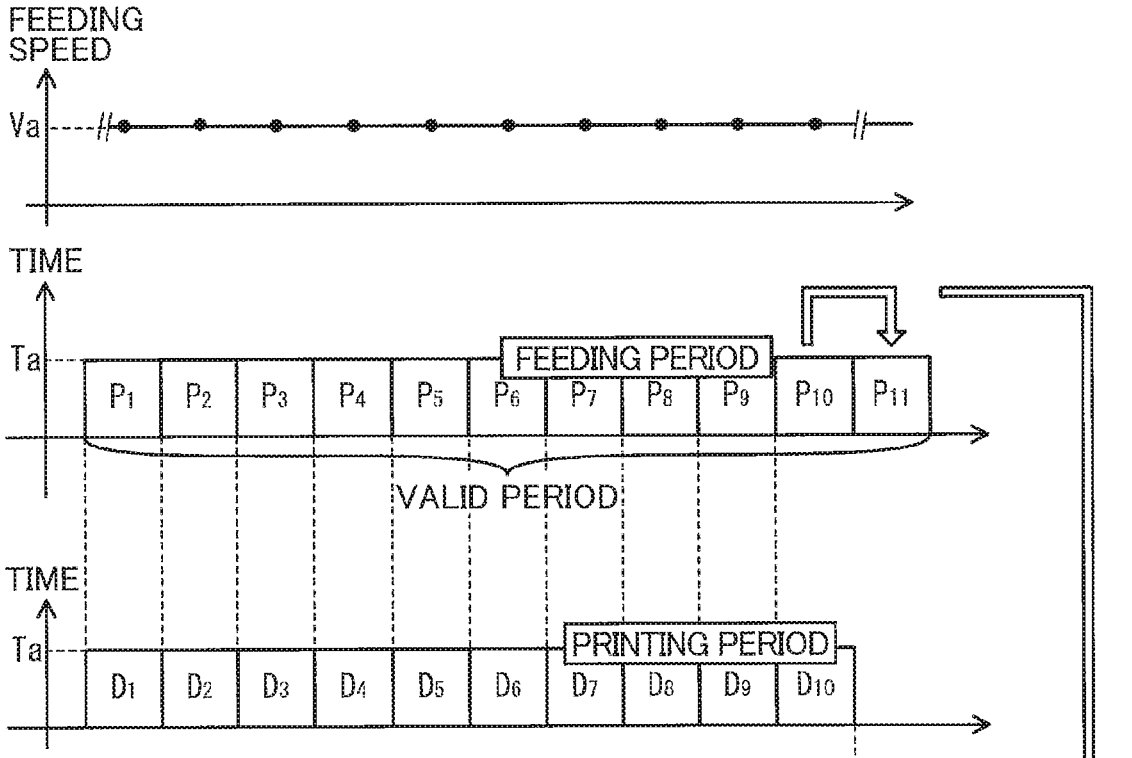
Figure 8B:
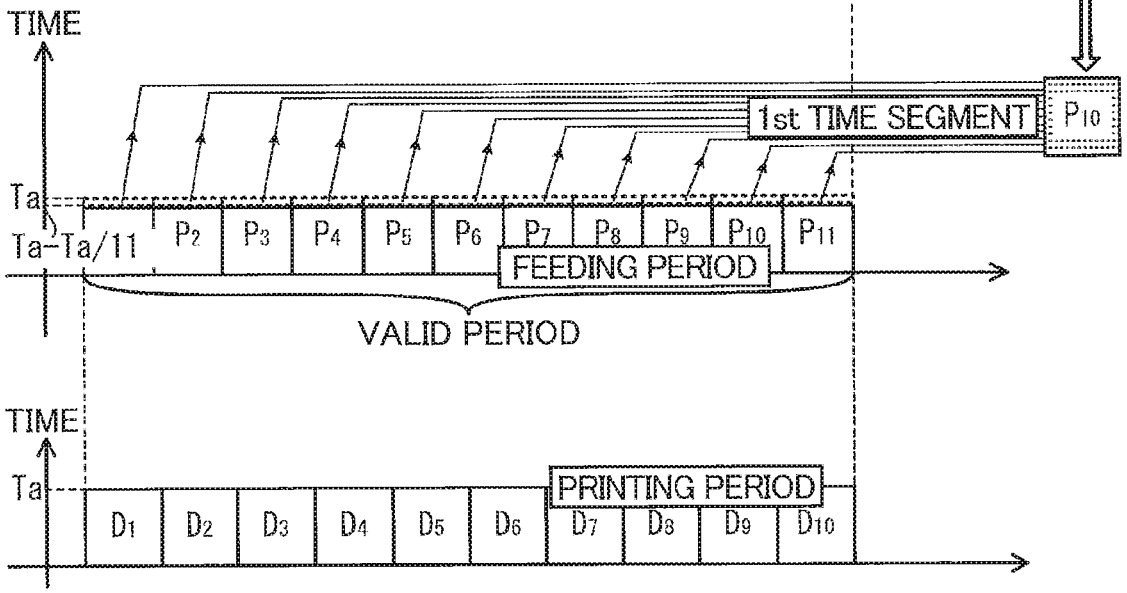

As illustrated in FIGS. 8A and 8B, the printing device 1 determines an integer m that is greater than or equal to one and less than n to be one. The integer m is the number of feeding periods corresponding to the ratio of the difference between the setting value Li and the actual value Lp to the setting value Li according to the adjustment value+10%. As described in section 5-1 with reference to FIGS. 6A and 6B and section 5-2 with reference to FIGS. 7A and 7B, the tenth feeding period $P_{10}$ is also selected to be the m number of (m=1) feeding period corresponding to +10%. As illustrated in FIG. 8A, the printing device 1 adds an eleventh feeding period $P_1$ having the same time duration as that of the selected m number of (m=1) feeding period (the tenth feeding period $P_{10}$) to the first to n-th (n=10) feeding periods $P_1$ to $P_{10}$. The printing device 1 then determines the first to eleventh feeding periods $P_1$ to $P_{11}$ to be valid periods.

As illustrated in FIG. 8B, the printing device 1 then equally divides the time duration (m×Ta) in the selected m number of (m=1) feeding period (the tenth feeding period $P_{10}$) into (n+m) number of (n+m=11) time segments, where (n+m) is the number of valid periods. Each of the resulting time segment (m×Ta/(n+m)) corresponds to the first time segment. The printing device 1 then subtracts the first time segment from each of the valid periods (the first to eleventh feeding periods $P_1$ to $P_{11}$). The time duration of each feeding period is calculated to be Ta−(m×Ta/(n+m))=Ta−Ta/11.

The printing device 1 outputs a pulsed signal to the tape feeding motor 24 during the time duration corresponding to the difference between each of the valid periods (the first to eleventh feeding periods $P_1$ to $P_{11}$) and the first time segment. As a result, the tape feeding motor 24 is driven to rotate, thereby feeding the tape 31A. The valid periods consist of eleven feeding periods (the first to eleventh feeding periods $P_1$ to $P_{11}$). This is 10% more than the number of feeding periods normally included in a print cycle. However, in this example, the actual value Lp without adjustment is 10% smaller than the setting value Li. Therefore, the length of the tape 31A to be fed is 10% smaller than the actual value Lp without adjustment and coincides with the setting value Li. Note that, as the time duration of each feeding period decreases, the feeding speed of the tape 31A increases.

Since the first time segment is subtracted from each of the valid periods (the first to eleventh feeding periods $P_1$ to $P_{11}$), the total time duration of the valid periods coincides with the total time duration of the first to tenth printing periods $D_1$ to $D_{10}$. Therefore, while the tape 31A is fed in response to the pulsed signal outputted to the tape feeding motor 24 during each valid period, dots are printed on the tape 31A during each printing period to form an object on the tape 31A.

<5-4. Printing Period Adjustment by First Time Segment (Lp<Li)>

Figure 9A:
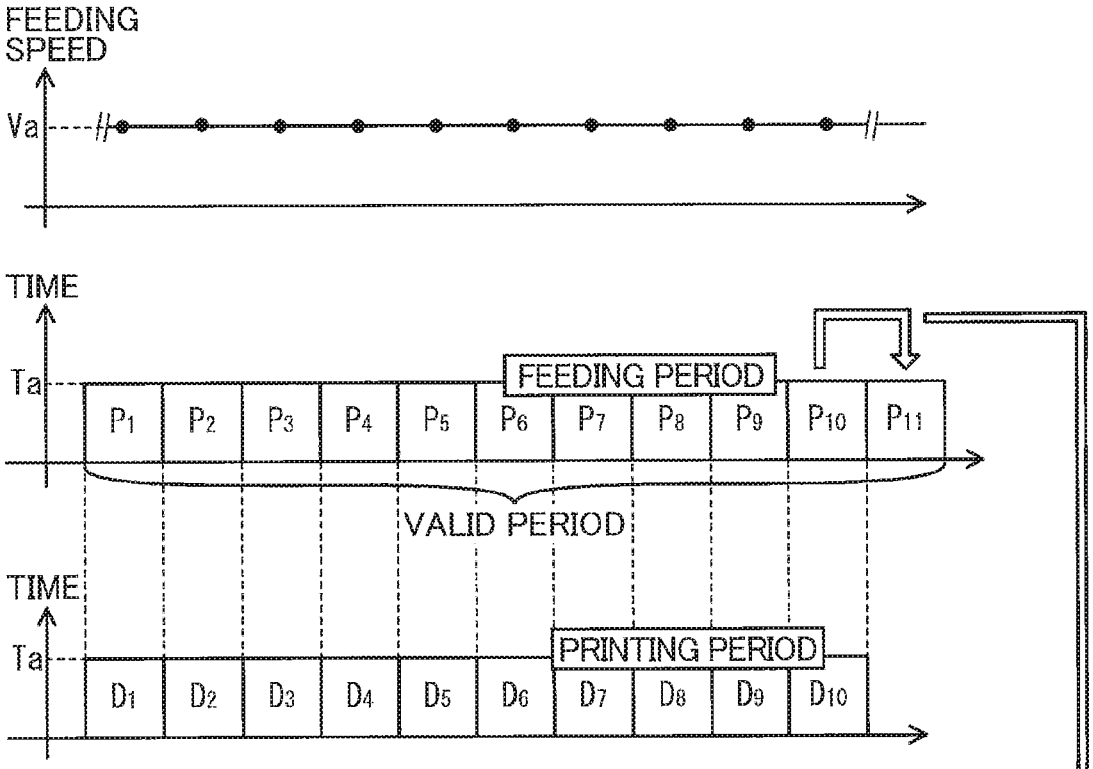
Figure 9B:
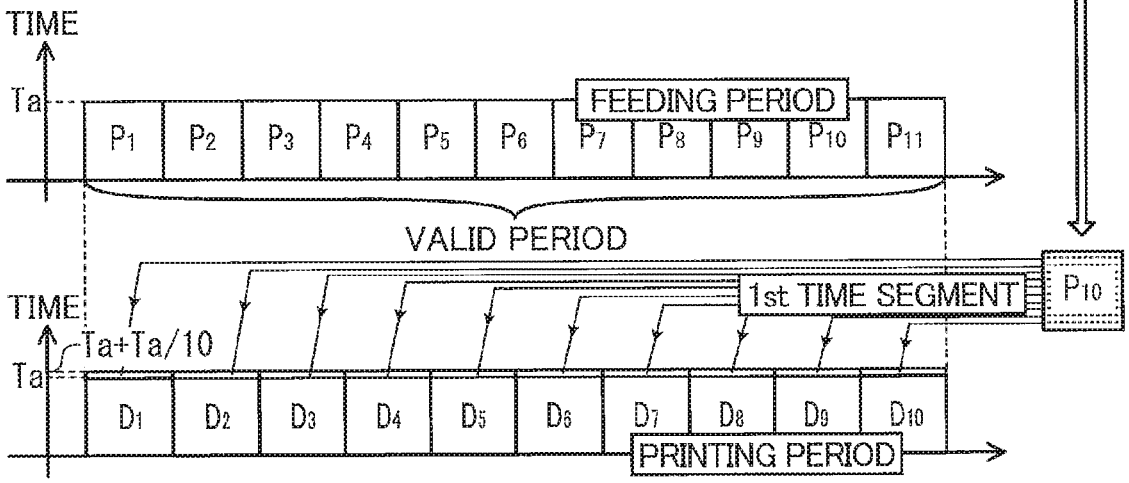

The process up to determining the first to eleventh feeding periods $P_1$ to $P_{11}$ to be valid periods is the same as that in the feeding period adjustment described in section 5-3 with reference to FIGS. 8A and 8B. Therefore, the process will not be described here but is illustrated in FIG. 9A. Next, as illustrated in FIG. 9B, the printing device 1 equally divides the time duration in the selected m number of (m=1) feeding period (the tenth feeding period $P_{10}$) into n number of (n=10) time segments, where n is the number of printing periods in the print cycle. Each resulting time segment (m×Ta/n) corresponds to the first time segment. The printing device 1 then adds the first time segment to each of the first to tenth printing periods $D_1$ to $D_{10}$. The time duration of each printing period is calculated to be Ta+(m×Ta/n)=Ta+Ta/10.

The printing device 1 outputs a pulsed signal to the tape feeding motor 24 during each of the valid periods (the first to eleventh feeding periods $P_1$ to $P_{11}$). As a result, the tape feeding motor 24 rotates to feed the tape 31A. Therefore, the length of the tape 31A to be fed is 10% larger than the actual value Lp and coincides with the setting value Li. Since the first time segment is added to each of the printing periods, the total time duration of the first to tenth printing periods $D_1$ to $D_{10}$ coincides with the total time duration of the valid periods (the first to eleventh feeding periods $P_1$ to $P_{11}$). Therefore, while the tape 31A is fed in response to the pulsed signal outputted to the tape feeding motor 24 during each valid period, dots are printed on the tape 31A during each printing period to form an object on the tape 31A.

<6. Print-Length Adjustment Control (when Feeding Speed is Maintained at Constant Speed after Acceleration)>

In the examples illustrated in FIGS. 10A to 13B, the feeding speed of the tape 31A increases from a speed Vb to a speed Vein the N-th print cycle. Specifically, during the N-th print cycle, the feeding speed in the first feeding period $P_1$ is a speed Vb, and the feeding speed in the n-th (n=10) feeding period $P_{10}$ is a speed Vc. The feeding speed of the tape 31A in the first to n-th (n=10) feeding periods $P_1$ to $P_{10}$ of the (N+1)-th print cycle is maintained at a constant speed Vc. In other words, the feeding speed of the tape 31A reaches a speed Vc in the n-th (n=10) feeding period $P_{10}$ of the N-th print cycle, and is maintained at this constant speed Vc in the first to n-th (n=10) feeding periods $P_1$ to $P_{10}$ of the (N+1)-th print cycle. Similarly, the printing speed increases in the N-th print cycle, reaches a constant speed in the n-th (n=10) printing period $D_{10}$ of the N-th print cycle, and is maintained at the constant speed through the first to n-th (n=10) printing periods $D_1$ to $D_{10}$ in the (N+1)-th print cycle.

A specific example of such change of the feeding speed of the tape 31A includes a through-up operation at the start of printing an object.

The printing device 1 sets the feeding speed of the tape 31A in each of the feeding periods from the p-th (p is an integer that is greater than or equal to two and smaller than m) to n-th (n=10) feeding periods $P_p$ to $P_{10}$ among the first to n-th (n=10) feeding periods $P_1$ to $P_{10}$ in the N-th print cycle to be a constant speed Vc, which is the same as the feeding speed of the tape 31A in each of the first to n-th (n=10) feeding periods $P_1$ to $P_{10}$ in the (N+1)-th print cycle. Therefore, as illustrated in FIGS. 10A, 11A, 12A, and 13A, the feeding speed Vc in each of the ninth (p=9) and n-th (n=10) feeding periods $P_9$ and $P_{10}$ of the N-th print cycle is the same as the feeding speed Vc in the first to n-th (n=10) feeding periods $P_1$ to $P_{10}$ of the (N+1)-th print cycle. Similarly, the printing device 1 sets the printing speed in each of the p-th (p=9) to n-th (n=10) printing periods $D_9$ and $D_{10}$ among the first to n-th (n=10) printing periods $D_1$ to $D_{10}$ of the N-th print cycle to be a constant speed, which is the same as the printing speed in each of the first to n-th (n=10) printing periods $D_1$ to $D_{10}$ in the (N+1)-th print cycle.

The value p is set to a minimum integer satisfying the relational expression Q<p/n, where Q (in a fractional value) is the largest design value of the ratio of the difference between the setting value Li and the actual value Lp to the setting value Li. A specific example will now be described in which p=2. Each of FIGS. 10A and 10B and FIGS. 11A and 11B illustrates a case in which the actual value Lp is approximately 10% larger than the setting value Li(Lp=1.1Li), and the adjustment value is −10%. Each of FIGS. 12A and 12B and FIGS. 13A and 13B illustrates a case in which the actual value Lp is approximately 10% smaller than the setting value Li (Lp=0.9Li), and the adjustment value is +10%.

<6-1. Feeding Period Adjustment by First Time Segment (Lp>Li)>

Figure 10A:
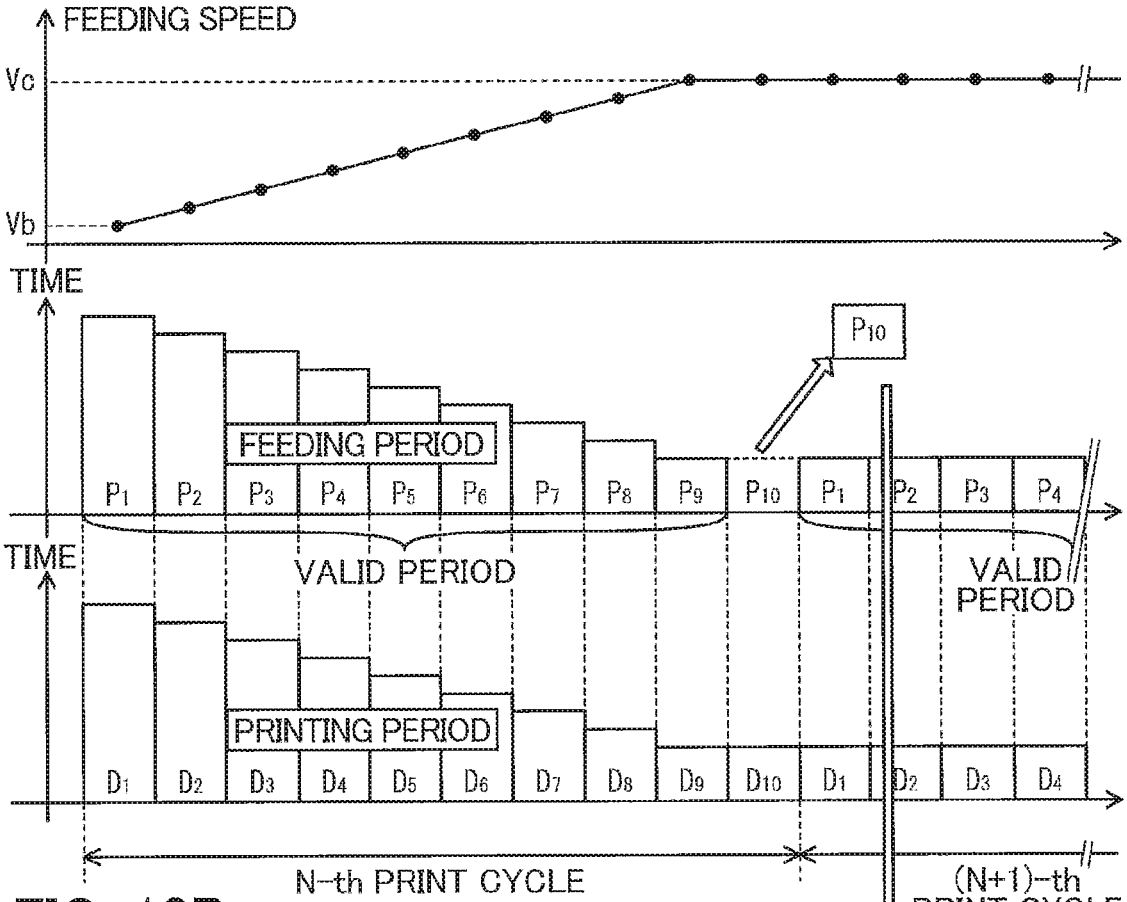
Figure 10B:
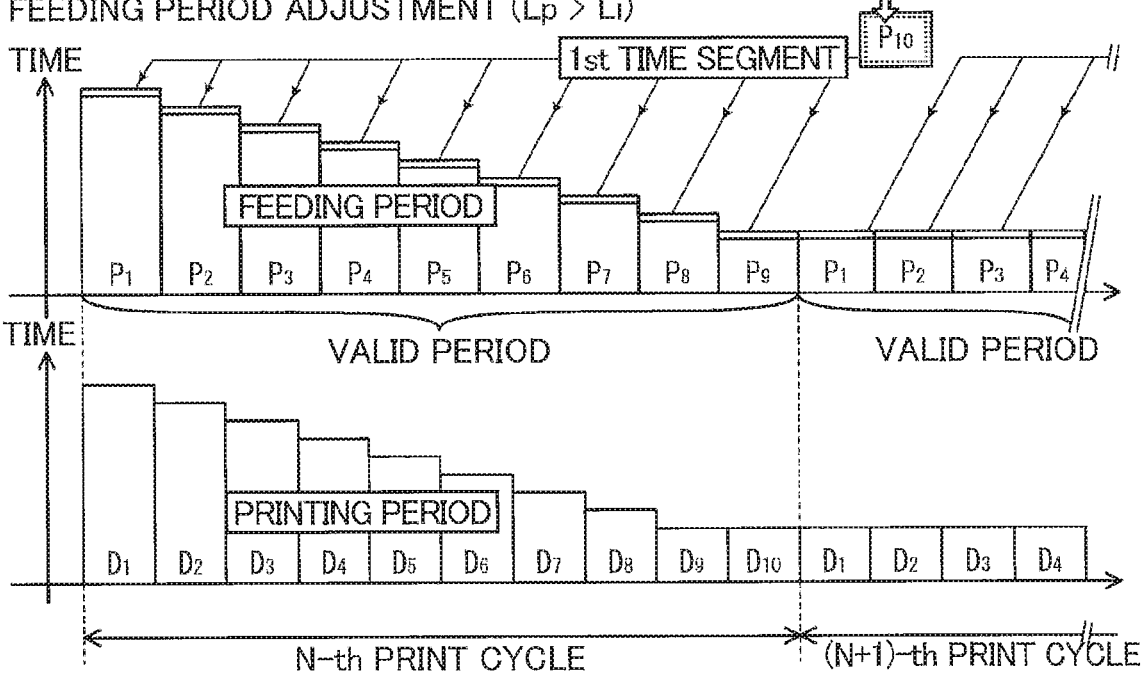

As illustrated in FIGS. 10A and 10B, the printing device 1 determines an integer m (=1) which is the number of feeding periods corresponding to the ratio of the difference between the setting value Li and the actual value Lp to the setting value Li on the basis of the adjustment value −10%. Unlike the case in which the feeding speed is maintained at constant as described in section 5 with reference to FIGS. 6A to 9B, the printing device 1 then selects m number of (m=1) feeding periods from among the first to n-th (n=10) feeding periods $P_1$ to $P_{10}$ in descending order from the n-th (n=10) feeding period $P_{10}$. In the example illustrated in FIGS. 10A and 10B, the n-th (n=10) feeding period $P_{10}$ is selected. Next, as illustrated in FIG. 10A, the printing device 1 determines valid periods to be feeding periods (the first to ninth feeding periods $P_1$ to $P_9$) except the selected m number of (m=1) feeding period (the tenth feeding period $P_{10}$) from among the first to n-th (n=10) feeding periods $P_1$ to $P_{10}$ in the N-th print cycle. In addition, the printing device 1 determines valid periods to be feeding periods (the first to ninth feeding periods $P_1$ to $P_9$) except the same feeding period as the selected m number of (m=1) feeding period (the tenth feeding period $P_{10}$) from among the first to n-th (n=10) feeding periods $P_1$ to $P_{10}$ in the (N+1)-th print cycle.

As illustrated in FIG. 10B, the printing device 1 then equally divides the time duration in the selected m number of (m=1) feeding period (the tenth feeding period $P_{10}$) into (n−m) number of (n−m=9) time segments, where (n−m) is the number of valid periods. Each resulting time segment is defined as the first time segment. Next, the printing device 1 adds the first time segment to each of the valid periods (the first to ninth feeding periods $P_1$ to $P_9$) in the N-th print cycle. Furthermore, the printing device 1 adds the first time segment determined for the N-th print cycle to each of the valid periods (the first to ninth feeding periods $P_1$ to $P_9$) in the (N+1)-th print cycle.

The feeding speed in each of the p-th (p=9) to n-th (n=10) feeding periods $P_9$ and $P_{10}$ in the N-th print cycle is the same constant speed Vc as the feeding speed in each of the first to n-th (n=10) feeding periods $P_1$ to $P_{10}$ in the (N+1)-th print cycle. Therefore, the sum of the time duration of the first time segment and the time duration of the last valid period (the ninth feeding period $P_9$) in the N-th print cycle coincides with the sum of the time duration of the first time segment and the time duration of the first valid period (the first feeding period $P_1$) in the (N+1)-th print cycle. As a result, the feeding speed is suppressed from varying during the transition from the N-th print cycle to the (N+1)-th print cycle.

The printing device 1 outputs a pulsed signal to the tape feeding motor 24 during each of the valid periods (the first to ninth feeding periods $P_1$ to $P_9$) to which the first time segment is added in the N-th print cycle, and also outputs a pulsed signal to the tape feeding motor 24 during each of the valid periods (the first to ninth feeding periods $P_1$ to $P_9$) to which the first time segment is added in the (N+1)-th print cycle. As a result, the tape feeding motor 24 is driven to rotate, thereby feeding the tape 31A. The valid periods in the N-th and (N+1)-th print cycles each consist of nine feeding periods (the first to ninth feeding periods $P_1$ to $P_9$). This is 10% less than the number of feeding periods normally included in a prim cycle. However, in this example, the actual value Lp without adjustment is 10% is larger than the setting value Li. Therefore, the length of the tape 31A to be fed is 10% smaller than the actual value Lp without adjustment and coincides with the setting value Li.

Since the first time segment is added to each of the valid periods (the first to ninth feeding periods $P_1$ to $P_9$ in the N-th print cycle and the first to ninth feeding periods $P_1$ to $P_9$ in the (N+1)-th print cycle), the total time duration of the valid periods coincides with the total time duration of the first to n-th (n=10) printing periods $D_1$ to $D_{10}$ in the N-th print cycle and the total time duration of the first to n-th (n=10) printing periods $D_1$ to $D_{10}$ in the (N+1)-th print cycle. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles to form an object on the tape 31A.

<6-2. Printing Period Adjustment by First Time Segment (Lp>Li)>

Figure 11A:
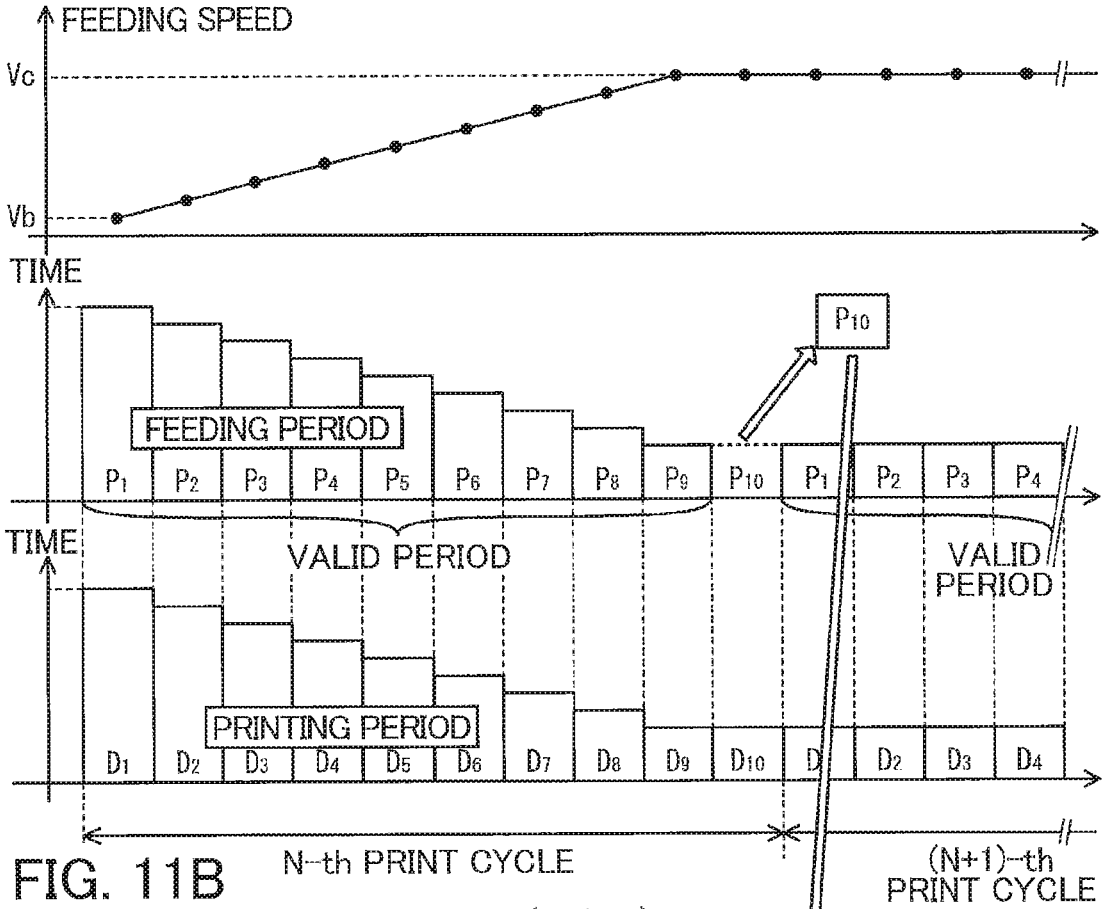
Figure 11B:
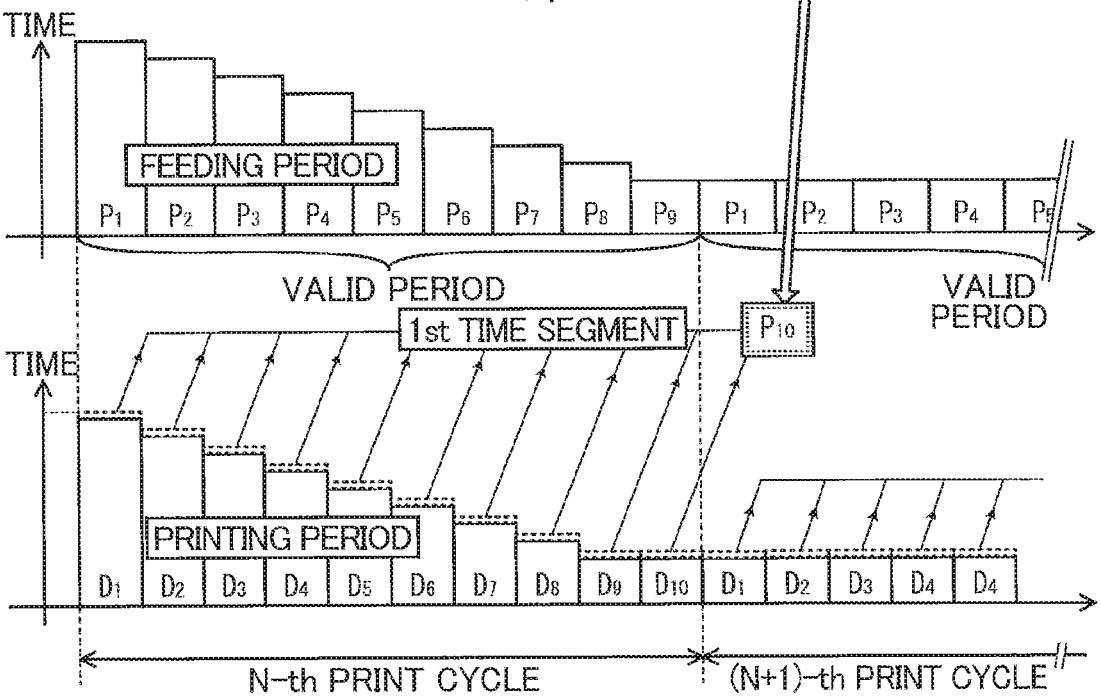

The process up to determining the first to ninth feeding periods $P_1$ to $P_9$ in the N-th print cycle and the first to ninth feeding periods $P_1$ to $P_9$ in the (N+1)-th print cycle to be valid periods is the same as that in the feeding period adjustment described in section 6-1 with reference to FIG. 10A. Therefore, the process will not be described here but is illustrated in FIG. 11A. As illustrated in FIG. 11B, the printing device 1 then equally divides the time duration in the selected m number of (m=1) feeding period (the tenth feeding period $P_{10}$) into n number of (n=10) time segments, where n is the number of printing periods in the print cycle. The resulting time segments are each defined as the first time segment. Next, the printing device 1 subtracts the first time segment from each of the first to n-th (n=10) printing periods $D_1$ to $D_{10}$ in the N-th print cycle. Furthermore, the printing device 1 subtracts the first time segment from each of the first to n-th (n=10) printing periods $D_1$ to $D_{10}$ in the (N+1)-th print cycle.

The printing speed in each of the p-th (p=9) to n-th (n=10) printing periods $D_9$ to $D_{10}$ in the N-th print cycle is the same as the printing speed in each of the first to n-th (n=10) printing periods $D_1$ to $D_{10}$ in the (N+1)-th print cycle. Therefore, the printing speed in each of the p-th (p=9) to n-th (n=10) printing periods $D_9$ and $D_{10}$ in the N-th print cycle coincides with the printing speed in each of the first to n-th (n=10) printing periods $D_1$ to $D_{10}$ in the (N+1)-th print cycle. As described above, the first time segment is subtracted from each of the first to n-th (n=10) printing periods $D_1$ to $D_{10}$ in the N-th print cycle and from each of the first to n-th (n=10) printing periods $D_1$ to $D_{10}$ in the (N+1)-th print cycle. Therefore, the printing speed in the last printing period (the n-th (n=10) printing period $D_{10}$) in the N-th print cycle coincides with the printing speed in the initial printing period (the first printing period $D_1$) in the (N+1)-th print cycle. As a result, the printing speed is suppressed from varying during the transition from the N-th print cycle to the (N+1)-th print cycle.

The printing device 1 outputs a pulsed signal to the tape feeding motor 24 during each of the valid periods (the first to ninth feeding periods $P_1$ to $P_9$) of the N-th print cycle and each of the valid periods (the first to ninth feeding periods $P_1$ to $P_9$) of the (N+1)-th print cycle. As a result, the tape feeding motor 24 is driven to rotate, thereby feeding the tape 31A. Therefore, the length of the tape 31A to be fed is 10% smaller than the actual value Lp without adjustment and coincides with the setting value Li.

Since the first time segment is subtracted from each of the first to n-th (n=10) printing periods $D_1$ to $D_{10}$ in the N-th print cycle and each of the first to n-th (n 10) printing periods $D_1$ to $D_{10}$ in the (N+1)-th print cycle, the total time duration of the first to n-th (n=10) printing periods $D_1$ to $D_{10}$ in the N-th print cycle and the total time duration of the first to n-th (n=10) printing periods $D_1$ to $D_{10}$ in the (N+1)-th print cycle respectively coincide with the total time duration of the valid periods (the first to ninth feeding periods $P_1$ to $P_9$) of the N-th print cycle and the total time duration of the valid periods (the first to ninth feeding periods $P_1$ to $P_9$) of the (N+1)-th print cycle. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles to form an object on the tape 31A.

<6-3. Feeding Period Adjustment by First Time Segment (Lp<Li)>

Figure 12A:
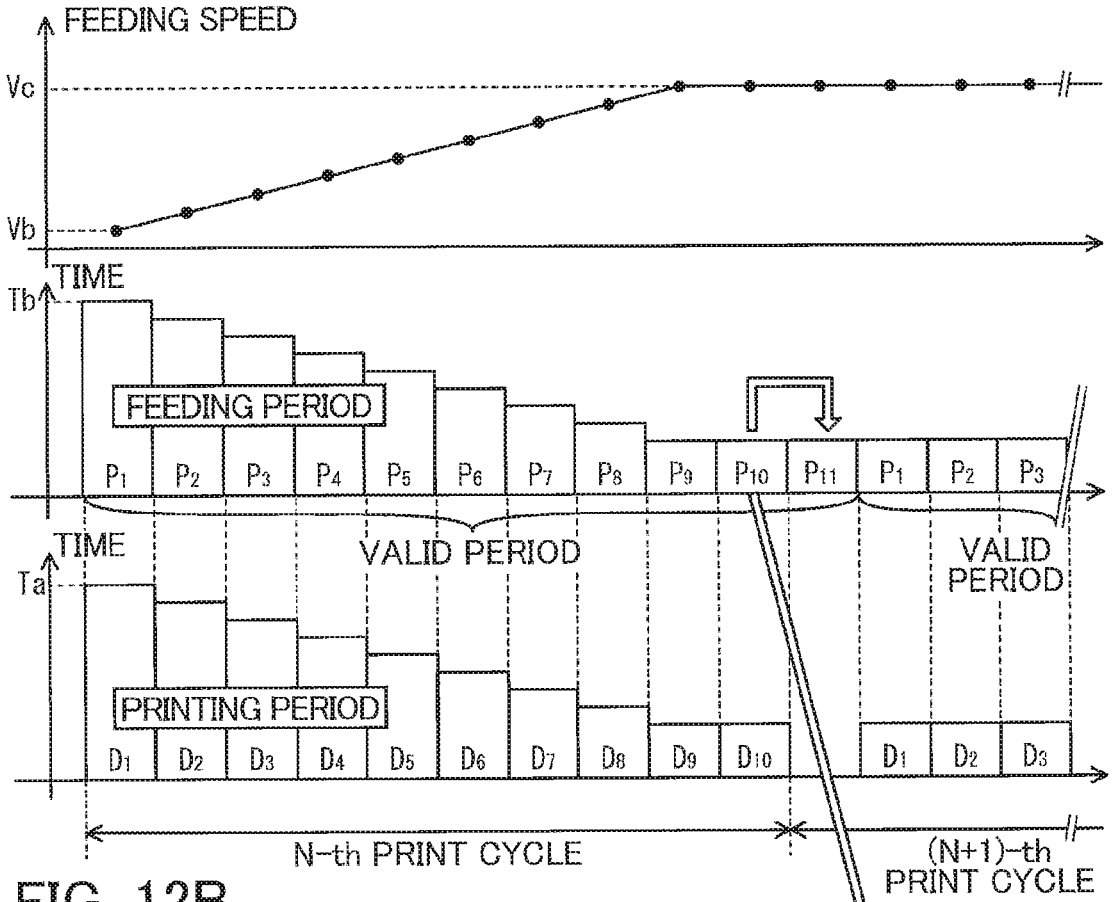
Figure 12B:
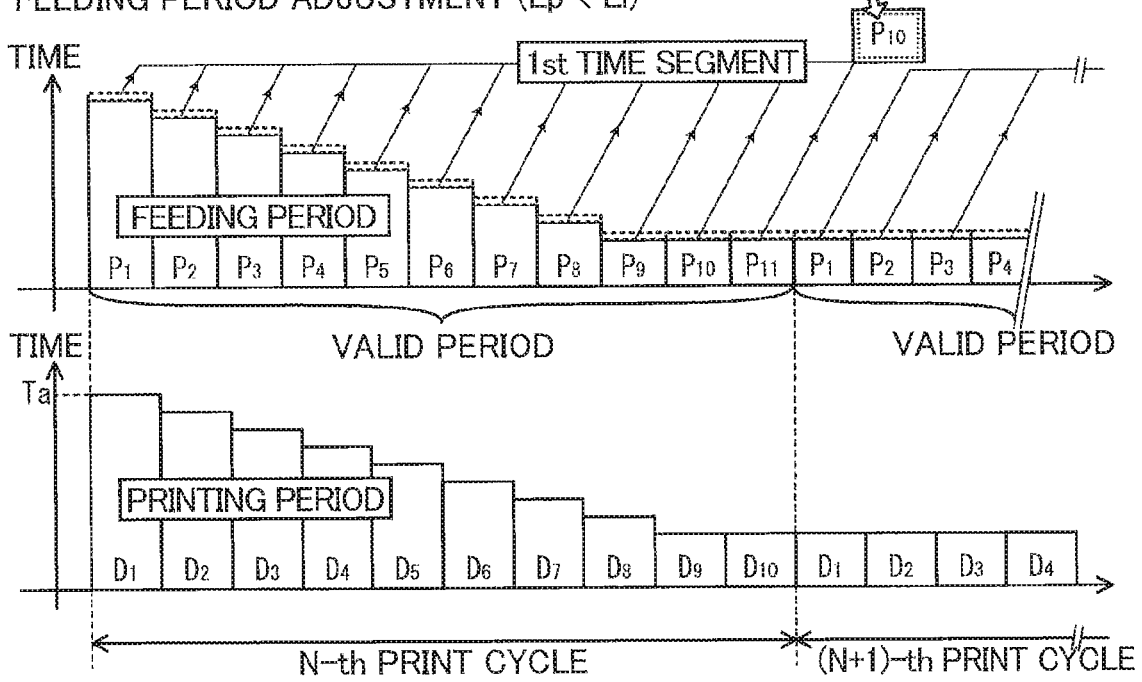

As illustrated in FIGS. 12A and 12B, the printing device 1 selects the tenth feeding period $P_{10}$ in the N-th print cycle (as in sections 6-1 (see FIGS. 10A and 10B) and 6-2 (see FIGS. 11A and 11B)) to be the m number of (m=1) feeding period corresponding to the ratio of the difference between the setting value Li and the actual value Lp to the setting value Li on the basis of the adjustment value+10%. The printing device 1 adds an eleventh feeding period $P_{11}$ having the same time duration as that of the selected m number of (m=1) feeding period (the tenth feeding period $P_{10}$) to the N-th print cycle and determines the first to eleventh feeding periods $P_1$ to $P_{11}$ to be the valid periods of the N-th print cycle, as illustrated in FIG. 12A. Furthermore, the printing device 1 adds an eleventh feeding period $P_{11}$ to the (N+1)-th print cycle and determines the first to eleventh feeding periods $P_1$ to $P_{11}$ to be the valid periods in the (N+1)-th print cycle.

The printing device 1 then equally divides the time duration in the selected m number of (m=1) feeding period (the tenth feeding period $P_{10}$) into (n+m) number of (n+m=11) time segments, where n+m is the number of valid periods. The printing device 1 defines each of the resulting time segments as the first time segment. The printing device 1 then subtracts the first time segment from each of the valid periods (the first to eleventh feeding periods $P_1$ to $P_{11}$) in the N-th print cycle. Furthermore, the printing device 1 subtracts the first time segment from each of the valid periods (the first to eleventh feeding periods $P_1$ to $P_{11}$) in the (N+1)-th print cycle.

The feeding speed in each of the p-th (p=9) to n-th (n=10) feeding periods $P_9$ to $P_{10}$ in the N-th print cycle is set to the same constant speed Vc as the feeding speed in each of the first to n-th (n=10) feeding periods $P_1$ to $P_{10}$ in the (N+1)-th print cycle. Therefore, the value obtained by subtracting the time duration of the first time segment from the time duration of the last valid period (the eleventh feeding period $P_{11}$) in the N-th print cycle coincides with the value obtained by subtracting the time duration of the first time segment from the time duration of the initial valid period (the first feeding period $P_1$) in the (N+1)-th print cycle. As a result, the feeding speed is suppressed from varying during the transition from the N-th print cycle to the (N+1)-th print cycle.

The printing device 1 outputs a pulsed signal to the tape feeding motor 24 during each of the valid periods (the first to eleventh feeding periods $P_1$ to $P_{11}$) from which the first time segment is subtracted in the N-th print cycle, and also outputs a pulsed signal during each of the valid periods (the first to eleventh feeding periods $P_1$ to $P_{11}$) from which the first time segment is subtracted in the (N+1)-th print cycle. As a result, the tape feeding motor 24 is driven to rotate, thereby feeding the tape 31A. The valid periods in the N-th print cycle and the valid periods in the (N+1)-th print cycles each consist of eleven feeding periods (the first to eleventh feeding periods $P_1$ to $P_{11}$). This is 10% more than the number of feeding periods normally included in a print cycle. However, in this example, the actual value Lp without adjustment is 10% smaller than the setting value Li. Therefore, the length of the tape 31A to be fed is 10% larger than the actual value Lp without adjustment and coincides with the setting value Li.

Since the first time segment is subtracted from each of the valid periods (the first to eleventh feeding periods $P_1$ to $P_{11}$ in the N-th print cycle and the first to eleventh feeding periods $P_1$ to $P_{11}$ in the (N+1)-th print cycle), the total time duration of the valid periods coincides with the total time duration of the first to n-th (n=10) printing periods $D_1$ to $D_{10}$ in the N-th print cycle or the total time duration of the first to n-th (n=10) printing periods $D_1$ to $D_{10}$ in the (N+1)-th print cycle. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles to form an object on the tape 31A.

<6-4. Printing Period Adjustment by First Time Segment (Lp<Li)>

Figure 13A:
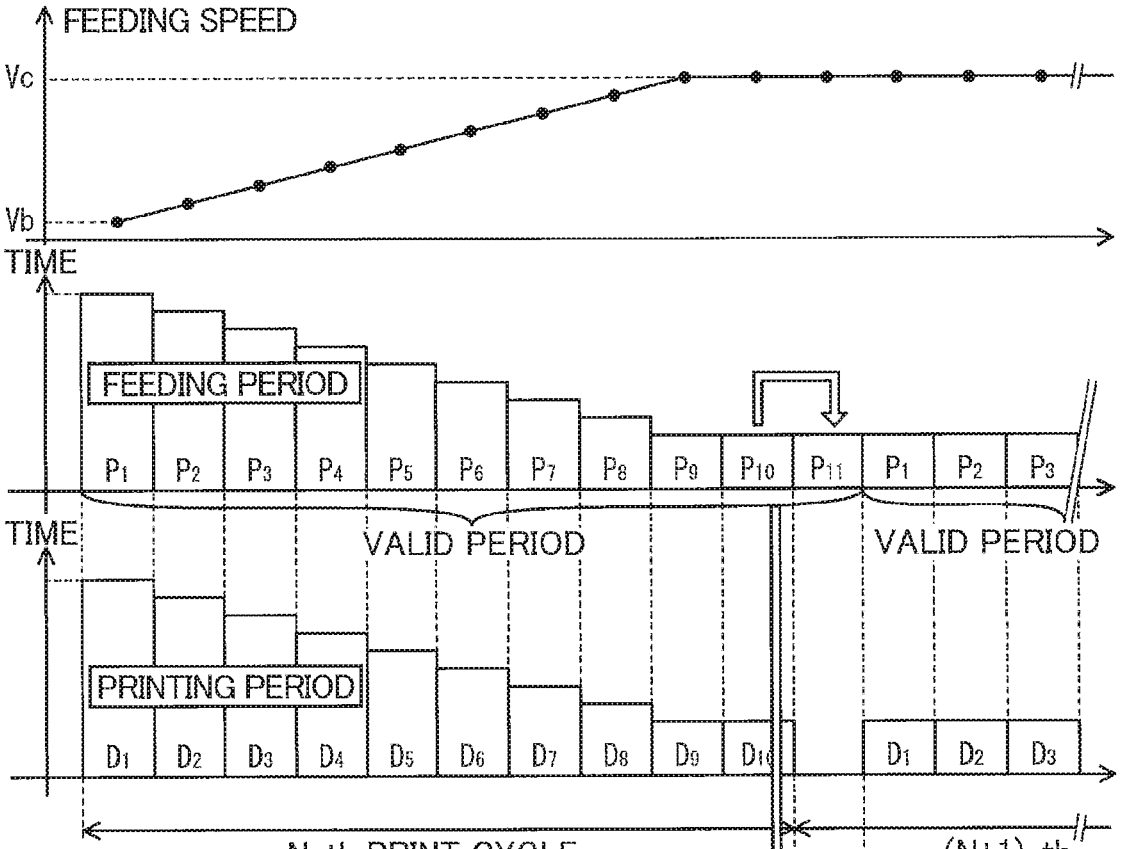
Figure 13B:
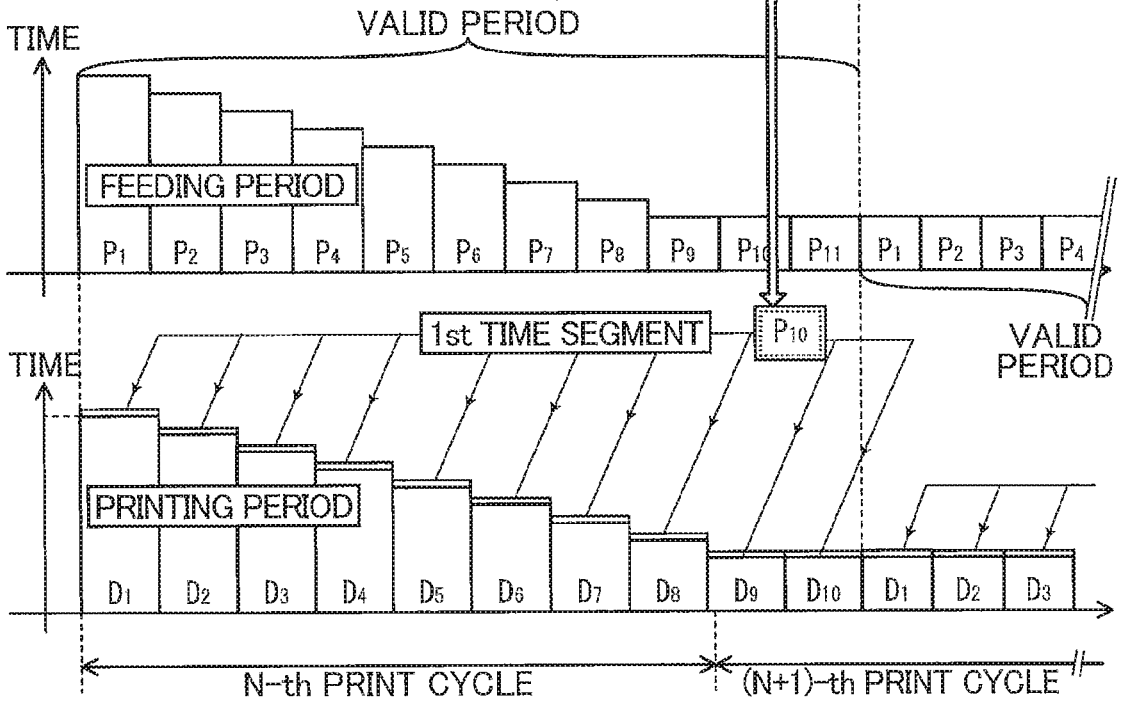

The process up to determining the first to eleventh feeding periods $P_1$ to $P_1$ in the N-th print cycle and the first to eleventh feeding periods $P_1$ to $P_{11}$ in the (N+1)-th print cycle to be valid periods is the same as that in the feeding period adjustment described in section 6-3 with reference to FIG. 12A. Therefore, the process will not be described here but is illustrated in FIG. 13A. As illustrated in FIG. 13B, the printing device 1 then equally divides the time duration in the selected m number of (m=1) feeding period (the tenth feeding period $P_{10}$) into the n number of (n=10) time segments, where n is the number of printing periods in the N-th print cycle. The resulting time segments are each defined as the first time segment. Next, the printing device 1 adds the first time segment to each of the first to n-th (n=10) printing periods $D_1$ to $D_{10}$ in the N-th print cycle. Furthermore, the printing device 1 adds the first time segment to each of the first to n-th (n=10) printing periods $D_1$ to $D_{10}$ in the (N+1)-th print cycle.

The printing speed in each of the p-th (p=9) to n-th (n=10) printing periods $D_9$ to $D_{10}$ in the N-th print cycle is the same as the printing speed in each of the first to n-th (n=10) printing period $D_1$ to $D_{10}$ in the (N+1)-th print cycle. Therefore, the printing speed in each of the p-th (p=9) to n-th (n=10) printing periods $D_9$ to $D_{10}$ in the N-th print cycle coincides with the printing speed in each of the first to n-th (n=10) printing periods $D_1$ to $D_{10}$ in the (N+1)-th print cycle. As described above, the first time segment is added to each of the first to n-th (n=10) printing periods $D_1$ to $D_{10}$ in the N-th print cycle and each of the first to n-th (n=10) printing periods $D_1$ to $D_{10}$ in the (N+1)-th print cycle. Therefore, the printing speed in the last printing period (the n-th (n=10) feeding period $D_{10}$) in the N-th print cycle coincides with the printing speed in the initial printing period (the first feeding period $D_1$) in the (N+1)-th print cycle. As a result, the printing speed is suppressed from varying during the transition from the N-th print cycle to the (N+1)-th print cycle.

The printing device 1 outputs a pulsed signal to the tape feeding motor 24 during each of the valid periods (the first to eleventh feeding periods $P_1$ to Pit) of the N-th print cycle and each of the valid periods (the first to eleventh feeding periods $P_1$ to $P_{11}$) in the (N+1)-th print cycle. As a result, the tape feeding motor 24 is driven to rotate, thereby feeding the tape 31A. Therefore, the length of the tape 31A to be fed is 10% larger than the actual value Lp without adjustment and coincides with the setting value Li.

Since the first time segment is added to each of the first to n-th (n=10) printing periods $D_1$ to $D_{10}$ in the N-th print cycle and to each of the first to n-th (n=10) printing periods $D_1$ to $D_{10}$ in the (N+1)-th print cycle, the total time duration of the first to n-th (n=10) printing periods $D_1$ to $D_{10}$ in the N-th print cycle and the total time duration of the first to n-th (n=10) printing periods $D_1$ to $D_{10}$ in the (N+1)-th print cycle respectively coincide with the total time duration of the valid periods (the first to eleventh feeding periods $P_1$ to $P_{11}$) in the N-th print cycle and the total time duration of the valid periods (the first to eleventh feeding periods $P_1$ to $P_{11}$) in the (N+1)-th print cycle. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles to form an object on the tape 31A.

<7. Print-Length Adjustment Control (when Feeding Speed Decreases after Maintained at Constant Speed)>

Figure 14:
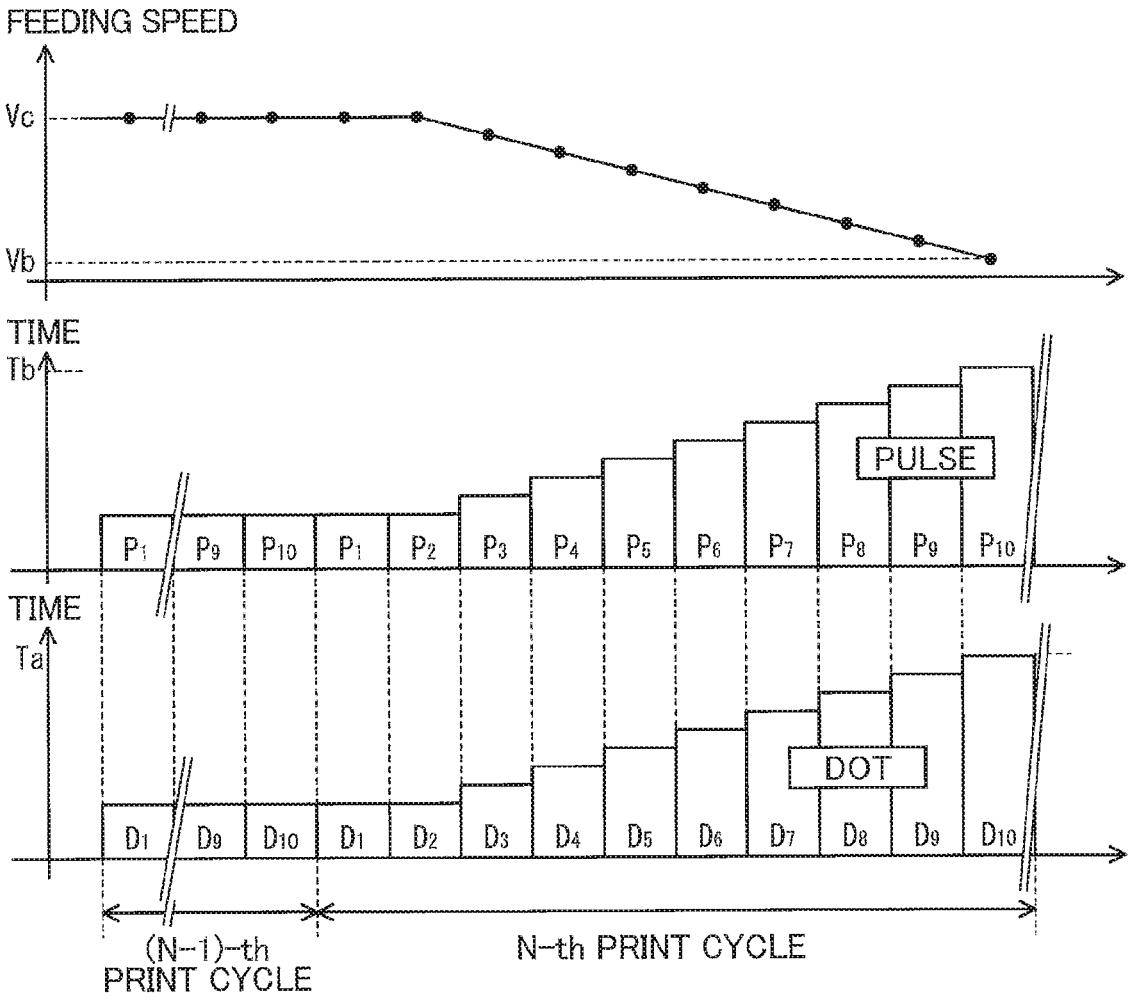
FIG. 14 is an explanatory diagram illustrating the feeding speed of the tape, feeding periods and printing periods in non-synchronized print control in which the feeding speed of the tape decreases after maintained at a constant.

In the example illustrated in FIG. 14, the feeding speed of the tape 31A in the first to n-th (n=10) feeding periods $P_1$ to $P_{11}$ of the (N−1)-th print cycle is maintained at a constant speed Vc. In the N-th print cycle, the feeding speed of the tape 31A decreases from a speed Vc to a speed Vb. In other words, the feeding speed in the first to n-th (n=10) feeding periods $P_1$ to $P_{10}$ of the (N−1)-th print cycle is maintained at a constant speed Vc that is the same speed in the first feeding period $P_1$ of the N-th print cycle. A specific example of such change of the feeding speed of the tape 31A includes a through-down operation at the end of printing an object.

The printing device 1 sets the feeding speed of the tape 31A in each of the feeding periods from the first to p-th feeding periods $P_1$ to $P_p$ among the first to n-th (n=10) feeding periods $P_1$ to $P_{10}$ in the N-th print cycle to be a constant speed Ve, which is the same as the feeding speed in each of the first to n-th (n=10) feeding periods $P_1$ to $P_{10}$ in the (N−1)-th print cycle. The setting condition of p is the same as that in the case of acceleration of the feeding speed described in section 6 with reference to FIGS. 10A to 13B, and p is set to two in this embodiment. Therefore, the feeding speed in each of the first and second (p-th) feeding periods $P_1$ and $P_2$ in the N-th print cycle is the same constant speed Vc as the feeding speed in each of the first to tenth (n-th) feeding periods $P_1$ to $P_{10}$ in the (N−1)-th print cycle. Similarly, the printing speed in each of the first and the second (p-th) printing periods $D_1$ and $D_2$ in the N-th print cycle is the same as the printing speed in each of the first to tenth (n-th) printing periods $D_1$ to $D_{10}$ in the (N−1)-th print cycle.

The print-length adjustment control (the feeding period adjustment and the printing period adjustment) performed when the feeding speed decreases after maintained at a constant speed is substantially the same as the print-length adjustment control (the feeding period adjustment (see FIGS. 10A and 10B and FIGS. 12A and 12B) and the printing period adjustment (see FIGS. 11A and 11B and FIGS. 13A and 13B)) performed when the feeding speed is maintained at a constant speed after acceleration. The procedure to select m number of feeding periods when the integer m, that is the number of feeding periods corresponding to the ratio of the difference between the setting value Li and the actual value Lp to the setting value Li, is determined is different from that in the case in which the feeding speed increases. When the feeding speed reaches and is maintained at a constant speed after acceleration (see FIGS. 10A to 13B), the printing device 1 selects m number of feeding periods from among the first to n-th feeding periods $P_1$ to $P_n$ of the N-th print cycle in descending order from the n-th feeding periods Pn. In contrast, when the feeding speed decreases after maintained at a constant velocity (see FIGS. 14A and 14B), the printing device 1 selects m number of feeding periods from among the first to n-th (n=10) feeding periods $P_1$ to $P_{10}$ of the N-th print cycle in ascending order from the first feeding period $P_1$. Since other steps in the print-length adjustment control for a case in which the feeding speed decreases after maintained at a constant speed are the same as those for a case in which the feeding speed reaches and is maintained at a constant speed after acceleration. Therefore, the descriptions thereof are not repeated here.

The case illustrated in FIG. 14 is similar to the cases illustrated in FIGS. 10A to 13B. Therefore, even when feeding period adjustment is performed, for example, the feeding speed is suppressed from varying during the transition from the N-th print cycle to the (N+1)-th print cycle. Moreover, even when printing period adjustment is performed, for example, the printing speed is suppressed from varying during the transition from the N-th print cycle to the (N+1)-th print cycle.

<8. Print-Length Adjustment Control by First Time Segment (when Feeding Speed Decreases after Acceleration)>

In the examples illustrated in FIGS. 15A to 18B, the feeding speed of the tape 31A increases from a speed Vd to a speed Ve during the first to n-th (n=10) feeding periods $P_1$ to $P_{10}$ in the N-th print cycle. The feeding speed during the first feeding period $P_1$ in the N-th print cycle is the speed Vd, and the feeding speed during the n-th (n=10) feeding period $P_{10}$ is the speed Ve. The feeding speed of the tape 31A during the first to n-th (n=10) feeding periods $P_1$ to $P_{10}$ in the (N+1)-th print cycle decreases from the speed Ve to the speed Vd. A specific example in which the feeding speed of the tape 31A varies in such a manner includes a case in which an object having small length in the feeding direction is printed.

Each of FIGS. 15A and 15B and FIGS. 16A and 16B illustrates a case in which the actual value Lp is approximately 10% larger than the setting value Li, and the adjustment value is set to −10%. Each of FIGS. 17A and 17B and FIGS. 18A and 18B illustrates a case in which the actual value Lp is approximately 10% smaller than the setting value Li, and the adjustment value is set to +10%.

<8-1. Feeding Period Adjustment by First Time Segment (Lp>Li)>

Figure 15A:
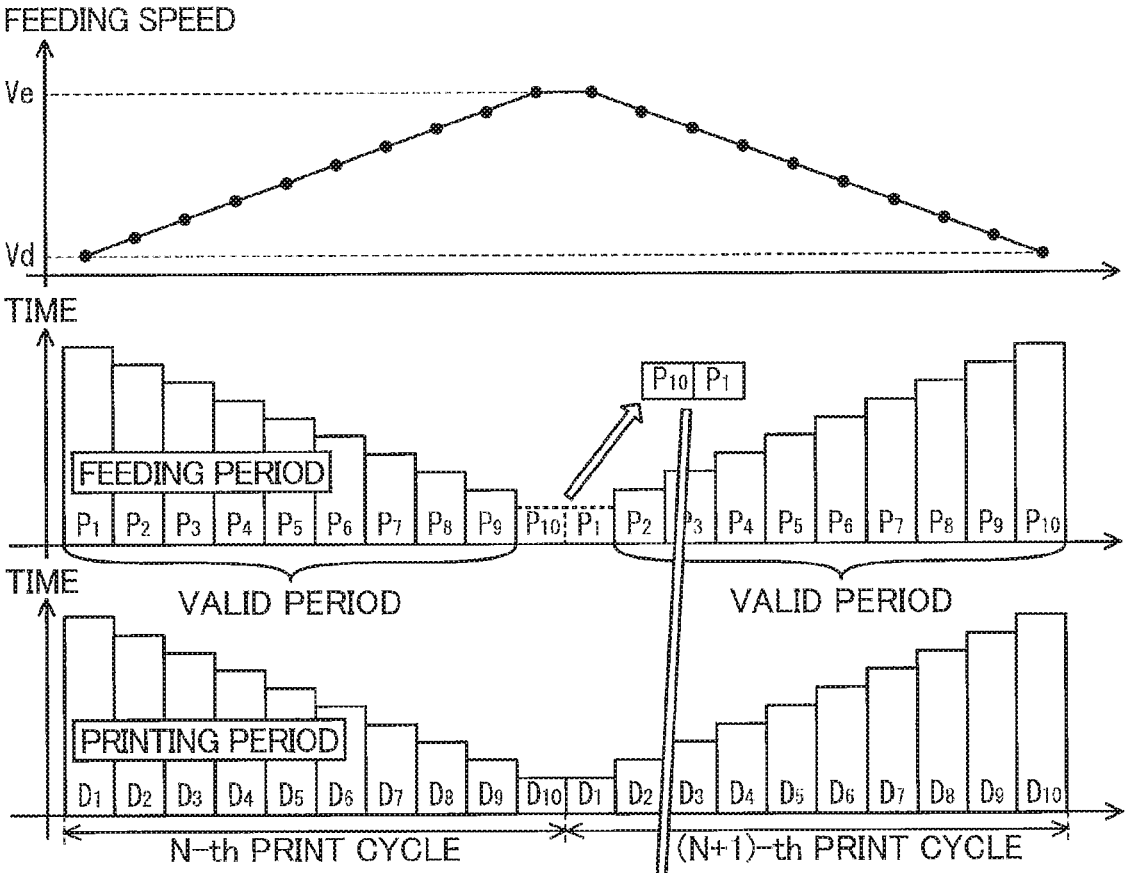

As illustrated in FIG. 15A, the printing device 1 first determines an integer m which is greater than or equal to one and smaller than n. The integer m is the number of feeding periods corresponding to the ratio of the difference between the setting value Li and the actual value Lp to the setting value Li according to the adjustment value −10%. Note that, unlike the description above, the printing device 1 determines the integer m on the basis of 2n number of (n=10) feeding periods included in two print cycles (the N-th print cycle and the (N+1)-th print cycle). Thus, when the adjustment value is −10%, the corresponding integer m that is the number of the corresponding feeding periods is two which is a value satisfying the relational expression $m/2n=|-10\%|$.

Next, the printing device 1 selects m number of (m=2) feeding periods from among the first to n-th (n=10) feeding periods $P_1$ to $P_{10}$ in the N-th print cycle and the first to n-th (n=10) feeding periods $P_1$ to $P_{10}$ in the (N+1)-th print cycle in order of feeding speed from the fastest one. In the case illustrated in FIG. 15A, the feeding speed Ve in the tenth feeding period $P_{10}$ of the N-th print cycle and the feeding speed Ve in the first feeding period $P_1$ of the (N+1)-th print cycle are the fastest. Therefore, these two feeding periods are selected. The first to ninth feeding periods $P_1$ to $P_9$ in the N-th print cycle and the second to n-th (n=10) feeding periods $P_2$ to $P_{10}$ in the (N+1)-th print cycle are determined as valid periods while the selected m number of (m=2) feeding periods are excluded.

Figure 15B:
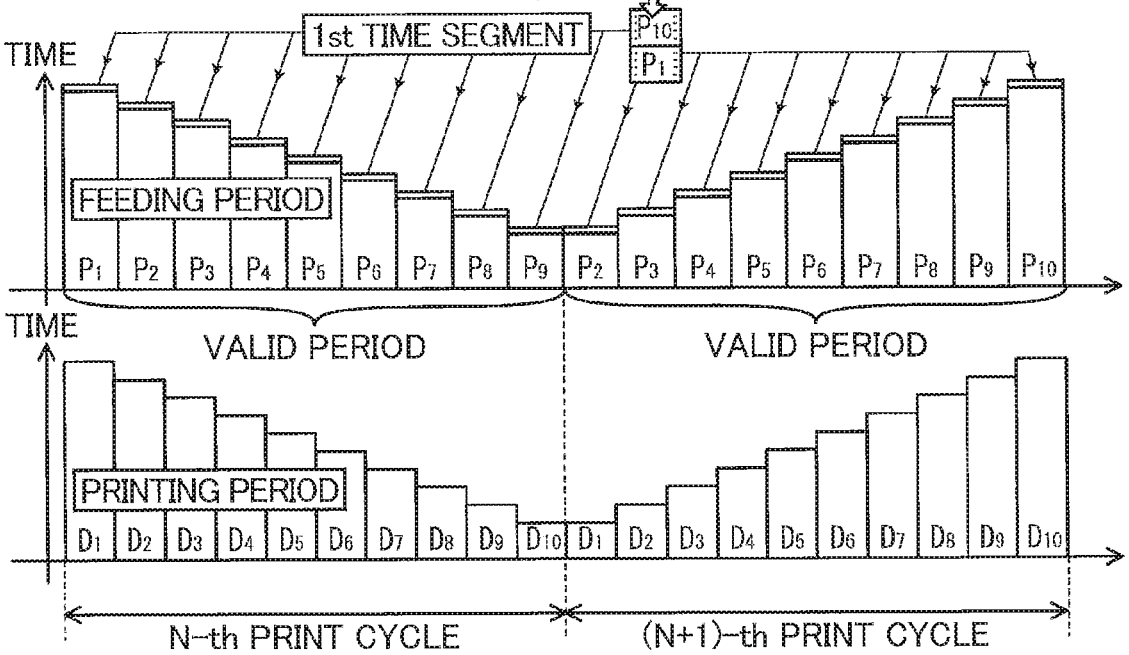

As illustrated in FIG. 15B, the printing device 1 then equally divides the time duration corresponding to the sum of the selected m number of (m=2) feeding periods (the tenth feeding period $P_{10}$ in the N-th print cycle and the first feeding period $P_1$ in the (N+1)-th print cycle) into (2n−m) number of (2n−m=18) time segments, where (2n−m) is the number of valid periods. The resulting time segments are each defined as the first time segment. The printing device 1 adds the first time segment to each of the valid periods (the first to ninth feeding periods $P_1$ to $P_9$ in the N-th print cycle and the second to n-th (n=10) feeding periods $P_2$ to $P_{10}$ in the (N+1)-th print cycle).

The printing device 1 outputs a pulsed signal to the tape feeding motor 24 during each of the valid periods (the first to ninth feeding periods $P_1$ to $P_9$ in the N-th print cycle and the second to n-th (n=10) feeding periods $P_2$ to $P_{10}$ in the (N+1)-th print cycle) to which the first time segment is added. As a result, the tape feeding motor 24 is driven to rotate, thereby feeding the tape 31A. The valid periods in the N-th and (N+1)-th print cycles consist of a total of eighteen feeding periods. This is 10% less than the total number of feeding periods normally included in the N-th and (N+1)-th print cycles. However, in this example, the actual value Lp without adjustment is 10% larger than the setting value Li. Therefore, the length of the tape 31A to be fed is 10% smaller than the actual value Lp without adjustment and coincides with the setting value Li.

Since the first time segment is added to each of the valid periods in the N-th print cycle and to each of the valid periods in the (N+1)-th print cycle (the first to ninth feeding periods $P_1$ to $P_9$ in the N-th print cycle and the second to n-th (n=10) feeding periods $P_2$ to $P_{10}$ in the (N+1)-th print cycle), the total time duration of the valid periods in each print cycle coincides with the total time duration of the first to n-th (n=10) printing periods $D_1$ to $D_{10}$ in each of the N-th and (N+1)-th print cycles. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles. In this way, an object is printed on the tape 31A.

<8-2. Printing Period Adjustment by First Time Segment (Lp>Li)>

Figure 16A:
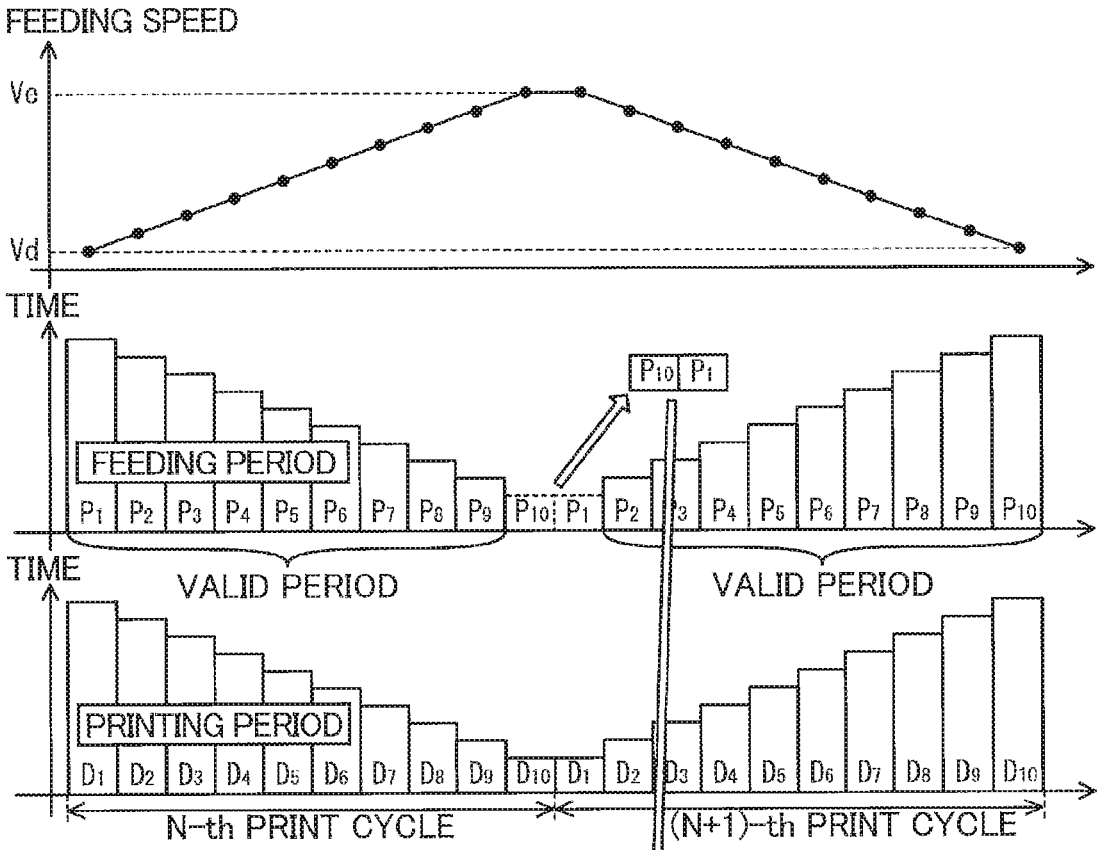

The process up to determining the first to ninth feeding periods $P_1$ to $P_9$ in the N-th print cycle and the second to n-th (n=10) feeding periods $P_2$ to $P_{10}$ in the (N+1)-th print cycle to be valid periods is the same as that described in section 8-1 with reference to FIG. 15A. Therefore, the process will not be described here but is illustrated in FIG. 16A. Next, as illustrated in FIG. 15B, the printing device 1 equally divides the time duration corresponding to the sum of the selected m number of (m=2) feeding periods (the tenth feeding period $P_{10}$ in the N-th print cycle and the first feeding period $P_1$ in the (N+1)-th print cycle) into 2n number of (2n=20) time segments, where 2n is the number of printing periods in the N-th and (N+1)-th print cycles. The resulting time segments are each defined as the first time segment. The printing device 1 then subtracts the first time segment from each of the first to n-th (n=10) printing periods $D_1$ to $D_{10}$ in the N-th print cycle and the first to n-th (n=10) printing periods $D_1$ to $D_{10}$ in the (N+1)-th print cycle.

The printing device 1 outputs a pulsed signal to the tape feeding motor 24 during each of the valid periods (the first to ninth feeding periods $P_1$ to $P_9$) in the N-th print cycle, and also outputs a pulsed signal to the tape feeding motor 24 during each of the valid periods (the second to n-th (n=10) feeding periods $P_2$ to $P_{10}$) in the (N+1)-th print cycle. As a result, the tape feeding motor 24 rotates to feed the tape 31A. Therefore, the length of the tape 31A to be fed is 10% smaller than the actual value Lp without adjustment and coincides with the setting value Li.

Since the first time segment is subtracted from each of the first to tenth printing periods $D_1$ to $D_{10}$ in the N-th and (N+1)-th print cycles, the total time duration of the first to tenth printing periods $D_1$ to $D_{10}$ in the N-th print cycle coincides with the total time duration of the valid periods (the first to ninth feeding periods $P_1$ to $P_9$) in the N-th print cycle, and the total time duration of the first to tenth printing periods $D_1$ to $D_{10}$ in the (N+1)-th print cycle coincides with the total time duration of the valid periods (the second to n-th (n=10) feeding period $P_2$ to $P_{10}$) in the (N+1)-th print cycle. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles. In this way, an object is printed on the tape 31A.

<8-3. Feeding Period Adjustment by First Time Segment (Lp<Li)>

Figure 16B:
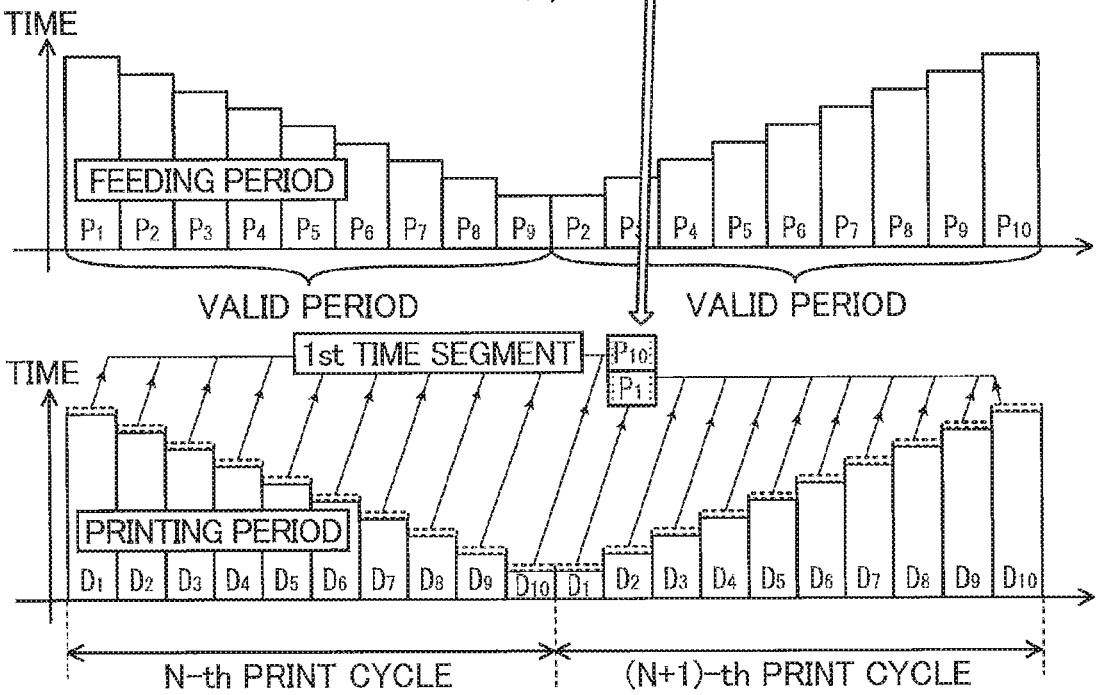
Figure 17A:
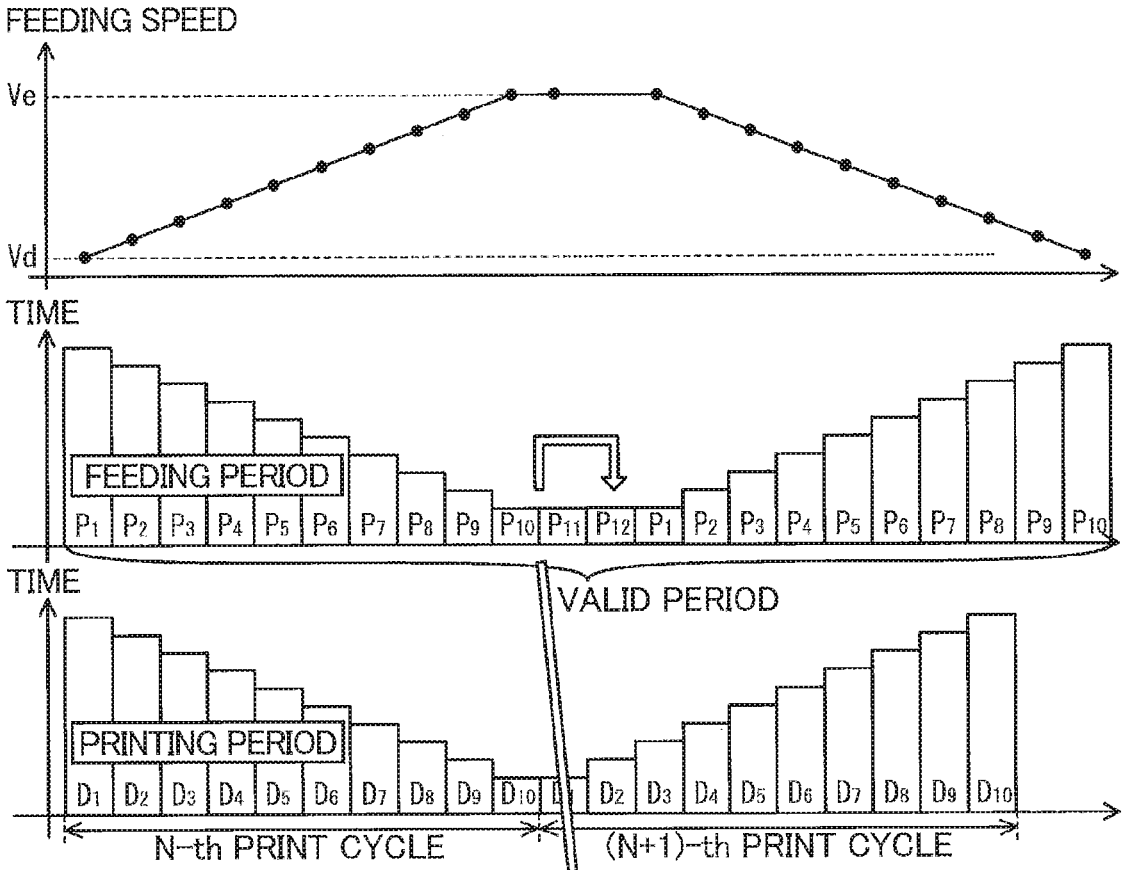

The process up to selecting m number of (m=2) feeding periods (the tenth feeding period $P_{10}$ in the N-th print cycle and the first feeding period $P_1$ in the (N+1)-th print cycle) corresponding to the ratio of the difference between the setting value Li and the actual value Lp to the setting value Li is the same as that described in section 8-1 with reference to FIGS. 15A and 15B and section 8-2 with reference to FIGS. 16A and 16B. Therefore, the process will not be described here. As illustrated in FIG. 17A, the printing device 1 adds eleventh and twelfth feeding periods $P_{11}$ and $P_{12}$ to the feeding periods from the first feeding period $P_1$ in the N-th print cycle to the n-th (n=10) feeding period $P_{10}$ in the (N+1)-th print cycle. The eleventh and twelfth feeding periods $P_1$ and $P_{12}$ each has a time duration that is the same as that of each of the selected m number of (m=2) feeding periods (the tenth feeding period $P_{10}$ in the N-th print cycle and the first feeding period $P_1$ in the (N+1)-th print cycle). The printing device 1 determines the first to tenth feeding periods $P_1$ to $P_{10}$ in the N-th print cycle, the first to tenth feeding periods $P_1$ to $P_{10}$ in the (N+1)-th print cycle, and the eleventh and twelfth feeding periods $P_{11}$ and $P_{12}$ to be valid periods.

Figure 17B:
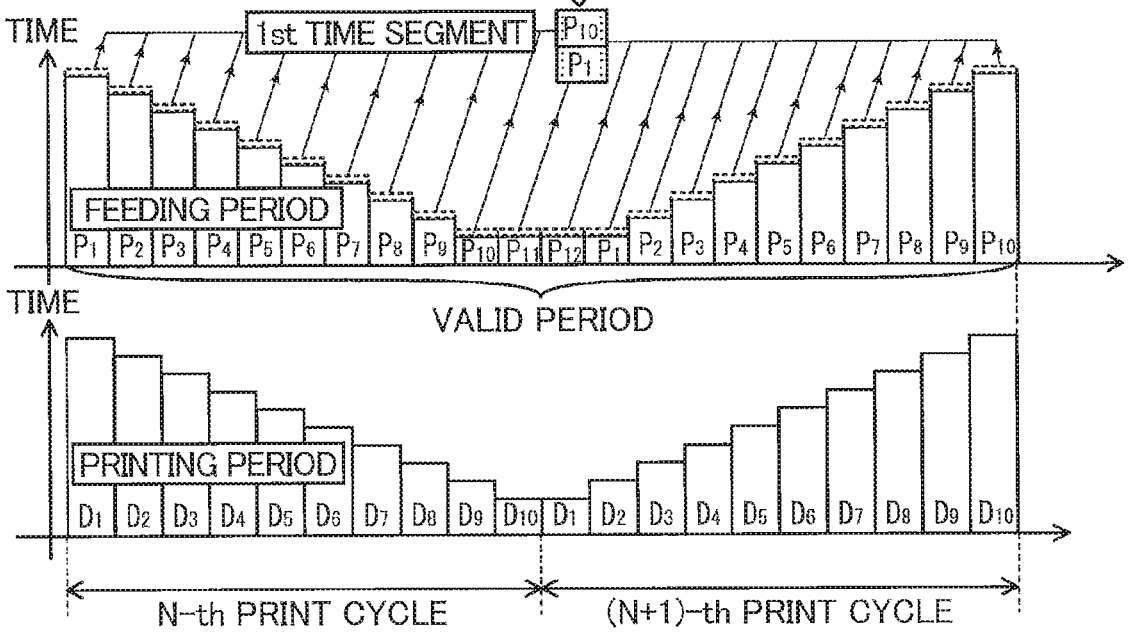

As illustrated in FIG. 17B, the printing device 1 then equally divides the time duration corresponding to the sum of the selected m number of (m=2) feeding periods (the tenth feeding period $P_{10}$ in the N-th print cycle and the first feeding period $P_1$ in the (N+1)-th print cycle) into (2n+m) number of (2n+m=22) time segments, where (2n+m) is the number of valid periods. The resulting time segments are each defined as the first time segment. The printing device 1 then subtracts the first time segment from each of the valid periods (the first to n-th (n=10) feeding periods $P_1$ to $P_{10}$ in the N-th print cycle, the first to n-th (n=10) feeding periods $P_1$ to $P_{10}$ in the (N+1)-th print cycle, and the eleventh and twelfth feeding periods $P_{11}$ and $P_{12}$).

The printing device 1 outputs a pulsed signal to the tape feeding motor 24 during each of the valid periods (the first to n-th (n=10) feeding periods $P_1$ to $P_{10}$ in the N-th print cycle, the first to n-th (n=10) feeding periods $P_1$ to $P_{10}$ in the (N+1)-th print cycle, and the eleventh and twelfth feeding periods $P_{11}$ and $P_{12}$) from which the first time segment is subtracted. As a result, the tape feeding motor 24 is driven to rotate, thereby feeding the tape 31A. The valid periods in the N-th and (N+1)-th print cycles consist of a total of twenty-two feeding periods. This is 10% more than the total number of feeding periods normally included in the N-th and (N+1)-th print cycles. However, in this example, the actual value Lp without adjustment is 10% smaller than the setting value Li. Therefore, the length of the tape 31A to be fed is 10% larger than the actual value Lp without adjustment and coincides with the setting value Li.

Since the first time segment is subtracted from each of the valid periods in the N-th and (N+1)-th print cycles (the first to n-th (n=10) feeding periods $P_1$ to $P_{10}$ in the N-th print cycle, the first to n-th (n=10) feeding periods $P_1$ to $P_{10}$ in the (N+1)-th print cycle, and the eleventh and twelfth feeding periods $P_{11}$ and $P_{12}$), the total time duration of the valid periods coincides with the total time duration of the first to n-th (n=10) printing periods $D_1$ to $D_{10}$ in the N-th print cycle and the first to n-th (n=10) printing periods $D_1$ to $D_{10}$ in the (N+1)-th print cycle. Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles. In this way, an object is printed on the tape 31A.

<8-4. Printing Period Adjustment by First Time Segment (Lp<Li)>

Figure 18A:
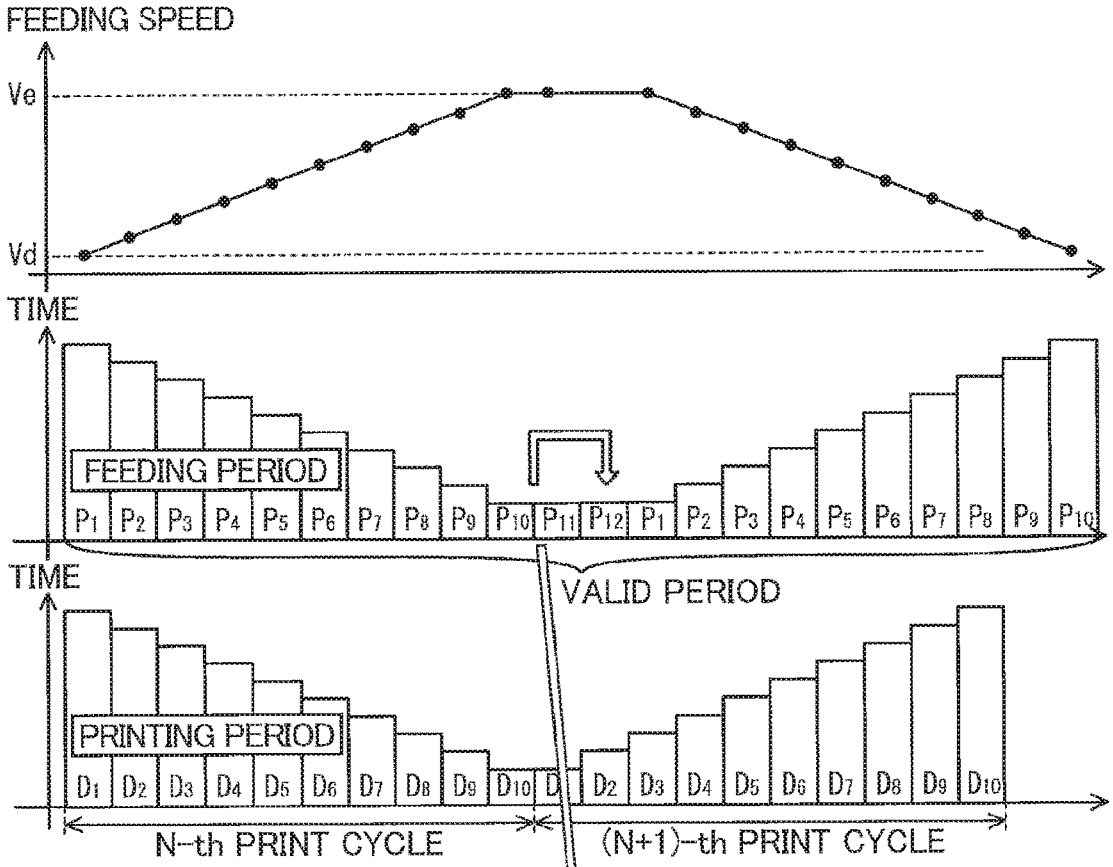
Figure 18B:
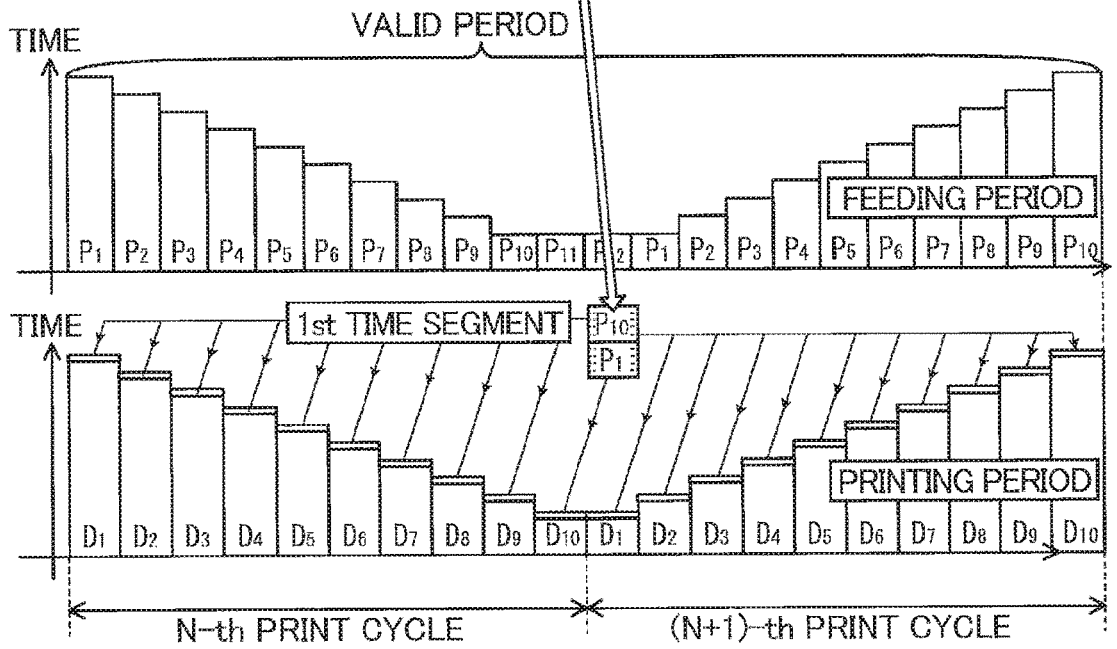

The process up to determining the first to tenth feeding periods $P_1$ to $P_{10}$ in the N-th print cycle, the first to tenth feeding periods $P_1$ to $P_{10}$ in the (N+1)-th print cycle, and the eleventh and twelfth feeding periods $P_{11}$ and $P_{12}$ to be valid periods is the same as that described in section 8-3 with reference to FIG. 17A. Therefore, the process will not be described here but is illustrated in FIG. 18A. Next, as illustrated in FIG. 18B, the printing device 1 equally divides the time duration corresponding to the sum of the selected m number of (m=2) feeding periods (the tenth feeding period $P_{10}$ in the N-th print cycle and the first feeding period $P_1$ in the (N+1)-th print cycle) into 2n number of (2n=20) time segments, where 2n is the number of printing periods in the N-th and (N+1)-th print cycles. The resulting time segments are each defined as the first time segment. The printing device 1 then adds the first time segment to each of the first to n-th (n=10) printing periods $D_1$ to $D_{10}$ in the N-th print cycle and the first to n-th (n=10) printing period $D_1$ to $D_{10}$ in the (N+1)-th print cycle.

The printing device 1 outputs a pulsed signal to the tape feeding motor 24 during each of the valid periods (the first to n-th (n=10) feeding periods $P_1$ to $P_{10}$ in the N-th print cycle, the first to n-th (n=10) feeding periods $P_1$ to $P_{10}$ in the (N+1)-th print cycle, and the eleventh and twelfth feeding periods Pit and $P_{11}$). As a result, the tape feeding motor 24 is driven to rotate, thereby feeding the tape 31A. Therefore, the length of the tape 31A to be fed is 10% larger than the actual value Lp without adjustment and coincides with the setting value Li.

Since the first time segment is added to each of the first to n-th (n=10) printing periods $D_1$ to $D_{10}$ in the N-th print cycle and the first to n-th (n=10) printing periods $D_1$ to $D_{10}$ in the (N+1)-th print cycle, the total time duration of the first to n-th (n=10) printing periods $D_1$ to $D_{10}$ in the N-th and (N+1)-th print cycles coincides with the total time duration of the valid periods (the first to twelfth feeding periods $P_1$ to $P_{12}$ in the N-th print cycle and the first to tenth feeding periods $P_1$ to $P_{10}$ in the (N+1)-th print cycle). Therefore, while the tape 31A is fed in response to the pulsed signal outputted to the tape feeding motor 24 during each valid period in the N-th and (N+1)-th print cycles, dots are printed on the tape 31A during each printing period in the N-th and (N+1)-th print cycles. In this way, an object is printed on the tape 31A.

<9. Print-Length Adjustment Control by Second Time Segment>

Depending on the length of the object to be printed in the feeding direction, the number of feeding periods and the number of the printing periods included in a print cycle at the end of printing may be smaller than the value n (=10). In the example illustrated in FIG. 19A, at the end of printing the object in the N-th print cycle, the feeding speed of the tape 31A decreases and then the feeding of the tape 31A is stopped. In such a case, for example, the (N−1)-th print cycle may only include first to r-th feeding periods $P_1$ to $P_r$ and first to r-th printing periods $D_1$ to $D_r$ (where r is an integer greater than or equal to two and smaller than n), and both of the number of feeding periods in the (N−1)-th print cycle and the number of printing periods in the (N−1)-th print cycle may be smaller than n. In the following description, a case where r is five will be taken as an example.

For example, when the adjustment value is set to −10%, the value m representing the number of feeding periods corresponding to the ratio of the difference between the setting value Li and the actual value Lp to the setting value Li satisfies the relational expression m/(r+n)=|10%|. Since the value (r+n) represents the total number of feeding periods in the (N−1)-the and N-th print cycles and is 15, the value m is determined to be 1.5. When the above-described print-length adjustment control by the first time segment is to be performed, the valid periods are determined by subtracting m number of feeding periods from all the feeding periods in the print cycle. However, if the value m contains a fraction smaller than one, adjustment corresponding to the fraction smaller than one cannot be performed. To solve this issue, the printing device 1 performs print-length adjustment control by a second time segment described later in addition to the print-length adjustment control by a first time segment. In this way, the printing device 1 precisely match the setting value Li and the actual value Lp.

Figure 19A:
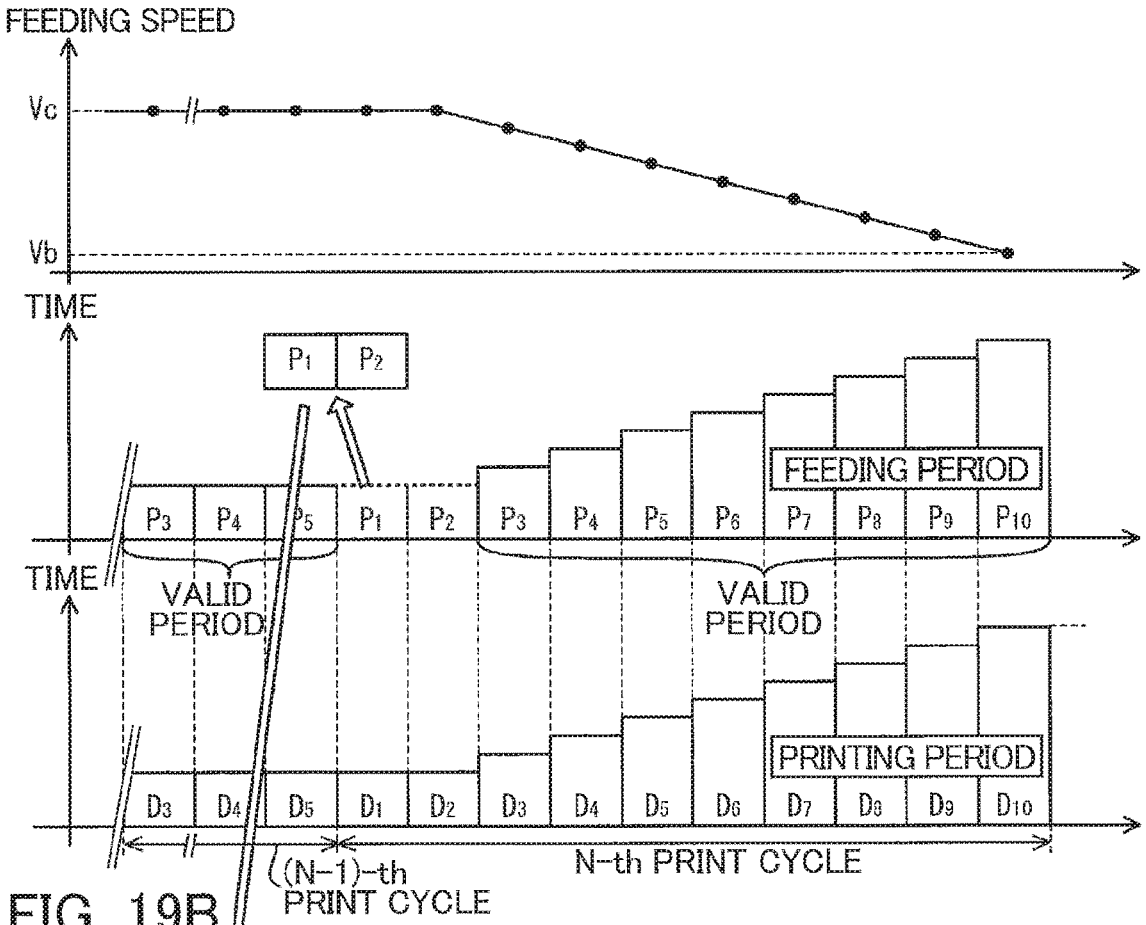

A case in which the feeding speed decreases after being maintained at a constant speed and then the feeding is stopped will now be described with reference to FIGS. 19A and 19B. The printing device 1 tries to determine a value m representing the number of feeding periods corresponding to the ratio of the difference between the setting value Li and the actual value Lp to the setting value Li on the basis of the adjustment value −10%. Here, the value m satisfying the relational expression m/(r+n)=m/15=|−10%| is 1.5. This value cannot be determined as the number of the feeding periods. In such a case, the printing device 1 determines that |−10%| representing the ratio of the difference between the setting value Li and the actual value Lp to the setting value Li corresponds to an intermediate value between (m−1)/(r+n) and m/(r+n), where r+n=15. According to this relation, the printing device 1 determines m to be two, where m=2 satisfies the relation 1/15 (=6.6%)<|−10%|<2/15 (=13.3%). The printing device 1 then performs the feeding period adjustment through the same procedure as that described in section 6-1 with reference to FIGS. 10A and 10B.

More specifically, the printing device 1 selects m number of (m=2) feeding periods (the first and second feeding periods $P_1$ and $P_2$) from the N-th print cycle and subtracts the selected first and second feeding periods $P_1$ and $P_2$ from all the feeding periods $P_1$ to $P_{10}$ in the N-th print cycle. The printing device 1 then determines the third to n-th (n=10) feeding periods $P_3$ to $P_{10}$ remaining in the N-th print cycle and the first to r-th (r=5) feeding periods in the (N−1)-th print cycle to be valid periods, as illustrated in FIG. 19A. The printing device 1 equally divides the first and the second feeding periods $P_1$ and $P_2$ into (r+n+m) number of (r+n+m=13) time segments, where (r+n+m) is the number of valid periods. The resulting time segments are each defined as the first time segment. The printing device 1 then adds the first time segment to each valid period.

In order for time segments corresponding to the intermediate value 10% to be finally added to the valid periods without excess and deficiency, the excess time corresponding to the value obtained by subtracting the intermediate value 10% from m/(r+n) (=2/15=13.3%) becomes excessive. Here, the time duration in the first and second feeding periods $P_1$ and $P_2$ selected from the N-th print cycle corresponds to approximately 13.3% (=2/15) of the total time duration in the (N−1)-th and N-th print cycles. Since the excess time corresponds to 3.3% of the time duration in the first and second feeding periods $P_1$ and $P_2$, the excess time corresponds to 0.004 (=13.3%×3.3%) of the total time duration in the (N−1)-th and N-th print cycles.

Figure 19B:
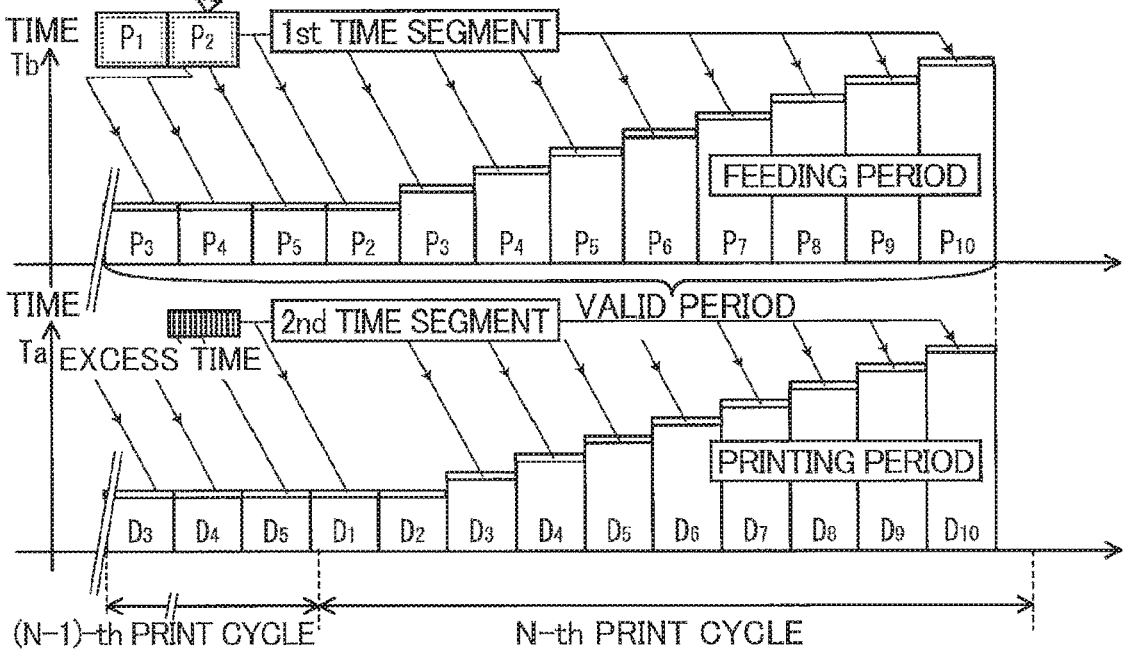

Therefore, as illustrated in FIG. 19B, the printing device 1 equally divides the excess time into (r+n) number of (r+n=15) time segments, where (r+n) is the number of printing periods in the (N−1)-th and N-th print cycles. Hereinafter, each resulting time segment is referred to as a "second time segment." The printing device 1 then adds the second time segment to each of the printing periods in the (N−1)-th and N-th print cycles. The printing device 1 outputs a pulsed signal to the tape feeding motor 24 during each of the valid periods (the first to r-th (r=5) feeding periods $P_1$ to $P_5$ in the (N−1)-th print cycle and the third to n-th (n=10) feeding periods $P_3$ to $P_{10}$ in the N-th print cycle) to which the first time segment is added. As a result, the tape feeding motor 24 is driven to rotate, thereby feeding the tape 31A. The printing device 1 prints dots on the tape 31A during each of the first to r-th (r=5) printing periods $D_1$ to $D_5$ in the (N−1)-th print cycle to which the second time segment is added, and prints dots on the tape 31A during each of the third to n-th (n=10) printing periods $D_3$ to $D_{10}$ in the N-th print cycle to which the second time segment is added. In this way, an object is printed on the tape 31A.

Although not described in detail, the adjustment by the second time segment is also performed as described above when the feeding speed decreases after acceleration and then the feeding is stopped (see FIGS. 15A to 18B).

<10-1. Main Process>

Figure 20:
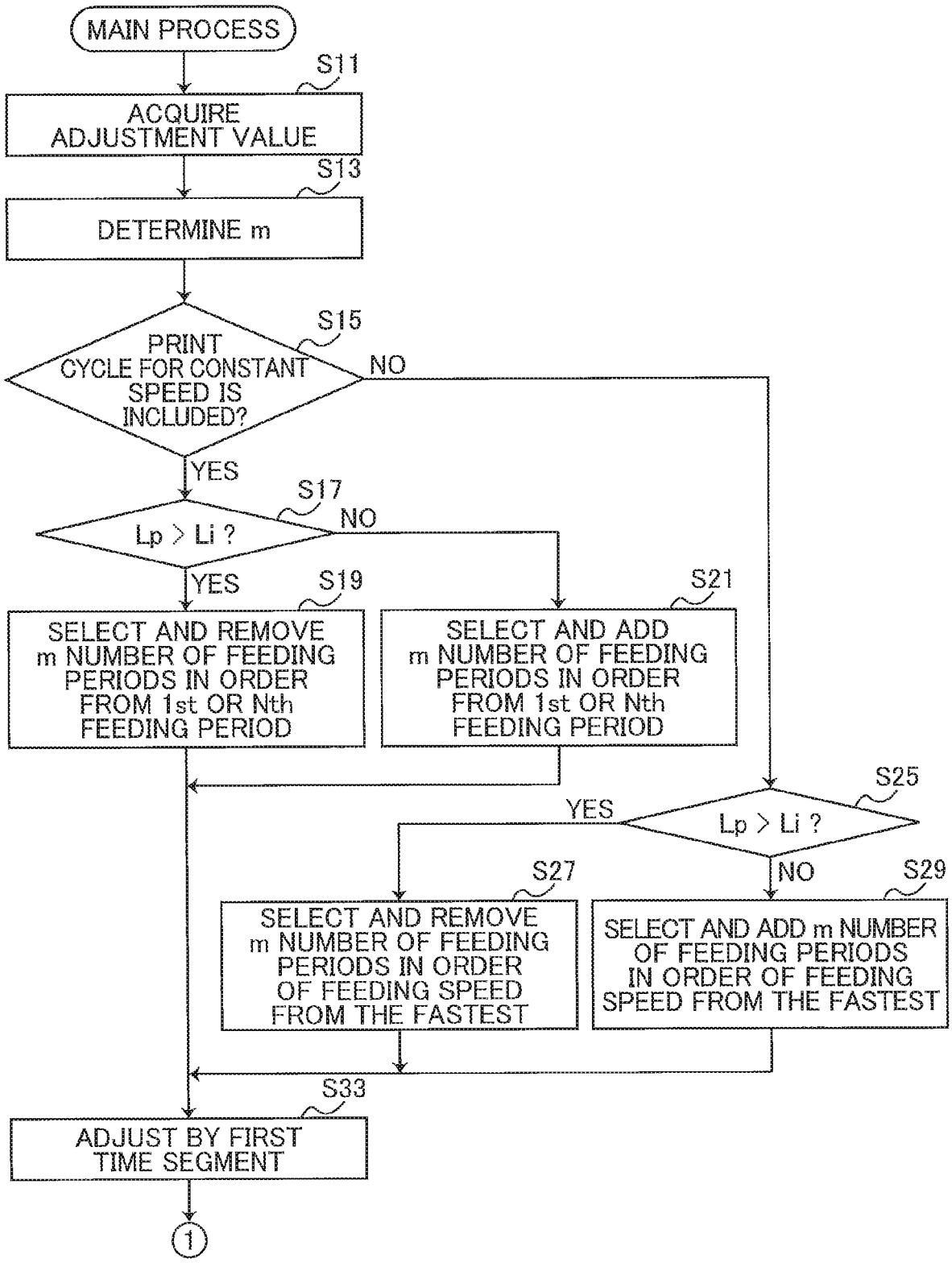
FIG. 20 is a part of a flowchart illustrating a main process performed by the printing device according to the embodiment of the present disclosure.

Next, the main process performed by the CPU 401 of the printing device 1 will be described with reference to FIG. 20. The main process starts when the CPU 401 reads a program stored in the flash memory 410 and executes the program. As illustrated in FIG. 20, in S11 the CPU 401 first acquires an adjustment value set via the operation unit 2. In S13 the CPU 401 determines, using the acquired adjustment value, the number of feeding periods corresponding to the ratio of the difference between the setting value Li and the actual value Lp to the setting value Li as the value m.

The CPU 401 reads print data stored in the flash memory 410 and acquires information on print cycles required for printing an object. In S15 the CPU 401 determines whether a print cycle during which the feeding speed of the tape 31A is maintained at a constant speed (hereinafter, also referred to as a "print cycle for a constant speed") is included. For example, if the setting value Li of the object to be printed is larger than the length corresponding to two print cycles, i.e., a print cycle required for increasing the feeding speed (hereinafter, also referred to as a "print cycle for acceleration") and a print cycle required for decreasing the feeding speed until stopped (hereinafter, also referred to as a "print cycle for deceleration"), a print cycle for a constant speed is included (S15: YES). In this case, the CPU 401 advances to Step S17. If the setting value Li of the object to be printed is smaller than the length corresponding to two print cycles, only a print cycle for acceleration and a print cycle for deceleration are included and the print cycle for a constant speed is not included (S15: NO). In this case, the CPU 401 advances to Step S25.

If a print cycle for a constant speed is included (S15: YES), in S17 the CPU 401 determines whether the actual value Lp is larger than the setting value Li. If the adjustment value is a negative value, the CPU 401 determines that the actual value Lp is larger than the setting value Li (S17: YES). In such a case, in S19 the CPU 401 selects m number of feeding periods from each print cycle using the value m determined in S13. If the feeding speed increases from the first feeding period $P_1$ to the n-th feeding period $P_n$ in a print cycle, the CPU 401 selects the m number of feeding periods in descending order from the n-th feeding period $P_n$ in the print cycle in S19 (see FIGS. 10A, 1A, 12A, and 13A). If the feeding speed decreases from the first feeding period $P_1$ to the n-th feeding period $P_n$ in a print cycle, the CPU 401 selects the m number of feeding periods in ascending order from the first feeding period $P_1$ in the print cycle in S19 (see FIG. 14). If the feeding speed is maintained at a constant speed from the first feeding period $P_1$ to the n-th feeding period $P_n$ in a print cycle, the CPU 401 selects any of the m number of feeding periods in the print cycle in S19 (see FIGS. 6A, 7A, 8A, and 9A). The CPU 401 then remove the selected m number of feeding periods from the first to n-th feeding periods $P_1$ to $P_{10}$ in each print cycle and determines the remaining feeding periods as valid periods in S19 (See FIGS. 6A, 7A, 10A, and 11A). The CPU 401 then advances to Step S33.

If the adjustment value is a positive value, the CPU 401 determines that the actual value Lp is smaller than the setting value Li (S17: NO). In such a case, in S21 the CPU 401 selects the m number of feeding periods from each print cycle using the value m determined in S13. If the feeding speed increases from the first feeding period $P_1$ to n-th feeding period $P_n$ in a print cycle, the CPU 401 selects the m number of feeding periods in descending order from the n-th feeding period $P_n$ the print cycle in S21 (see FIGS. 10A, 11A, 12A, and 13A). If the feeding speed decreases from the first feeding period $P_1$ to the n-th feeding period $P_n$ in a print cycle, the CPU 401 selects the m number of feeding periods in ascending order from the first feeding period $P_1$ in the print cycle in S21 (see FIG. 14). If the feeding speed is maintained at a constant speed from the first feeding period $P_1$ to the n-th feeding period $P_n$ in a print cycle, the CPU 401 selects any of the m number of feeding periods in the print cycle in S21 (see FIGS. 6A, 7A, 8A, and 9A). The CPU 401 then adds the selected m number of feeding periods to the first to n-th feeding periods $P_1$ to $P_n$ in each print cycle and determines these feeding periods as valid periods in S21 (see FIGS. 8A, 9A, 12A, and 13A). The CPU 401 then advances to Step S33.

If a print cycle for a constant speed is not included (S15: NO), in S25 the CPU 401 determines whether the actual value Lp is larger than the setting value Li. If the adjustment value is a negative value, the CPU 401 determines that the actual value Lp is larger than the setting value Li (S25: YES). In such a case, in S27 the CPU 401 selects m number of feeding periods from the first to n-th feeding periods $P_1$ to $P_n$ in the print cycle for acceleration and the first to n-th feeding periods $P_1$ to $P_n$ in the print cycle for deceleration using the value m determined in S13. At this time, the CPU 401 selects the m number of feeding periods from among feeding periods in two print cycles, i.e., the first to n-th feeding periods $P_1$ to $P_n$ in the print cycle for acceleration and the first to n-th feeding periods $P_1$ to $P_n$ in the print cycle for deceleration, in order of feeding speed from the fastest one in S27 (see FIGS. 15A, 16A, 17A, and 18A). The CPU 401 then removes the selected m number of feeding periods from the first to n-th feeding periods $P_1$ to $P_n$ in the two print cycles and determines the remaining feeding periods as valid periods in S27 (see FIGS. 15A and 16A). The CPU 401 then advances to Step S33.

If the adjustment value is a positive value, the CPU 401 determines that the actual value Lp is smaller than the setting value Li (S25: NO). In such a case, in S29 the CPU 401 selects m number of feeding periods from the first to n-th feeding periods $P_1$ to $P_n$ in the print cycle for acceleration and the first to n-th feeding periods $P_1$ to $P_n$ in the print cycle for deceleration using the value m determined in S13. At this time, the CPU 401 selects the m number of feeding periods from among feeding periods in two print cycles, i.e., the first to n-th feeding periods $P_1$ to $P_n$ in the print cycle for acceleration and the first to n-th feeding periods $P_1$ to $P_n$ in the print cycle for deceleration, in order of feeding speed from the fastest one in S29 (see FIGS. 15A, 16A, 17A, and 18A). The CPU 401 then adds the selected m number of feeding periods to the first to n-th feeding periods $P_1$ to $P_n$ in the two print cycles and determines these feeding periods as valid periods in S29 (see FIGS. 16A and 17A). The CPU 401 then advances to Step S33.

In S33 the CPU 401 calculates the first time segment on the basis of the feeding periods selected in corresponding step of S19, S21, S27, and S29. In S33 the CPU 401 adjusts the feeding periods or the printing periods by the calculated first time segment and determines the feeding periods and the printing periods (see FIGS. 6B, 7B, 8B, 9B, 10B, 11B, 13B, 15B, 16B, 17B, and 18B). The CPU 401 then advances to Step S41 (see FIG. 21).

Figure 21:
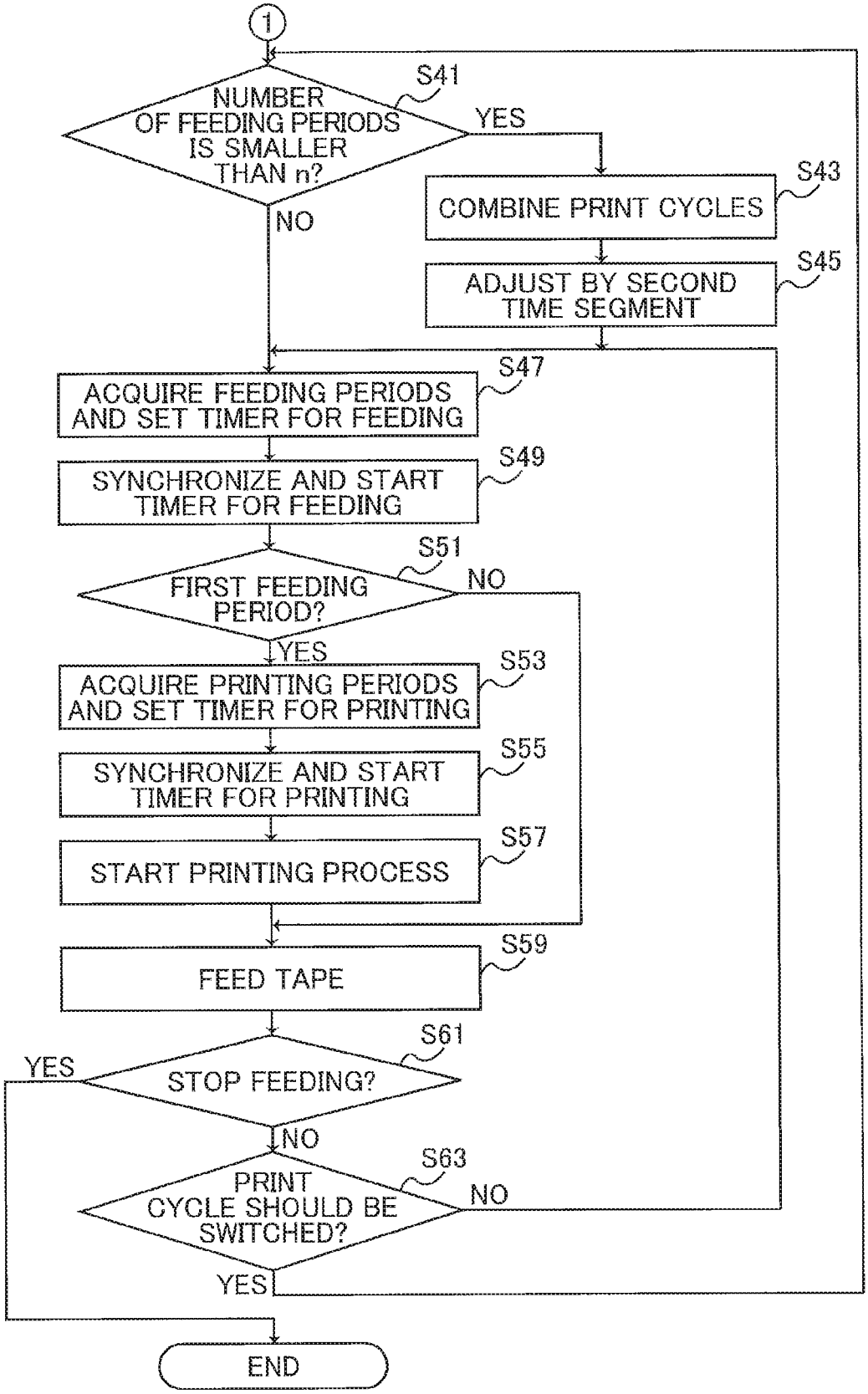
FIG. 21 is the remaining part of the flowchart illustrating the main process performed by the printing device according to the embodiment of the present disclosure.

As illustrated in FIG. 21, in S41 the CPU 401 determines whether the number of feeding periods in the N-th print cycle during which the feeding of the tape 31A is started by process of S47 to S59 described later is smaller than the value n on the basis of the print data read from the flash memory 410. If the number of feeding periods included in the N-th print cycle is n or more (S41: NO), the CPU 401 advances to Step S47.

In S47 the CPU 401 acquires the feeding periods determined in S33 (see FIG. 20), and sets the timer so that a notification is outputted in these feeding periods. In S49 the CPU 401 starts the timer set in S47 (hereinafter, referred to as a "timer for feeding"). In S51 The CPU 401 determines whether it is the timing of the first feeding period $P_1$ in the N-th print cycle. If it is the timing of the first feeding period $P_1$ (S51: YES), in S53 the CPU 401 acquires the printing periods determined in S33 (see FIG. 20), and sets the timer so that a notification is outputted in these printing periods. In S55 the CPU 401 starts the timer set in S53 (hereinafter, referred to as a "timer for printing"). In this way, the first feeding period and the first printing period in the N-th print cycle are synchronized. In S57 the CPU 401 starts the printing process (see FIG. 22) which is a separate task from the main process and is performed in parallel with the main process. The printing process will be described later in detail. After the printing process has been started, the CPU 401 advances to Step S59.

If the CPU 401 determines that it is not the timing of the first feeding period (S51: NO), the CPU 401 advances to Step S59.

The CPU 401 detects the notification outputted from the timer for feeding every set feeding period, and outputs a pulsed signal to the tape feeding motor 24 at every detected timing. In this way, in S59 the tape feeding motor 24 is driven to rotate, and the tape 31A is fed in response to the rotation of the tape feeding motor 24. In such a case, the tape 31A is fed by one pulse worth every time the CPU 401 detects a notification from the timer for feeding.

In S61 the CPU 401 determines whether to stop the feeding of the tape 31A in response to the completion of the printing in all print cycles according to the print data acquired from the flash memory 410. If the CPU 401 determines that the printing has not been completed in all print cycles (S61: NO), the CPU 401 advances to Step S63.

In 863 the CPU 401 determines whether the printing has been completed in the N-th print cycle and the printing should be switched to the (N+1)-th print cycle. If the printing in the N-th print cycle has not been completed (S63: NO), the CPU 401 advances to Step S47. The CPU 401 then sets the timer for feeding (S47), starts the timer for feeding (S49), and continues outputting pulsed signals to the tape feeding motor 24 to continue the feeding of the tape 31A. If printing in the N-th print cycle has been completed, the CPU 401 determines that the printing should be switched to the (N+1)-th print cycle (S63: YES). In such a case, the CPU 401 adds one to the value N to update the print cycle and advances to Step S41.

In S41 the CPU 401 determines whether the number of feeding periods in the N-th print cycle is smaller than the value n. If the number of feeding periods in the N-th print cycle is r, where r is smaller than n (S41: YES), the CPU 401 advances to Step S43. In S43 the CPU 401 combines the N-th print cycle including r number of feeding periods and the (N+1)-th print cycle including n number of feeding periods into one print cycle including (r+n) number of feeding periods (hereinafter, referred to as a "combined cycle"). In S45 the CPU 401 calculates the second time segment through the procedure illustrated in FIGS. 19A and 19B and determines the printing periods by adjusting the printing periods in the combined cycle by adding the second time segment to each printing period. The CPU 401 then advances to Step S47.

In process of S47 to S61, a pulsed signal is outputted to the tape feeding motor 24 in every feeding period in the combined cycle, and the tape 31A is fed. The CPU 401 acquires the printing periods determined in S45 and sets the timer for printing so that notifications are outputted in the printing periods (S53). The CPU 401 starts the timer for printing set in S53 (S55). In such a case, in the printing process described later with reference to FIG. 22, printing is performed in the printing periods adjusted by the second time segment. If the CPU 401 determines to stop the feeding of the tape 31A in response to the completion of the printing in all print cycles according to the print data (S61: YES), the CPU 401 ends the main process.

<10-2. Printing Process>

Figure 22:
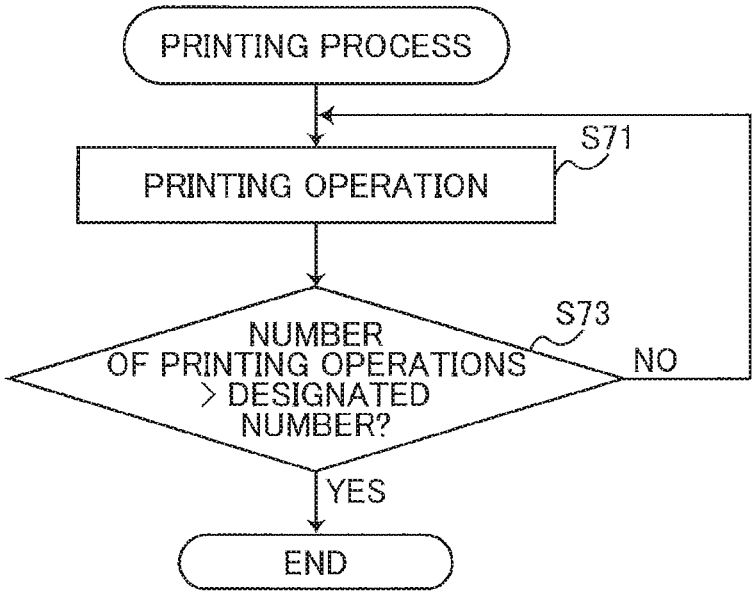
FIG. 22 is a flowchart illustrating a printing process performed by the printing device according to the embodiment of the present disclosure.

Next, the printing process will be described with reference to FIG. 22. The printing process is started in Step S57 of the main process (see FIG. 21) and is performed in parallel with the main process. The CPU 401 acquires the number of printing periods included in the current print cycle as a designated number according to the print data acquired from the flash memory 410 in the main process.

The CPU 401 detects a notification outputted from the timer for printing every printing period set in S53 of the main process (see FIG. 21) and heats the thermal head 10 at the timing of detection. In this way, in S71 the printing device 1 prints an object on the tape 31A fed in the feeding process (see FIG. 21). In such a case, the printing device 1 prints one line worth of the object each time the CPU 401 detects a notification outputted from the timer for printing. The CPU 401 then updates the number of printing operations and advances to Step S73.

In S73 the CPU 401 determines whether the updated number of printing operations is greater than the designated number. If the number of printing operations is smaller than or equal to the designated number (S73: NO), the CPU 401 returns to the process of S71 and repeats printing the object. If the updated number of printing operations is greater than the designated number (S73: YES), the CPU 401 determines that the printing has been completed in all the relevant print cycles, and ends the printing process.

<Operational and Technical Advantages of the Embodiment>

The printing device 1 selects m number of feeding periods corresponding to the ratio of the difference between the setting value Li and the actual value Lp to the setting value Li in feeding period adjustment (S19, S21, S27, and S29). The printing device 1 updates the valid periods by applying the first time segment obtained by dividing the time duration corresponding to the m number of feeding periods and by applying the first time segment to the printing periods (S33).

When a print cycle for increasing or decreasing the feeding speed (print cycle for acceleration or print cycle for deceleration) adjoins a print cycle for a constant feeding speed, the printing device 1 applies the first time segment to the valid periods or the printing periods in the print cycle for increasing or decreasing the feeding speed and, simultaneously, applies the first time segment to the valid periods or the printing periods in the print cycle for a constant feeding speed. The printing device 1 selects the m number of feeding periods to be removed (excluded) or added for determining the valid periods from feeding periods in the print cycle for increasing or decreasing the feeding speed in order from the feeding period closest to the print cycle for a constant feeding speed. When the feeding speed in the N-th print cycle increases and the feeding speed in the (N+1)-th print cycle decreases, the printing device 1 selects the m number of feeding periods to be removed (excluded) or added for determining the valid periods from the feeding periods in the two print cycles in order of feeding speed from the feeding period corresponding to the fastest feeding speed.

This allows the printing device 1 to suppress the feeding speed and the printing speed from varying during the transition between print cycles. Therefore, the printing device 1 can precisely perform non-synchronized printing even when the feeding speed and/or the printing speed varies during print cycles. Note that the printing device 1 calculates the first time segment by equally dividing m number of feeding periods. In this way, the printing device 1 can facilitate the adjustment of the feeding periods by the first time segment.

When the feeding speed in the N-th print cycle increases or decreases and the feeding speed in the (N+1)-th print cycle is maintained at constant, the printing device 1 sets the feeding speed in the p-th to n-th feeding periods in the N-th print cycle to be the same as the feeding speed in the (N+1)-th print cycle. When the feeding speed of the (N−1)-th print cycle is maintained at constant and the feeding speed of the N-th print cycle increases or decreases, the printing device 1 sets the feeding speed of the first to p-th feeding periods in the N-th print cycle to be the same as the feeding speed in the feeding periods in the (N−1)-th print cycle. This allows the printing device 1 to reduce the possibility of the feeding speed or the printing speed varying during the transition between print cycles even when the selected m number of feeding periods are removed or added.

If the ratio of the difference between the setting value TA and the actual value Lp to the setting value Li corresponds to an intermediate value between (m−1)/(r+n) and m/(r+n) (S41: YES), the second time segment is calculated and applied to the printing periods (45). This allows the printing device 1 to adjust, through print-length adjustment control, even the slight difference between the setting value Li and the actual value Lp that cannot be adjusted merely by removing or adding feeding periods. Therefore, the printing device 1 can precisely match the setting value Li and the actual value Lp through the print-length adjustment control. Note that the printing device 1 calculates the second time segment by equally dividing the excess time. In this way, the printing device 1 can facilitate the adjustment of printing periods by the second time segment.

Without adjustment, the number of feeding periods and the number of printing periods are the same n in all print cycles. This allows the printing device 1 to share the processes between the print cycles. In this way, the load of the printing operation can be reduced. In each print cycle, the first feeding period and the first printing period are synchronized, but the second to n-th feeding periods and the second to n-th printing periods are not synchronized. This allows the printing device 1 to precisely match the setting value Li and the actual value Lp by adjusting the individual feeding periods or the individual printing periods in the print cycles even when the actual value Lp without adjustment and the setting value Li do not match.

<Modifications>

While the description has been made in detail with reference to specific embodiments, it would be apparent to those skilled in the art that various changes and modifications may be made thereto. In the examples illustrated in FIGS. 10A to 13B, the feeding speed increases in the N-th print cycle and is maintained at constant in the (N+1)-th print cycle. However, the same process may be performed even when the feeding speed decreases in the N-th print cycle and is maintained at constant in the (N+1)-th print cycle. In the example illustrated in FIG. 14, the feeding speed in the (N−1)-th print cycle is maintained at constant in the (N−1)-th print cycle and decreases in the N-th print cycle. However, the same process can be performed even when the feeding speed is maintained at constant in the (N−1)-th print cycle and increases in the N-th print cycle.

In FIGS. 10A to 13B, the feeding speed in the feeding periods in the N-th print cycle may not necessarily vary uniformly. Therefore, for example, the feeding periods in the N-th print cycle may decrease and then increase. For example, the N-th print cycle may include a feeding period for a constant feeding speed. This is also the same for the case illustrated in FIG. 14.

The calculation of the first time segment and the second time segment is not limited to equally dividing the m number of feeding periods. Therefore, each of the first time segment and the second time segment may consist of a plurality of time segments each of which have different time duration.

When the feeding speed increases or decreases in the N-th print cycle and is maintained at constant in the (N+1)-th print cycle, the feeding speed may vary in the p-th to n-th feeding periods in the N-th print cycle. Similarly, the feeding speed in the p-th to n-th feeding periods in the N-th print cycle may be same as the feeding speed in the (N+1)-th print cycle. When the feeding speed is maintained at constant in the (N−1)-th print cycle and increases or decreases in the N-th print cycle, the printing device 1 may vary the feeding speed in the first to p-th feeding periods in the N-th print cycle.

The printing device 1 may only adjust the printing periods by the second time segment without adjusting the feeding periods by the first time segment. For example, an arbitrary value (for example, −3%) may be set as an adjustment value in the printing device 1. The printing device 1 determines that the ratio |−3%| of the difference between the setting value Li and the actual value Lp to the setting value Li, corresponds to an intermediate value smaller than 1/n (=10%). The printing device 1 then equally divides the time duration corresponding to the ratio |−3%| of the n-th printing period into n number of time segments. Each resulting time segment corresponds to the second time segments. Next, the printing device 1 adds the second time segment to each of the first to n-th printing periods in the print cycle. The printing device 1 outputs a pulsed signal to the tape feeding motor 24 during each of the feeding periods. As a result, the tape feeding motor 24 is driven to rotate, thereby feeding the tape 31A. The printing device 1 prints a dot on the tape 31A during the time duration of each printing period to which the second time segment is added. In this way, an object is printed on the tape 31A.

In such a case, the printing device 1 can adjust, through print-length adjustment control, even the slight difference between the setting value Li and the actual value Lp that cannot be adjusted by merely removing or adding feeding periods. Therefore, the printing device 1 can match the setting value Li and the actual value Lp even more precisely.

<Note>

The CPU 401 is an example of the controller of the present disclosure. The tape 31A is an example of the printing medium of the present disclosure. The flash memory 410 is an example of the memory of the present disclosure. The tape feeding motor 24 is an example of the motor of the present disclosure.

What is claimed is:

1. A printing device comprising:

a motor used for conveying a printing medium in a conveying direction;

a controller configured to output a pulse, the motor being configured to be driven to rotate in response to receiving the pulse, the printing medium being conveyed in the conveying direction at a conveying speed in response to the motor being driven to rotate; and a memory storing a set of program instructions therein, the set of program instructions, when executed by the controller, causing the printing device to perform a plurality of print cycles one by one to print an object, the plurality of print cycles including an N-th print cycle where N is an integer greater than or equal to one, each of the print cycles including a plurality of conveying periods from a first conveying period to an n-th conveying period and a plurality of printing periods from a first printing period to an n-th printing period where n is an integer greater than or equal to two, the pulse being outputted in each of the plurality of conveying periods, a portion of the object being printed in each of the plurality of printing periods, the object being designed to have a first length in the conveying direction and being expected to have a second length in the conveying direction in actual printed size, the conveying speed of the printing medium being increased or decreased during at least part of the plurality of conveying periods in the N-th print cycle, the N-th print cycle comprising:

(a) selecting, in a case where the second length does not match the first length, m number of conveying periods from among the plurality of conveying periods where m is an integer greater than or equal to one and smaller than n, m being set to a value corresponding to a first ratio of a difference between the first length and the second length to the first length;

(b) setting one or more valid conveying periods based on the selected m number of conveying periods;

(c) obtaining a first time duration by dividing a time duration corresponding to the selected m number of conveying periods into a plurality of time segments;

(d) adjusting a time duration of each of the one or more valid conveying periods using the first time duration; and (e) performing the one or more valid conveying periods in parallel with performing the plurality of printing periods, the (e) performing comprising:

(e1) outputting the pulse in each of the one or more valid conveying periods to convey the printing medium in response to the motor being driven to rotate upon receipt of the pulse; and (e2) printing the portion of the object on the printing medium in each of the plurality of printing periods, wherein in a case where the conveying speed is increased from the first conveying period to the n-th conveying period in the N-th print cycle, the (a) selecting selects the m number of conveying periods in descending order from the n-th conveying periods, wherein in a case where the conveying speed is decreased from the first conveying period to the n-th conveying period in the N-th print cycle, the (a) selecting selects the m number of conveying periods in ascending order from the first conveying periods, wherein in a case where the second length is greater than the first length, the (b) setting sets (n−m) number of conveying periods as the one or more valid conveying periods by removing the selected m number of conveying periods from the plurality of conveying periods in the N-th print cycle, the (c) obtaining divides the time duration corresponding to the selected m number of conveying periods into (n−m) number of time segments and calculates, as the first time duration, (n−m) number of time durations corresponding to respective ones of the (n−m) number of time segments, and the (d) adjusting adds the (n−m) number of time durations to respective ones of the one or more valid conveying periods, and wherein in a case where the second length is smaller than the first length, the (b) setting sets (n+m) number of conveying periods as the one or more valid conveying periods by adding the selected m number of conveying periods to the plurality of conveying periods in the N-th print cycle, the (c) obtaining divides the time duration corresponding to the selected m number of conveying periods into (n+m) number of time segments and calculates, as the first time duration, (n+m) number of time durations corresponding to respective ones of the (n+m) number of time segments, and the (d) adjusting subtracts the (n+m) number of time durations from respective ones of the one or more valid conveying periods.

2. The printing device according to claim 1, wherein the plurality of print cycles further includes an (N+1)-th print cycle successively performed following the N-t print cycle, the conveying speed of the printing medium reaching a prescribed speed in the n-th conveying period in the N-th print cycle and being maintained at the prescribed speed during the first conveying period to the n-th conveying period in the (N+1)-th print cycle, wherein in the (N+1)-th print cycle, the (a) selecting selects m number of conveying periods from among the plurality of conveying periods in the (N+1)-th print cycle, wherein in a case where the (d) adjusting adds the first time duration to the time duration corresponding to each of the one or more valid conveying periods in the N-th print cycle, in the (N+1)-th print cycle, the (b) setting sets (n−m) number of conveying periods as the one or more valid conveying periods in the (N+1)-th print cycle by removing the selected m number of conveying periods from the plurality of conveying periods in the (N+1)-th print cycle, and the (d) adjusting adds the first time duration to each of the one or more valid conveying periods in the (N+1)-th print cycle, and wherein in a case where the (d) adjusting subtracts the first time duration from the time duration corresponding to each of the one or more valid conveying periods in the N-th print cycle, in the (N+1)-th print cycle, the (b) setting sets (n+m) number of conveying periods as the one or more valid conveying periods in the (N+1)-th print cycle by adding the selected m number of conveying periods to the plurality of conveying periods in the (N+1)-th print cycle, and the (d) adjusting subtracts the first time duration from each of the one or more valid conveying periods in the (N+1)-th print cycle.

3. The printing device according to claim 1, wherein in a case where the second length is greater than the first length, the (c) obtaining equally divides the time duration corresponding to the selected m number of conveying periods into the (n−m) number of time segments and obtains a time duration corresponding to each of the (n−m) number of time segments as the first time duration, and wherein in a case where the second length is smaller than the first length, the (c) obtaining equally divides the time duration corresponding to the selected m number of conveying periods into the (n+m) number of time segments and obtains a time duration corresponding to each of the (n+m) number of time segments as the first time duration.

4. The printing device according to claim 1, wherein the plurality of print cycles further includes an (N+1)-th print cycle successively performed following the N-th print cycle, the conveying speed of the printing medium reaching a prescribed speed in the n-th conveying period in the N-th print cycle and being maintained at the prescribed speed during the first conveying period to the n-th conveying period in the (N+1)-th print cycle, and wherein the plurality of conveying periods includes a p-th conveying period where p is an integer greater than or equal to two and smaller than m, the conveying speed of the printing medium being maintained at the prescribed speed during the p-th conveying period to the n-th conveying period in the N-th print cycle.

5. The printing device according to claim 1, wherein the plurality of print cycles further includes an (N−1)-th print cycle successively performed prior to the N-th print cycle, the conveying speed of the printing medium being maintained at a prescribed speed during the first conveying period to the n-th conveying period in the (N−1)-th print cycle, and wherein the plurality of conveying periods includes a p-th conveying period where p is an integer greater than or equal to two and smaller than m, the conveying speed of the printing medium being maintained at the prescribed speed during the first conveying period to the p-th conveying period in the N-th print cycle.

6. The printing device according to claim 1, wherein the plurality of print cycles further includes an (N−1)-th print cycle successively performed prior to the N-th print cycle, the plurality of conveying periods includes an r-th conveying period where r is an integer greater than or equal to two and smaller than n, and the plurality of printing periods includes an r-th printing periods, wherein in the (N−1)-th print cycle, the (e1) outputting is performed in each of the first conveying period to the r-th conveying period and the (e2) printing is performed in each of the first printing period to the r-th printing period, and wherein in a case where the first ratio is an intermediate value between (m−1)/(r+n) and m/(r+n) in the (a) selecting of the N-th print cycle, the (c) obtaining further obtains a second time duration by dividing an excess time duration into (r+n) number of time segments, the excess time duration being obtained by multiplying the time duration corresponding to the selected m number of conveying periods by a second ratio obtained by subtracting the intermediate value from m/(r+n), the (c) obtaining calculating, as the second time duration, (r+n) number of time durations corresponding to respective ones of the (r+n) number of time segments, and the (d) adjusting adds the (r+n) number of time durations to respective ones of (r+n) number of printing periods including the first printing period to the r-th printing period in the (N−1)-th print cycle and the first printing period to the n-th printing period in the N-th print cycle.

7. The printing device according to claim 6, wherein the (c) obtaining equally divides the excess time duration into the (r+n) number of time segments and obtains a time duration corresponding to each of the (r+n) number of time segments as the second time duration.

8. The printing device according to claim 1, wherein in each of the plurality of print cycles, the first conveying period and the first printing period are synchronously performed in synchronization, and the plurality of conveying periods except the first conveying period and the plurality of printing periods except the first printing period are asynchronously performed.

9. The printing device according to claim 1, wherein each of the plurality of the print cycles including a same number of conveying periods prior to performing the (a) selecting, the (b) setting, the (c) obtaining, and the (d) adjusting.

10. A printing device comprising:

a motor used for conveying a printing medium in a conveying direction;

a controller configured to output a pulse, the motor being configured to be driven to rotate in response to receiving the pulse, the printing medium being conveyed in the conveying direction at a conveying speed in response to the motor being driven to rotate; and a memory storing a set of program instructions therein, the set of program instructions, when executed by the controller, causing the printing device to perform a plurality of print cycles one by one to print an object, the plurality of print cycles including an N-th print cycle where N is an integer greater than or equal to one, each of the print cycles including a plurality of conveying periods from a first conveying period to an n-th conveying period and a plurality of printing periods from a first printing period to an n-th printing period where n is an integer greater than or equal to two, the pulse being outputted in each of the plurality of conveying periods, a portion of the object being printed in each of the plurality of printing periods, the object being designed to have a first length in the conveying direction and being expected to have a second length in the conveying direction in actual printed size, the conveying speed of the printing medium being increased or decreased during at least part of the plurality of conveying periods in the N-th print cycle, the N-th print cycle comprising:

(a) selecting, in a case where the second length does not match the first length, m number of conveying periods from among the plurality of conveying periods where m is an integer greater than or equal to one and smaller than n, m being set to a value corresponding to a first ratio of a difference between the first length and the second length to the first length;

(b) setting one or more valid conveying periods based on the selected m number of conveying periods;

(c) obtaining a first time duration by dividing a time duration corresponding to the selected m number of conveying periods into n number of time segments, n number of time durations corresponding to respective ones of the n number of time segments being calculated as the first time duration;

(d) adjusting a time duration of each of the plurality of printing periods using the first time duration; and (e) performing the one or more valid conveying periods in parallel with performing the plurality of printing periods, the (e) performing comprising:

(e1) outputting the pulse in each of the one or more valid conveying periods to convey the printing medium in response to the motor being driven to rotate upon receipt of the pulse; and (e2) printing the portion of the object on the printing medium in each of the plurality of printing periods, wherein in a case where the conveying speed is increased from the first conveying period to the n-th conveying period in the N-th print cycle, the (a) selecting selects the m number of conveying periods in descending order from the n-th conveying periods, wherein in a case where the conveying speed is decreased from the first conveying period to the n-th conveying period in the N-th print cycle, the (a) selecting selects the m number of conveying periods in ascending order from the first conveying periods, wherein in a case where the second length is greater than the first length, the (d) adjusting subtracts the n number of time durations from respective ones of the plurality of printing periods, and wherein in a case where the second length is smaller than the first length, the (d) adjusting adds the n number of time durations to respective ones of the plurality of printing periods.

11. The printing device according to claim 10, wherein the plurality of print cycles further includes an (N+1)-th print cycle successively performed following the N-th print cycle, the conveying speed of the printing medium reaching a prescribed speed in the n-th conveying period in the N-th print cycle and being maintained at the prescribed speed during the first conveying period to the n-th conveying period in the (N+1)-th print cycle, wherein in a case where the (d) adjusting subtracts the n number of time durations from respective ones of the plurality of printing periods in the N-th print cycle, in the (N+1)-th print cycle, the (d) adjusting subtracts the n number of time durations from respective ones of the plurality of printing periods in the (N+1)-th print cycle, and wherein in a case where the (d) adjusting adds the n number of time durations to respective ones of the plurality of printing periods in the N-th print cycle, in the (N+1)-th print cycle, the (d) adjusting adds the n number of time durations to respective ones of the plurality of printing periods in the (N+1)-th print cycle.

12. The printing device according to claim 10, wherein the (c) obtaining equally divides the time duration corresponding to the selected m number of conveying periods into the n number of time segments and obtains a time duration corresponding to each of the n number of time segments as the first time duration.

13. A printing device comprising:

a motor used for conveying a printing medium in a conveying direction;

a controller configured to output a pulse, the motor being configured to be driven to rotate in response to receiving the pulse, the printing medium being conveyed in the conveying direction at a conveying speed in response to the motor being driven to rotate; and a memory storing a set of program instructions therein, the set of program instructions, when executed by the controller, causing the printing device to perform: a plurality of print cycles one by one to print an object, the plurality of print cycles including an N-th print cycle and an (N+1)-th print cycle successively performed following the N-th print cycle where N is an integer greater than or equal to one, each of the print cycles including a plurality of conveying periods from a first conveying period to an n-th conveying period and a plurality of printing periods from a first printing period to an n-th printing period where n is an integer greater than or equal to two, the pulse being outputted in each of the plurality of conveying periods, a portion of the object being printed in each of the plurality of printing periods, the object being designed to have a first length in the conveying direction and being expected to have a second length in the conveying direction in actual printed size, the conveying speed of the printing medium being increased from the first conveying period to the n-th conveying period in the N-th print cycle and being decreased from the first conveying period to the n-th conveying period in the (N+1)-th print cycle, the N-th print cycle and the (N+1)-th print cycle comprising:

(a) selecting, in a case where the second length does not match the first length, m number of conveying periods from among the plurality of conveying periods in the N-th print cycle and the plurality of conveying periods in the (N+1)-th print cycle where m is an integer greater than or equal to one and smaller than n, m being set to a value corresponding to a ratio of a difference between the first length and the second length to the first length, the m number of conveying periods being selected in order of the conveying speed from a fastest conveying speed;

(b) setting one or more valid conveying periods based on the selected m number of conveying periods;

(c) obtaining a first time duration by dividing a time duration corresponding to the selected m number of conveying periods into a plurality of time segments;

(d) adjusting a time duration of each of the one or more valid conveying periods using the first time duration; and (e) performing the one or more valid conveying periods in parallel with performing the plurality of printing periods in the N-th print cycle and the plurality of printing periods in the (N+1)-th print cycle, the (e) performing comprising:

(e1) outputting the pulse in each of the one or more valid conveying periods to convey the printing medium in response to the motor being driven to rotate upon receipt of the pulse; and (e2) printing the portion of the object on the printing medium in each of the plurality of printing periods in the N-th print cycle and the plurality of printing periods in the (N+1)-th print cycle, wherein in a case where the second length is greater than the first length, the (b) setting sets (2n−m) number of conveying periods as the one or more valid conveying periods by removing the selected m number of conveying periods from the plurality of conveying periods in the N-th print cycle and the plurality of conveying periods in the (N+1)-th print cycle, the (c) obtaining divides the time duration corresponding to the selected m number of conveying periods into (2n−m) number of time segments and calculates, as the first time duration, (2n−m) number of time durations corresponding to respective ones of the (2n−m) number of time segments, and the (d) adjusting adds the (2n-m) number of time durations to respective ones of the one or more valid conveying periods, and wherein in a case where the second length is smaller than the first length, the (b) setting sets (2n+m) number of conveying periods as the one or more valid conveying periods by adding the selected m number of conveying periods to the plurality of conveying periods in the N-th print cycle and the plurality of conveying periods in the (N+1)-th print cycle, the (c) obtaining divides the time duration corresponding to the selected m number of conveying periods into (2n+m) number of time segments and calculates, as the first time duration, (2n+m) number of time durations corresponding to respective ones of the (2n+m) number of time segments, and the (d) adjusting subtracts the (2n+m) number of time durations from respective ones of the one or more valid conveying periods.

14. The printing device according to claim 13, wherein in a case where the second length is greater than the first length, the (c) obtaining equally divides the time duration corresponding to the selected m number of conveying periods into (2n−m) number of time segments and obtains a time duration corresponding to each of the (2n−m) number of time segments as the first time duration, and wherein in a case where the second length is smaller than the first length, the (c) obtaining equally divides the time duration corresponding to the selected m number of conveying periods into (2n+m) number of time segments and obtains a time duration corresponding to each of the (2n+m) number of time segments as the first time duration.

15. A printing device comprising:

a motor used for conveying a printing medium in a conveying direction;

a controller configured to output a pulse, the motor being configured to be driven to rotate in response to receiving the pulse, the printing medium being conveyed in the conveying direction at a conveying speed in response to the motor being driven to rotate; and a memory storing a set of program instructions therein, the set of program instructions, when executed by the controller, causing the printing device to perform a plurality of print cycles one by one to print an object, the plurality of print cycles including an N-th print cycle and an (N+1)-th print cycle successively performed following the N-th print cycle where N is an integer greater than or equal to one, each of the print cycles including a plurality of conveying periods from a first conveying period to an n-th conveying period and a plurality of printing periods from a first printing period to an n-th printing period where n is an integer greater than or equal to two, the pulse being outputted in each of the plurality of conveying periods, a portion of the object being printed in each of the plurality of printing periods, the object being designed to have a first length in the conveying direction and being expected to have a second length in the conveying direction in actual printed size, the conveying speed of the printing medium being increased from the first conveying period to the n-th conveying period in the N-th print cycle and being decreased from the first conveying period to the n-th conveying period in the (N+1)-th print cycle, the N-th print cycle and the (N+1)-th print cycle comprising:

(a) selecting, in a case where the second length does not match the first length, m number of conveying periods from among the plurality of conveying periods in the N-th print cycle and the plurality of conveying periods in the (N+1)-th print cycle where m is an integer greater than or equal to one and smaller than n, m being set to a value corresponding to a ratio of a difference between the first length and the second length to the first length, the m number of conveying periods being selected in order of the conveying speed from a fastest conveying speed;

(b) setting one or more valid conveying periods based on the selected m number of conveying periods;

(c) obtaining a first time duration by dividing a time duration corresponding to the selected m number of conveying periods into a 2n number of time segments, 2n number of time durations corresponding to respective ones of the 2n number of time segments being calculated as the first time duration;

(d) adjusting a time duration of each of the plurality of printing periods in the N-th print cycle and the plurality of printing periods in the (N+1)-th print cycle using the first time duration; and (e) performing the one or more valid conveying periods in parallel with performing the plurality of printing periods in the N-th print cycle and the plurality of printing periods in the (N+1)-th print cycle, the (e) performing comprising:

(e1) outputting the pulse in each of the one or more valid conveying periods to convey the printing medium in response to the motor being driven to rotate upon receipt of the pulse; and (e2) printing the portion of the object on the printing medium in each of the plurality of printing periods in the N-th print cycle and the plurality of printing periods in the (N+1)-th print cycle, wherein in a case where the second length is greater than the first length, the (b) setting sets (2n−m) number of conveying periods as the one or more valid conveying periods by removing the selected m number of conveying periods from the plurality of conveying periods in the N-th print cycle and the plurality of conveying periods in the (N+1)-th print cycle, and the (d) adjusting subtracts the 2n number of time durations from respective ones of the plurality of printing periods in the N-th print cycle and the plurality of printing periods in the (N+1)-th print cycle, and wherein in a case where the second length is smaller than the first length, the (b) setting sets (2n+m) number of conveying periods as the one or more valid conveying periods by adding the selected m number of conveying periods to the plurality of conveying periods in the N-th print cycle and the plurality of conveying periods in the (N+1)-th print cycle, and the (d) adjusting adds the 2n number of time durations to respective ones of the plurality of printing periods in the N-th print cycle and the plurality of printing periods in the (N+1)-th print cycle.

16. The printing device according to claim 15, wherein the (c) obtaining equally divides the time duration corresponding to the selected m number of conveying periods into the 2n number of time segments and obtains a time duration corresponding to each of the 2n number of time segments as the first time duration.

* * * * *